US005500290A

United States Patent [19]

Udagawa et al.

[11] Patent Number: 5,500,290

[45] Date of Patent: Mar. 19, 1996

[54] SURFACE TREATED STEEL SHEET

[75] Inventors: Satoru Udagawa; Masaki Abe; Satoru Ando; Yasuhiro Matsuki; Toyofumi Watanabe; Yukimitsu Shiohara; Masaya Morita; Akimasa Kido, all of Kawasaki, Japan

[73] Assignee: NKK Corporation, Tokyo, Japan

[21] Appl. No.: 265,239

[22] Filed: Jun. 24, 1994

[30] Foreign Application Priority Data

| | | | |
|---|---|---|---|
| Jun. 29, 1993 | [JP] | Japan | 5-158502 |
| Jun. 29, 1993 | [JP] | Japan | 5-158503 |
| Sep. 2, 1993 | [JP] | Japan | 5-218565 |
| Dec. 13, 1993 | [JP] | Japan | 5-311937 |
| Apr. 18, 1994 | [JP] | Japan | 6-079008 |
| Apr. 18, 1994 | [JP] | Japan | 6-079009 |
| Apr. 25, 1994 | [JP] | Japan | 6-086709 |
| Apr. 25, 1994 | [JP] | Japan | 6-086710 |
| May 31, 1994 | [JP] | Japan | 6-119163 |
| May 31, 1994 | [JP] | Japan | 6-119164 |

[51] Int. Cl.[6] ..... B32B 15/18

[52] U.S. Cl. ..... 428/610; 428/658; 428/659; 428/679; 428/941

[58] Field of Search ..... 428/610, 658, 428/659, 679, 941

[56] References Cited

U.S. PATENT DOCUMENTS

| | | | |
|---|---|---|---|
| 4,013,488 | 3/1977 | Ramqvist et al. | 428/679 |
| 4,608,320 | 8/1986 | Mochizuki et al. | 428/679 |
| 4,731,301 | 3/1988 | Higuchi et al. | 428/679 |
| 4,758,479 | 7/1988 | Swatnirajan et al. | 428/659 |
| 4,999,258 | 3/1991 | Wake et al. | 428/658 |
| 5,019,460 | 5/1991 | Yasuda et al. | 428/659 |
| 5,059,493 | 10/1991 | Takahata | 428/679 |
| 5,069,981 | 12/1991 | Oishi et al. | 428/659 |
| 5,156,690 | 10/1992 | Asano et al. | 428/659 |
| 5,203,985 | 4/1993 | Nishimura et al. | 427/433 |
| 5,384,206 | 1/1995 | Ushioda et al. | 428/659 |

FOREIGN PATENT DOCUMENTS

| | | | |
|---|---|---|---|
| 59-162292 | 9/1984 | Japan | 428/658 |
| 60-184687 | 9/1985 | Japan | 428/679 |
| 2-190462 | 7/1990 | Japan | 428/659 |
| 3-150315 | 6/1991 | Japan . | |
| 3-229846 | 10/1991 | Japan | 428/659 |
| 3-253541 | 11/1991 | Japan . | |
| 4-141554 | 5/1992 | Japan . | |
| 4-168246 | 6/1992 | Japan . | |

OTHER PUBLICATIONS

Translation of Japanese Kokai 4–6259, Jan. 10, 1992.
Translation of Japanese Kokai 61–124580, Jun. 12, 1986.
Translation of Japanese Kokai 3–226550, Oct. 7, 1991.
Translation of Japanese Kokai 63–312960, Dec. 21, 1988.
Database WPI, Derwent Publications Ltd., London, GB, AN 93–129315 C16 of JP–A–5 065 595 (Nippon Steel Corp.) 19 Mar. 1993.
Patent Abstracts Of Japan, vol. 12, No. 338 (C–527) 12 Sep. 1988 of JP–A–63 096 294 (Nippon Steel Corp) 27 Apr. 1988.
Patent Abstracts Of Japan, vol. 10, No. 314 (C–380) 24 Oct. 1986 of JP–A–61 124 580 (Nippon Steel Corp) 12 Jun. 1986.
Patent Abstracts Of Japan, vol. 11, No. 141 (C–421) 8 May 1987 of JP–A–61 279 696 (Nippon Steel Corp) 10 Dec. 1986.

(List continued on next page.)

*Primary Examiner*—John Zimmerman
*Attorney, Agent, or Firm*—Frishauf, Holtz, Goodman, Langer & Chick

[57] ABSTRACT

A surface treated steel sheet comprises: a steel sheet containing C, Si, Mn, P, S, Ni, Ti, Cu and B; a diffused alloy layer containing Fe, Ni, and P; and a zinc coating layer formed on the diffused alloy layer.

A method for producing a surface treated steel sheet comprises the steps of: preparing a steel sheet; coating the steel sheet with a Ni-P coating layer; heat-treating the steel sheet coated with the Ni-P coating layer; and forming a zinc coating layer on the diffused alloy layer.

25 Claims, 6 Drawing Sheets

OTHER PUBLICATIONS

Patent Abstracts Of Japan, vol. 15, No. 353 (C–0865) 6 Sep. 1991 of JP–A–03 138 374 (Mitsubishi Electric Corp) 12 Jun. 1991.

Database WPI, Derwent Publications Ltd., London, GB, AN 80–51153C C29 "Deposition Of Nickel–Phosphorus Alloys" of SU–A–699 037 (Kazanovtsev) 28 Nov. 1979.

Patent Abstracts Of Japan, vol. 16, No. 148 (C–0928) 13 Apr. 1992 of JP–A–04 006 259 (Nippon Steel Corp) 10 Jan. 1992.

Patent Abstracts Of Japan, vol. 13, No. 156 (C–585) 14 Apr. 1989 of JP–A–63 312 960 (Nippon Steel Corp) 21 Dec. 1988.

Patent Abstracts Of Japan, vol. 15, No. 512 (C–0898) 26 Dec. 1991 of JP–A–03 226 550 (Nippon Steel Corp) 7 Oct. 1991.

SURFACE TREATED STEEL SHEET

BACKGROUND OF THE INVENTION

1. Field of the Invention

The present invention relates to a surface treated steel sheet having excellent corrosion resistance and being suitable for a steel sheet used for automobiles, building materials, electric equipment, and other applications, and relates to a method for producing thereof.

2. Description of the Related Arts

Cold-rolled steel sheets and other steel sheets used in automobiles have been reducing their sheet thickness aiming at the reduction of car-body weight and the reduction of production cost. The reduction of sheet thickness, however, reduces the net thickness after corrosion, which induces a problem of insufficient strength of the car-body after corroded. One of the most simple means to improve the corrosion resistance of automobile steel sheet is the increase of coating weight of zinc. The means, however, results in the increase of cost, and also induces a problem of separation of coating layer during the steel sheet working to expose the steel base material which is vulnerable to corrosion. In addition, the coating weight gives a significant effect to the spot welding which is widely employed in assembling automobile parts. In concrete terms, the increase of coating weight enhances the degradation of weldability. The steel sheets used in automobiles are requested to have a good formability such as deep drawing capability, as well as low cost. Responding to that kind of requirements, various types of steel sheets have been introduced, but none has fully satisfied those requirements.

For example, Japanese Patent Unexamined Publication (hereinafter referred to simply as "JP-A-") No. 3-253541 discloses that a steel of Cu-P system with reduced C, adding slight amount of S, and adding a specified amount of Si and Ti exhibits excellent corrosion resistance under an environment of repeated dry and wet cycle. JP-A-3-150315 discloses a method for producing steel sheet using a Cu-P system with reduced C and adding slight amount of Ni to give excellent corrosion resistance and formability. JP-A-4-141554 discloses a cold-rolled steel sheet having excellent corrosion resistance and having a high strength and a method for producing the steel sheet. JP-A-4-168246 discloses a cold-rolled steel sheet containing P, Ti, Nb, etc. and having excellent formability and corrosion resistance.

However, the steel sheet disclosed in JP-A-3-253541 is a Ti-killed steel, and the steel tends to generate surface defects and tends to induce nozzle plugging during the slab production in a continuous casting line. The method disclosed in JP-A-3-150315 specifies the use of box-annealing as the re-crystallizing crystallizing annealing to improve the formability. The box-annealing has, however, a tendency of cost increase and of segregation of P, which makes the steel brittle and degrades the workability.

The steel sheet disclosed in JP-A-4-141554 has disadvantages of the elongation (El) of less than 40%, Lankford value (rm value) of less than 2.0, which indicates an insufficient press-formability. In addition, a steel containing Cu, P, and Cr has a disadvantage of poor resistance to pitting. The cold-rolled steel sheet disclosed in JP-A-4-168246 contains P, Ti, Nb, etc., and that type of steel induces the occurrence of NbC to degrade the corrosion resistance.

SUMMARY OF THE INVENTION

The object of the present invention is to provide a surface treated steel sheet having excellent corrosion resistance and workability and to provide a method for producing thereof.

To achieve the object, the present invention provides a surface treated steel sheet comprising:

a steel sheet consisting essentially of:

0.001 to 0.005 wt. % C, 0.1 wt. % or less Si, 0.05 to 0.3 wt. % Mn, 0.02 wt. % or less P, 0.001 to 0.01 wt. % S, 0.05 to 0.3 wt. % Ni, 0.005 to 0.1 wt. % Ti, 0.05 to 0.3 wt. % Cu, 0.0002 to 0.002 wt. % B, and the balance being Fe;

S and Cu satisfying the following equation;

$$(S\ wt.\ \%/Cu\ wt.\ \%) \leqq 0.1;$$

a diffused alloy layer containing Fe, Ni, and P, the diffused alloy layer being formed on at least one surface of the steel sheet.

The surface treated steel sheet may further comprises a zinc coating layer formed on the diffused alloy layer.

Furthermore, the present invention provides a method for producing a surface treated steel sheet comprising the steps of:

preparing a steel sheet consisting essentially of:

0.001 to 0.005 wt. % C, 0.1 wt. % or less Si, 0.05 to 0.3 wt. % Mn, 0.02 wt. % or less P, 0.001 to 0.01 wt. % S, 0.004 wt. % or less N, 0.1 wt. % or less sol.Al 0.05 to 0.3 wt. % Ni, 0.005 to 0.1 wt. % Ti, 0.05 to 0.3 wt. % Cu, 0.0002 to 0.002 wt. % B, and the balance being Fe;

S and Cu satisfying the following equation;

$$(S\ wt.\ \%/Cu\ wt.\ \%) \leqq 0.1;$$

pickling the steel sheet;

coating the steel sheet with a Ni-P coating layer containing 8 to 18 wt. % P on at least one surface of the pickled steel sheet;

heat-treating the steel sheet coated with the Ni-P coating layer at a temperature of 500° to 880° C. in a non-oxidizing atmosphere to form a diffused alloy layer containing Fe, Ni,and P on the steel base material; and annealing the heat-treated steel sheet.

The method for producing a surface treated steel sheet may further comprises step the of forming a zinc coating layer on the diffused alloy layer.

Still further, the present invention provides a surface treated steel sheet comprising:

a steel sheet consisting essentially of:

0.001 to 0.006 wt. % C, less than 0.35 wt. % Si, 0.05 to 0.5 wt. % Mn, 0.03 to 0.08 wt. % P, less than 0.01 wt. % S, 0.01 to 0.1 wt. % sol.Al, 0.0035 wt. % or less N, 0.1 to 0.5 wt. % Cu, 0.1 to 0.5 wt. % Ni, 0.01 to 0.06 wt. % Ti, 0.003 to 0.015 wt. % Nb, 0.0002 to 0.002 wt. % B, and the balance being Fe;

the steel having the composition satisfying the following equations;

$$(P\ wt.\ \%/200) \leqq B\ wt.\ \%,$$
$$4 \times C\ wt.\ \% < Ti\ wt.\ \% - (48/14) \times N\ wt.\ \% - (48/32) \times S\ wt.\ \%,$$
$$0.004 \leqq Nb\ wt.\ \% \times (10 \times P\ wt.\ \% + 2 \times Cu\ wt.\ \% + Ni\ wt.\ \%)$$

diffused alloy layer being formed on at least one surface of the steel sheet.

The surface treated steel sheet may further comprises a zinc coating layer formed on the diffused alloy layer.

Furthermore, the present invention provides a method for producing a surface treated steel sheet comprising the steps of:

preparing a steel sheet consisting essentially of:

0.001 to 0.006 wt. % C, less than 0.35 wt. % Si, 0.05 to 0.5 wt. % Mn, 0.03 to 0.08 wt. % P, less than 0.01 wt. % S, 0.01 to 0.1 wt. % sol.Al, 0.0035 wt. % or less N, 0.1 to 0.5 wt. % Cu, 0.1 to 0.5 wt. % Ni, 0.01 to 0.06 wt. % Ti, 0.003 to 0.015 wt. % Nb, 0.0002 to 0.002 wt. % B, and the balance being Fe;

the steel having the composition satisfying the following equations;

$$(P\ wt.\ \%/200) \leqq B\ wt.\ \%,$$
$$4 \times C\ wt.\ \% < Ti\ wt.\ \% - (48/14) \times N\ wt.\ \% - (48/32) \times S\ wt.\ \%,$$
$$0.004 \leqq Nb\ wt.\ \% \times (10 \times P\ wt.\ \% + 2 \times Cu\ wt.\ \% + Ni\ wt.\ \%)$$

pickling the steel sheet for descaling;

coating the steel sheet with a Ni-P layer containing 8 to 18 wt. % P on at least one surface of the pickled steel sheet;

heat-treating the steel sheet coated with Ni-P layer at a temperature of 750° to 900° C. in a non-oxidizing atmosphere to form a diffused alloy layer containing Fe, Ni, and P on the steel sheet; and annealing the heat-treated steel sheet.

The method for producing a surface treated steel sheet may further comprises the step of forming a zinc coating layer on the diffused alloy layer.

Still further, the present invention provides a surface treated steel sheet comprising:

a steel sheet consisting essentially of:

0.002 to 0.01 wt. % C, 1 wt. % or less Si, 0.05 to 1 wt. % Mn, 0.02 to 0.1 wt. % P, 0.01 wt. % or less S, 0.1 wt. % or less sol.Al, 0.004 wt. % or less N, 0.0005 to 0.002 wt. % B, 0.2 to 0.5 wt. % Cu, 0.1 to 0.5 wt. % Ni, 0.002 to 0.05 wt. % Sn, and at least one element selected from the group consisting of 0.005 to 0.1 wt. % Ti and 0.002 to 0.05 wt. % Nb, and the balance being Fe;

the steel having the composition satisfying the following equation:

$$2 \leqq 1000 \times Sn\ wt.\ \% \times (2 \times;\ P\ wt.\ \% + Cu\ wt.\ \% + Ni\ wt.\ \%) \leqq 20;$$

a diffused alloy layer containing Fe, Ni and P, the diffused alloy layer being formed on at least one surface of the steel sheet.

The surface treated steel sheet may further comprises a zinc coating layer formed on the diffused alloy layer.

Furthermore, the present invention provides a method for producing a surface treated steel sheet comprising the steps of:

preparing a steel sheet consisting essentially of:

0.002 to 0.01 wt. % C, 1 wt. % or less Si, 0.05 to 1 wt. % Mn, 0.02 to 0.1 wt. % P, 0.01 wt. % or less S, 0.1 wt. % or less sol.Al, 0.004 wt. % or less N, 0.0005 to 0.002 wt. % B, 0.2 to 0.5 wt. % Cu, 0.1 to 0.5 wt. % Ni, 0.002 to 0.05 wt. % Sn, and at least one element selected from the group consisting of 0.005 to 0.1 wt. % Ti and 0.002 to 0.05 wt. % Nb, and balance being Fe;

the steel having the composition satisfying the following equation:

$$2 \leqq 1000Sn\ wt.\ \% \times (2 \times P\ wt.\ \% + Cu\ wt.\ \% + Ni\ wt.\ \%) \leqq 20;$$

pickling the steel sheet for descaling;

coating the steel sheet with a Ni-P layer containing 8 to 18 wt. % P on at least one surface of the pickled steel sheet;

heat-treating the steel sheet coated with Ni-P layer at a temperature of 500° to 880° in a non-oxidizing atmosphere to form a diffused alloy layer containing Fe, Ni, and P on the steel base material; and annealing the heat-treated steel sheet.

The method for producing a surface treated steel sheet may further comprises the step of forming a zinc coating layer on the diffused alloy layer.

DESCRIPTION OF THE PREFERRED EMBODIMENT

EMBODIMENT-1

A detailed description of the invention is given bellow.

Following is the experimental result which provides the basis of the present invention.

There prepared several steel sheets which have the basic composition of 0.001 to 0.005 wt. % C, 0.1 wt. % or less Si, 0.05 to 0.3 wt. % Mn, 0.02 wt. % or less P, 0.004 wt. % or less N, 0.05 to 0.3 wt. % Ni, 0.1 wt. % or less sol.Al,and the balance being Fe and inevitable impurities, and which further have a varied composition containing 0.2 wt. % or less S, 0.005 to 0.1 wt. % Ti, 0.025 wt. % or less Nb, 0.0002 to 0.002 wt. % B, and 0.3 wt. % or less Cu. On at least one surface of each steel sheet, a diffused alloy layer containing Fe-Ni-P as the main composition and further containing one or more of W, Mo, Cr, and Cu was formed. A zinc-system coating was applied on the diffused alloy layer. The corrosion resistance of thus prepared surface treated steel sheets was studied.

Each of the prepared steel sheets was exposed at non-painting condition under a corrosive environment of repeated dry/wet cycles combined with salt spraying for 60 days. The resulted corrosion depth on the surface was measured. The evaluation of the corrosion resistance was determined by the average depth of corrosion. The average depth of corrosion was determined by dividing the exposed area on the steel surface into segments of 10 mm×10 mm unit area and by measuring the maximum corrosion depth in each segment for averaging the total values.

Figure 1:
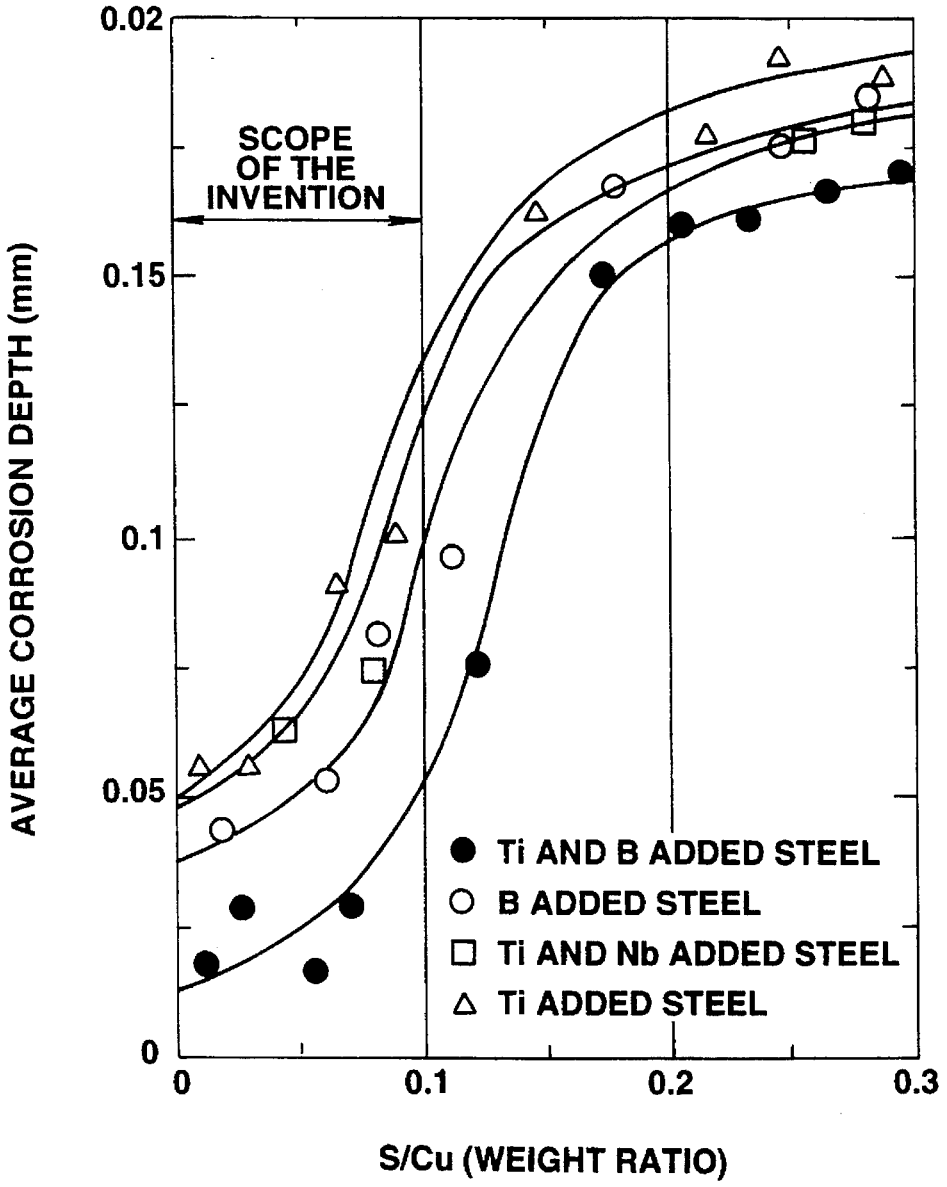
FIG. 1 is a graphical representation showing the relationship between S/Cu and average corrosion depth of the present invention.

FIG. 1 shows the relation between the determined average corrosion depth and the weight ratio of S/Cu. FIG. 1 points out that the corrosion resistance of each steel increases with the decrease of S/Cu value. When the average corrosion depth is compared among Ti added steel, Ti and Nb added steel, Nb added steel, B added steel, and Ti and B added steel, it is clear that the Ti and B added steel having the S/Cu value of 0.1 or less significantly improves the corrosion resistance. The reason of the superiority of the Ti and B added steel is presumably that Ti forms TiC to inhibit the occurrence of carbon solid solution and that B segregates to grain boundaries to suppress the corrosion beginning from the grain boundaries.

The reason that the steels other than the Ti and B added steel is inferior in the corrosion resistance is speculated as follows. As for the B added steel containing solely B, B is an element to form a nitride so that the carbon solid solution remains in the steel. The carbon solid solution not only exists in the ferrite grains but also segregates to grain boundaries. The segregation makes B difficult to exist at grain boundaries. As a result, the steel containing only B is inferior in the corrosion resistance. For a Ti added steel, no corrosion suppressing effect of B segregating toward the grain boundaries is expected, so the corrosion resistance is also poor. Regarding a Nb added steel, Nb forms NbC, and no carbon solid solution exists. Nevertheless, Nb does not segregate to grain boundaries so that Nb should not much affect the corrosion resistance. In this respect, the steel of this invention, which contains both Ti and Nb, leaves no carbon solid solution in the steel structure and allows to exist B at grain boundaries. The structure gives a significant effect of corrosion resistance, and clearly has the remarkably superior corrosion resistance to that of Ti added steel, Ti and Nb added steel and B added steel.

The reason of specifying the composition of steel is described below. The unit of % is wt. %.

C: Less C content is better for securing formability of steel sheet. The upper limit is specified as 0.005%. The C content of less than 0.001% increases the production cost. Therefore, this invention specifies the C content of 0.001 to 0.005%. More preferable range is 0.003% or less.

Si: Silicon degrades the chemical conversion treatment capability and gives bad effect to the post-painting corrosion resistance. Accordingly, less Si content is preferable. However, considering the production cost, the invention specifies as 0.1% or less.

Mn: Less Mn content is better for improving the corrosion resistance, and the invention specifies the upper limit at 0.3%. Considering the production cost, however, a substantial lower limit is 0.05%. Consequently, this invention specifies the Mn content of 0.05 to 0.3%.

P: Phosphorus tends to segregate to central region during hot working, so an excess addition of P induces cracks during working. Smaller added amount of P is better, and the invention specifies the upper limit as 0.02%.

S: Sulfur gives a significant effect on the corrosion resistance required by the invention. Sulfur bonds with Mn to yield MnS. The MnS acts as the nucleus of the initial stage rust which gives a bad effect to the corrosion resistance, so a lower S content is better for corrosion resistance. However, when the S content becomes below 0.001%, the production cost increases and the scale separating ability during pickling decreases. On the other hand, S content above 0.01% significantly degrades the corrosion resistance of the steel. As a result, this invention specifies the S content of 0.001 to 0.01%.

N: Less N content is preferred to improve the formability of steel. The invention specifies 0.004% as the upper limit to maintain the effect of the invention. The most preferable upper limit is 0.003%.

sol.Al: Aluminum is effective as a de-oxidizing element for steel. However, the addition of 0.1% or more Al gives not much improving effect on the de-oxidation, so the invention specifies the sol.Al content as 0.1% or less.

B: Boron segregates to the grain boundaries and suppresses the propagation of corrosion from the boundaries. Since a very low carbon steel (IF steel) has particularly clean grain boundaries, the addition of B enhances the segregation of B to the grain boundaries, which is effective for improving the corrosion resistance. The B addition also strengthens the grain boundaries. However, the addition of less than 0.0002% B gives relatively small effects. On the other hand, B increases the thermal deformation resistance during hot working so that the addition of B over 0.002% likely induces the problems of defective shape and insufficient sheet thickness during hot rolling. Therefore, this invention specifies the B content of 0.0002 to 0.002%.

Ni: When Cu is added to a steel, the generation of surface defects increases during hot working owing to the included Cu. Nickel is effective to reduce the surface defect generation. The Ni content of less than 0.05% can not give the effect, and above 0.3% degrades the formability of steel and increases the production cost. Accordingly, this invention specifies the Ni content of 0.05 to 0.3%.

Ti: Titanium generates TiN, TiS, etc. to reduce N, S, etc. and plays an important role for improving the corrosion resistance. Also Ti decreases carbon solid solution in steel to improve the deep drawing performance. However, the Ti content of less than 0.005% gives not much effect, and the content of above 0.1% increases the production cost. Consequently, this invention specifies the Ti content of 0.005 to 0.1%.

Cu: Copper is a useful element for improving the corrosion resistance. The addition of Cu at, however, less than 0.05% gives no effective corrosion resistance, and the content above 0.3% gives not much improving effect for corrosion resistance and results in a cost increase and degradation of surface quality and workability. Accordingly, this invention specifies the Cu content of 0.05 to 0.3%.

Adding to the above described elements, this invention specifies the value of S/Cu, the ratio of the content of S which strongly affects the corrosion occurrence to the content of Cu which is effective to corrosion resistance. As described before, the existence of S and Cu at a ratio of 0.1 or less prevents the bad effect of S and effectively performs the Cu effect for improving corrosion resistance.

Small amount of inevitable impurities such as Cr, Sn, and V which enter into the steel during steel making process is acceptable, and those inevitable impurities do no degrade the effect of this invention.

With the components described above, the steel sheet has an extremely high corrosion resistance. Nevertheless, as a steel sheet for automobile which is operated under a severe environment, further improved corrosion resistance is required.

For obtaining further corrosion resistance, this invention forms a diffused alloy layer consisting mainly of Fe-Ni-P on a steel sheet having the composition above described. The diffused alloy layer protects the base steel material from corrosion and, once the corrosion of the base steel sheet begins, makes the iron corrosion product promptly dense structure. As a result, the steel sheet obtains excellent corrosion resistance which could not attained in the prior arts.

The diffused alloy layer consisting essentially of Fe-Ni-P may further contain at least one element selected from the group consisting of N, Mo, Cr, and Cu. Those elements play a role of inhibitor to steel corrosion and show an effect to improve the denseness and stability of initial stage rust by the synergistic effect with Ni and P.

Following is the condition for producing the steel sheet of this invention.

According to the invention, a steel sheet having the composition described above undergoes descaling by pickling treatment, and is coated with Ni-P alloy layer containing P of 8 to 15 wt. %. The coating is applied before the annealing, and it may be applied immediately after the pickling at the exit of the pickling line before the cold rolling or may be applied after the cold rolling succeeding to the pickling. Particularly when the coating is given before the cold rolling, there appears an advantage that no pickling is required as the cleaning and activating the sheet before coating.

The Ni-P coating containing P of 8 to 18% forms an amorphous-like structure. When a steel sheet having that type of coating layer is subjected to heat treatment, a uniform diffused alloy layer is formed within a short period compared with the case of common crystalline coating layers. A Ni-P coating containing P of less than 8% forms a crystalline layer and gives non-uniform P distribution. As a result, that type of coating has non-uniform composition of diffused alloy layer when it is subjected to heat treatment, and the initial stage rust is insufficient in its uniformity and denseness, which gives unstable corrosion resistance. On the other hand, a coating containing P of above 18% makes the Ni-P alloy coating brittle and degrades the adhesiveness of the coating layer. A Ni-P coating containing P of less than 8% forms a crystalline layer and gives non-uniform P distribution. As a result, that type of coating has non-uniform composition of diffused alloy layer when it is subjected to heat treatment, and the initial rust is insufficient in its uniformity and denseness, which results unstable corrosion resistance. On the other hand, a coating containing P of above 18% makes the Ni-P alloy coating brittle and degrades the adhesiveness of the coating layer. As a result, the separation of coating layer tends to occur during cold rolling stage or the like. Therefore, this invention specifies the P content in the coating layer formed on the steel sheet in a range of from 8 to 18%. The more preferable range is from 10 to 13%.

As described above, the diffused alloy layer consisting essentially of Fe-Ni-P may contain at least one element selected from group consisting of W, Mo, Cr, and Cu to suppress the corrosion of steel and to further improve the denseness and stability of the initial stage rust. In that case, however, the Ni-P coating layer employs a composite of Ni-P with at least one element selected from group consisting of N, Mo, Cr, and Cu in an amount of up to 15%. The corrosion resistance increases with the increase of the content of N, Mo, Cr, and Cu. However, when the sum of the added amount of N, Mo, Cr, and Cu exceeds 15%, the adhesiveness of the coating layer degrades, and likely generates the separation of coating layer during cold rolling or the like. Therefore, the content of the sum of Mo, Cr, and Cu is specified as up to 15%. A preferable lower limit of the sum of N, Mo, Cr, and Cu to perform the effect of the addition is 0.5%.

The coating weight of the Ni-P alloy layer is specified as 0.05 g/m$^2$ to 8 g/m$^2$. The coating weight of less than 0.05 g/m$^2$ gives insufficient improvement of corrosion resistance, and the coating weight of above 8 g/m$^2$ degrades the workability of coating layer and induces separation of the layer. Furthermore, an excess coating weight needs to slow the line speed, which is a disadvantage in production yield.

Several methods for forming Ni-P alloy coating layer have been introduced. Among them, the electroplating or electroless coating (chemical coating) are preferred from the viewpoint of simplicity of operation and quality of obtained film.

The next step is the heat treatment of the steel sheet coated with Ni-P alloy layer in a non-oxidizing atmosphere to form a diffused alloy layer consisting essentially of Fe-Ni-P at the interface of the base steel sheet and the Ni-P coating layer. The heat treatment for diffusion also performs the ordinary annealing after the cold rolling, and the heat treatment may be done in a common annealing facility employed for annealing. In particular, a continuous annealing which offers a high productivity is preferred. The continuous annealing may be conducted in a continuous annealing facility for common rolled steel sheets or may be conducted in an annealing facility as the pre-treating unit of hot dip coating line. The continuous annealing preferably uses the heating by a direct firing furnace at a heating speed of 50° C./sec. or more.

A preferred maximum steel sheet temperature during the heat treatment is from 500° to 880° C., and more preferably from 800° to 880°C. The heat treatment at below 500° C. can not form a sufficient diffused layer between the Ni-P alloy coating layer and the steel sheet surface, and the insufficient dense-rust formation during the corrosion process gives only a small effect for improving corrosion resistance. On the other hand, the heat treatment at above 880° C. tends to induce a pickup of coating material to the surface of the rolls in the heat treatment furnace, which may cause the surface flaw on the steel sheets. Furthermore, the annealing at above 880° C. induces the growth of coarse ferrite grains which may cause rough surface after press-forming. A preferred range of holding time at the maximum temperature of the steel sheet is 1 to 120 sec., though the holding time depends on the temperature of the steel sheet. Too short holding time results in an insufficient diffused layer, which can not give the effect to improve the corrosion resistance. A holding time above 120 sec. induces an excessive diffusion alloying, which results in a brittle interface layer to degrade the adhesiveness and workability of the coating layer. A preferable depth of appropriate diffused layer formed by the heat treatment is in an approximate range of from 0.1 to 20 μm. During the heat treatment, an excessive aging for several minutes at a temperature range of approximately from 300° to 400° C. may be applied.

When a Ni-P alloy coating layer undergoes heat treatment, two types of coating structure appear. The one is that a part of the Ni-P alloy coating layer forms a diffused alloy layer and forms the steel sheet/diffused alloy layer/Ni-P alloy coating layer structure. The other is that all the Ni-P alloy coating layer forms a diffused alloy layer to give the steel sheet/diffused alloy layer structure. This invention includes both cases. After the heat treatment for diffusion, a temper rolling is conducted under an appropriate condition, at need.

The produced steel sheets of this invention following the method described above have excellent corrosion resistance and are applicable in a wide field including automobiles, building materials, and electric equipment where a high corrosion resistance is requested.

EXAMPLE

The following is the embodiments of this invention.

EXAMPLE-1

The steels having the chemical composition listed in Table 1 were melted to form slabs, heated, and hot-rolled to prepare the hot-rolled steel sheets having the thickness of 4.0 mm. The steel sheets were pickled and cold-rolled to obtain the steel sheets of 0.8 mm thick. The cold-rolled steel sheets were coated by Ni-P layer shown in Table 2, and were subjected to diffusion-heat treatment which also acted as annealing, and to temper-rolling to obtain the test pieces.

The test pieces prepared were evaluated in terms of corrosion resistance and workability. The method and criteria of the evaluation are the following.

(Method and criteria of evaluation)

(1) Corrosion resistance

The test piece without painting is allowed to stand for 60 days under the corrosive condition of repeated drying and humidifying combined with salt water spraying. The resulted corrosion depth was measured to evaluate in accordance with the criterion given below.

○: the maximum corrosion depth is 0.2 mm or less

Δ: the maximum corrosion depth is deeper than 0.2 mm and not deeper than 0.4 mm

X: the maximum corrosion depth is deeper than 0.4 mm (2) Workability

The test piece undergoes the 180 degree bending test to observe the damage of coating layer at the tip of bend. The evaluation was given in accordance with the following criterion.

○: no damage or only fine cracks are observed

Δ: large crack is observed or partial separation of coating layer is observed

X: coating separation is observed in a wide range

The evaluation results are summarized in Table 3 through Table 7. The designation of "Example" in these tables means that the case fully satisfies all the requirements of this invention, and the designation of "Comparative Example" means that either one of the requirements of this invention comes out of scope thereof.

Those tables prove that Examples are superior to Comparative Examples in both items of corrosion resistance and workability.

EXAMPLE-2

Among the steels shown in Table 1, the steels No. 1 through 3 which satisfy the requirement of this invention were melted to form slabs. The slabs were heated to hot-roll into the hot-rolled steel sheets of 4.0mm thick. After pickled, these steel sheets were cold-rolled to obtain the steel sheets of 0.8 mm thick. The cold-rolled steel sheets were separately subjected to Ni-P coating of A through C, and M through O, which are given in Table 3. Then these steel sheets were treated by diffusion-heat treatment and refining-rolling to prepare the test pieces.

The test pieces prepared by the above procedure were evaluated in terms of corrosion resistance and workability using the method and criteria described above. The result is summarized in Table 8. Similar to Tables 3 to 7, the case designated by "Example" satisfies all the requirements of this invention, and the case designated by "Comparative Example" dissatisfies either one of the requirements of this invention.

As Table 8 clearly shows, Examples are superior to Comparative Examples in both items of corrosion resistance and workability.

According to the invention, a steel sheet having the basic composition of controlled S content and small amount of Cu, B, and Ti, is employed, and a diffused alloy layer consisting essentially of Fe-Ni-P is formed on the steel sheet. With the structure, this invention provides a surface treated steel sheet giving a low production cost and having excellent corrosion resistance while maintaining the superior workability, and provides a method for producing the steel sheet.

TABLE 1

| | Steel | Chemical Composition (wt. %) | | | | | | | | | | | |
|---|---|---|---|---|---|---|---|---|---|---|---|---|---|
| | | C | Si | Mn | P | S | N | Cu | sol. Al | Ni | Ti | B | S/Cu |
| Examples of the present invention | 1 | 0.0019 | 0.02 | 0.15 | 0.011 | 0.005 | 0.0027 | 0.15 | 0.031 | 0.10 | 0.095 | 0.0005 | 0.033 |
| | 2 | 0.0043 | 0.02 | 0.22 | 0.012 | 0.008 | 0.0035 | 0.26 | 0.043 | 0.15 | 0.012 | 0.0009 | 0.031 |
| | 3 | 0.0012 | 0.01 | 0.12 | 0.014 | 0.003 | 0.0018 | 0.29 | 0.047 | 0.21 | 0.072 | 0.0019 | 0.010 |
| | 4 | 0.0015 | 0.02 | 0.18 | 0.019 | 0.003 | 0.0028 | 0.06 | 0.035 | 0.06 | 0.061 | 0.0002 | 0.050 |
| | 5 | 0.0044 | 0.02 | 0.23 | 0.019 | 0.009 | 0.0021 | 0.10 | 0.056 | 0.10 | 0.008 | 0.0002 | 0.090 |
| | 6 | 0.0047 | 0.04 | 0.21 | 0.008 | 0.004 | 0.0035 | 0.10 | 0.062 | 0.10 | 0.033 | 0.0003 | 0.040 |
| Compartive examples | 7 | 0.0031 | 0.03 | 0.15 | 0.014 | 0.006 | 0.0035 | 0.13 | 0.045 | 0.11 | 0.061 | Tr | 0.046 |
| | 8 | 0.0031 | 0.03 | 0.16 | 0.011 | 0.008 | 0.0030 | 0.03 | 0.046 | 0.12 | 0.080 | 0.0008 | 0.270 |
| | 9 | 0.0034 | 0.02 | 0.30 | 0.012 | 0.010 | 0.0025 | 0.15 | 0.033 | 0.13 | Tr | 0.0005 | 0.067 |

TABLE 2

| | P wt. % | Other component wt. % | Coating weight g/m$^2$ |
|---|---|---|---|
| A | 8 | — | 1.0 |
| B | 12 | — | 0.1 |
| C | 12 | — | 1.0 |
| D | 12 | — | 8.0 |
| E | 12 | 12%Cu | 1.0 |
| F | 12 | 8%Mo | 1.0 |
| G | 12 | 12%W | 1.0 |
| H | 12 | 5%Cr | 1.0 |
| I | 12 | 1%Mo—5%Cu | 1.0 |
| J | 12 | 8%Cu—5%Cr | 1.0 |
| K | 12 | 8%Cu—5%W | 1.0 |

TABLE 2-continued

| | P wt. % | Other component wt. % | Coating weight g/m² |
|---|---|---|---|
| L | 18 | — | 1.0 |
| M | 12 | — | 0.06 |
| N | 6 | — | 1.0 |
| O | 12 | — | 0.05 |
| P | 12 | — | 10.0 |
| Q | 12 | 16%W | 1.0 |
| R | 12 | 16%Mo | 1.0 |
| S | 12 | 8%Cu—16%W | 1.0 |
| T | 12 | 8%Cu—16%Mo | 1.0 |
| U | — | — | — |

TABLE 3

| No. | Steel sheet | Ni—P coating | Corrosion resistsnce | Workability | I or C** |
|---|---|---|---|---|---|
| 1 | 1 | A | ○ | ○ | I |
| 2 | 2 | A | ○ | ○ | I |
| 3 | 3 | A | ○ | ○ | I |
| 4 | 4 | A | ○ | ○ | I |
| 5 | 5 | A | ○ | ○ | I |
| 6 | 6 | A | ○ | ○ | I |
| 7 | 7 | A | Δ | ○ | C |
| 8 | 8 | A | Δ | ○ | C |
| 9 | 9 | A | Δ | ○ | C |
| 10 | 1 | B | ○ | ○ | I |
| 11 | 2 | B | ○ | ○ | I |
| 12 | 3 | B | ○ | ○ | I |
| 13 | 4 | B | ○ | ○ | I |
| 14 | 5 | B | ○ | ○ | I |
| 15 | 6 | B | ○ | ○ | I |
| 16 | 7 | B | Δ | ○ | C |
| 17 | 8 | B | Δ | ○ | C |
| 18 | 9 | B | Δ | ○ | C |
| 19 | 1 | C | ○ | ○ | I |
| 20 | 2 | C | ○ | ○ | I |
| 21 | 3 | C | ○ | ○ | I |
| 22 | 4 | C | ○ | ○ | I |
| 23 | 5 | C | ○ | ○ | I |
| 24 | 6 | C | ○ | ○ | I |
| 25 | 7 | C | Δ | ○ | C |
| 26 | 8 | C | Δ | ○ | C |
| 27 | 9 | C | Δ | ○ | C |
| 28 | 1 | D | ○ | ○ | I |
| 29 | 2 | D | ○ | ○ | I |
| 30 | 3 | D | ○ | ○ | I |
| 31 | 4 | D | ○ | ○ | I |
| 32 | 5 | D | ○ | ○ | I |
| 33 | 6 | D | ○ | ○ | I |
| 34 | 7 | D | Δ | ○ | C |
| 35 | 8 | D | Δ | ○ | C |
| 36 | 9 | D | Δ | ○ | C |

Notes)
(**)mark indicates that I: Example of the present invention; and C: Comparative example

TABLE 4

| No. | Steel sheet | Ni—P coating | Corrosion resistsnce | Workability | I r C** |
|---|---|---|---|---|---|
| 37 | 1 | E | ○ | ○ | I |
| 38 | 2 | E | ○ | ○ | I |
| 39 | 3 | E | ○ | ○ | I |
| 40 | 4 | E | ○ | ○ | I |
| 41 | 5 | E | ○ | ○ | I |
| 42 | 6 | E | ○ | ○ | I |
| 43 | 7 | E | Δ | ○ | C |
| 44 | 8 | E | Δ | ○ | C |
| 45 | 9 | E | Δ | ○ | C |
| 46 | 1 | F | ○ | ○ | I |
| 47 | 2 | F | ○ | ○ | I |

TABLE 4-continued

| No. | Steel sheet | Ni—P coating | Corrosion resistsnce | Workability | I r C** |
|---|---|---|---|---|---|
| 48 | 3 | F | ○ | ○ | I |
| 49 | 4 | F | ○ | ○ | I |
| 50 | 5 | F | ○ | ○ | I |
| 51 | 6 | F | ○ | ○ | I |
| 52 | 7 | F | Δ | ○ | C |
| 53 | 8 | F | Δ | ○ | C |
| 54 | 9 | F | Δ | ○ | C |
| 55 | 1 | G | ○ | ○ | I |
| 56 | 2 | G | ○ | ○ | I |
| 57 | 3 | G | ○ | ○ | I |
| 58 | 4 | G | ○ | ○ | I |
| 59 | 5 | G | ○ | ○ | I |
| 60 | 6 | G | ○ | ○ | I |
| 61 | 7 | G | Δ | ○ | C |
| 62 | 8 | G | Δ | ○ | C |
| 63 | 9 | G | Δ | ○ | C |
| 64 | 1 | H | ○ | ○ | I |
| 65 | 2 | H | ○ | ○ | I |
| 66 | 3 | H | ○ | ○ | I |
| 67 | 4 | H | ○ | ○ | I |
| 68 | 5 | H | ○ | ○ | I |
| 69 | 6 | H | ○ | ○ | I |
| 70 | 7 | H | Δ | ○ | C |
| 71 | 8 | H | Δ | ○ | C |
| 72 | 9 | H | Δ | ○ | C |

Notes)
(**)mark indicates that I: Example of the present invention; and C: Comparative example

TABLE 5

| No. | Steel sheet | Ni—P coating | Corrosion resistance | Workability | I or C** |
|---|---|---|---|---|---|
| 73 | 1 | I | ○ | ○ | I |
| 74 | 2 | I | ○ | ○ | I |
| 75 | 3 | I | ○ | ○ | I |
| 76 | 4 | I | ○ | ○ | I |
| 77 | 5 | I | ○ | ○ | I |
| 78 | 6 | I | ○ | ○ | I |
| 79 | 7 | I | Δ | ○ | C |
| 80 | 8 | I | Δ | ○ | C |
| 81 | 9 | I | Δ | ○ | C |
| 82 | 1 | J | ○ | ○ | I |
| 83 | 2 | J | ○ | ○ | I |
| 84 | 3 | J | ○ | ○ | I |
| 85 | 4 | J | ○ | ○ | I |
| 86 | 5 | J | ○ | ○ | I |
| 87 | 6 | J | ○ | ○ | I |
| 88 | 7 | J | Δ | ○ | C |
| 89 | 8 | J | Δ | ○ | C |
| 90 | 9 | J | Δ | ○ | C |
| 91 | 1 | K | ○ | ○ | I |
| 92 | 2 | K | ○ | ○ | I |
| 93 | 3 | K | ○ | ○ | I |
| 94 | 4 | K | ○ | ○ | I |
| 95 | 5 | K | ○ | ○ | I |
| 96 | 6 | K | ○ | ○ | I |
| 97 | 7 | K | Δ | ○ | C |
| 98 | 8 | K | Δ | ○ | C |
| 99 | 9 | K | Δ | ○ | C |
| 100 | 1 | L | ○ | ○ | I |
| 101 | 2 | L | ○ | ○ | I |
| 102 | 3 | L | ○ | ○ | I |
| 103 | 4 | L | ○ | ○ | I |
| 104 | 5 | L | ○ | ○ | I |
| 105 | 6 | L | ○ | ○ | I |
| 106 | 7 | L | Δ | ○ | C |
| 107 | 8 | L | Δ | ○ | C |
| 108 | 9 | L | Δ | ○ | C |
| 109 | 1 | M | ○ | ○ | I |
| 110 | 2 | M | ○ | ○ | I |
| 111 | 3 | M | ○ | ○ | I |
| 112 | 4 | M | ○ | ○ | I |

TABLE 5-continued

| No. | Steel sheet | Ni—P coating | Corrosion resistance | Workability | I or C** |
|---|---|---|---|---|---|
| 113 | 5 | M | ○ | ○ | I |
| 114 | 6 | M | ○ | ○ | I |
| 115 | 7 | M | Δ | ○ | C |
| 116 | 8 | M | Δ | ○ | C |
| 117 | 9 | M | Δ | ○ | C |

Notes)
(**)mark indicates that I: Example of the present invention; and C: Comparative example

TABLE 6

| No. | Steel sheet | Ni—P coating | Corrosion resistance | Workability | I or C** |
|---|---|---|---|---|---|
| 118 | 1 | N | Δ | ○ | C |
| 119 | 2 | N | Δ | ○ | C |
| 120 | 3 | N | Δ | ○ | C |
| 121 | 4 | N | Δ | ○ | C |
| 122 | 5 | N | Δ | ○ | C |
| 123 | 6 | N | Δ | ○ | C |
| 124 | 7 | N | X | ○ | C |
| 125 | 8 | N | X | ○ | C |
| 126 | 9 | N | X | ○ | C |
| 127 | 1 | O | X | ○ | C |
| 128 | 2 | O | X | ○ | C |
| 129 | 3 | O | X | ○ | C |
| 130 | 4 | O | X | ○ | C |
| 131 | 5 | O | X | ○ | C |
| 132 | 6 | O | X | ○ | C |
| 133 | 7 | O | X | ○ | C |
| 134 | 8 | O | X | ○ | C |
| 135 | 9 | O | X | ○ | C |
| 136 | 1 | P | ○ | X | C |
| 137 | 2 | P | ○ | X | C |
| 138 | 3 | P | ○ | X | C |
| 139 | 4 | P | ○ | X | C |
| 140 | 5 | P | ○ | X | C |
| 141 | 6 | P | ○ | X | C |
| 142 | 7 | P | ○ | X | C |
| 143 | 8 | P | ○ | X | C |
| 144 | 9 | P | ○ | X | C |
| 146 | 1 | Q | ○ | X | C |
| 146 | 2 | Q | ○ | X | C |
| 147 | 3 | Q | ○ | X | C |
| 148 | 4 | Q | ○ | X | C |
| 149 | 5 | Q | ○ | X | C |
| 150 | 6 | Q | ○ | X | C |
| 151 | 7 | Q | ○ | X | C |
| 152 | 8 | Q | ○ | X | C |
| 153 | 9 | Q | ○ | X | C |

Notes)
(**)mark indicates that I: Example of the present invention; and C: Comparative example.

TABLE 7

| No. | Steel sheet | Ni—P coating | Corrosion resistance | Workability | I or C** |
|---|---|---|---|---|---|
| 145 | 1 | R | ○ | X | C |
| 146 | 2 | R | ○ | X | C |
| 147 | 3 | R | ○ | X | C |
| 148 | 4 | R | ○ | X | C |
| 149 | 5 | R | ○ | X | C |
| 150 | 6 | R | ○ | X | C |
| 151 | 7 | R | ○ | X | C |
| 152 | 8 | R | ○ | X | C |
| 153 | 9 | R | ○ | X | C |
| 154 | 1 | S | ○ | X | C |
| 155 | 2 | S | ○ | X | C |
| 156 | 3 | S | ○ | X | C |
| 157 | 4 | S | ○ | X | C |
| 158 | 5 | S | ○ | X | C |

TABLE 7-continued

| No. | Steel sheet | Ni—P coating | Corrosion resistance | Workability | I or C** |
|---|---|---|---|---|---|
| 159 | 6 | S | ○ | X | C |
| 160 | 7 | S | ○ | X | C |
| 161 | 8 | S | ○ | X | C |
| 162 | 9 | S | ○ | X | C |
| 163 | 1 | T | ○ | X | C |
| 164 | 2 | T | ○ | X | C |
| 165 | 3 | T | ○ | X | C |
| 166 | 4 | T | ○ | X | C |
| 167 | 5 | T | ○ | X | C |
| 168 | 6 | T | ○ | X | C |
| 169 | 7 | T | ○ | X | C |
| 170 | 8 | T | ○ | X | C |
| 171 | 9 | T | ○ | X | C |
| 172 | 1 | U | X | — | C |
| 173 | 2 | U | X | — | C |
| 174 | 3 | U | X | — | C |
| 175 | 4 | U | X | — | C |
| 176 | 5 | U | X | — | C |
| 177 | 6 | U | X | — | C |
| 178 | 7 | U | X | — | C |
| 179 | 8 | U | X | — | C |
| 180 | 9 | U | X | — | C |

Notes)
(**)mark indicates that I: Example of the present invention; and C: Comparative example.

TABLE 8

| No. | Steel sheet | Ni—P coating wt. % | Corrosion resistance 100 cycle | Workability | I or C** |
|---|---|---|---|---|---|
| 1 | 1 | A | ○ | ○ | I |
| 2 | 2 | A | ○ | ○ | I |
| 3 | 3 | A | ○ | ○ | I |
| 4 | 1 | B | ○ | ○ | I |
| 5 | 2 | B | ○ | ○ | I |
| 6 | 3 | B | ○ | ○ | I |
| 7 | 1 | C | ○ | ○ | I |
| 8 | 2 | C | ○ | ○ | I |
| 9 | 3 | C | ○ | ○ | I |
| 10 | 1 | N | X | ○ | C |
| 11 | 2 | N | X | ○ | C |
| 12 | 3 | N | X | ○ | C |
| 13 | 1 | O | X | ○ | C |
| 14 | 2 | O | X | ○ | C |
| 15 | 3 | P | X | ○ | C |
| 16 | 1 | P | ○ | X | C |
| 17 | 2 | P | ○ | X | C |
| 18 | 3 | B | ○ | X | C |

Notes)
(**)mark indicates that I: Example of the presnt invention; and C: Comparative example

EMBODIMENT-2

Embodiment-2 uses the steel sheets having the composition specified in Embodiment-1 to form a diffused alloy layer consisting mainly of Fe-Ni-P. That type of diffused alloy layer protects the base steel from corrosion, and promptly densifies the iron corrosion product which is formed after the corrosion of the base steel begins. As a result, excellent corrosion resistance which could not be obtained in prior arts is achieved.

The diffused alloy layer consisting essentially of Fe-Ni-P may further contain at least one element selected from the group consisting of W, Mo, Cr, and Cu. Those elements play a role of inhibitor to the steel corrosion and also has an effect of improving the densification and stabilization of initial stage rust by a synergistic effect with Ni and P.

The formation of that type of diffused alloy layer gives an anti-pitting effect under a severe condition described before. However, it is not sufficient to suppress the rust generation resulted from a damage on external coating caused by jumping stone or the like.

To give a post-painting corrosion resistance, this invention applies a coating on the diffused alloy layer, which coating is Zn coating or a coating using Zn as the matrix and containing at least one metal of Ni, Fe, Co, Cr, Mn, Ti, Mo, Si or Al, or at least one oxide of Ni, Fe, Co, Cr, Mn, Ti, Mo, Si in a form of alloy or dispersed particles.

That type of coating contributes to the corrosion resistance during the process of coating corrosion owing to the sacrifice corrosion protection of the coating. It also gives an effect of stabilizing and densifying the base iron during the corrosion of base iron owing to the synergistic effect of the components in the Zn matrix and the components such as Ni and P in the diffused alloy layer.

A preferable zinc coating weight is from 5 to 60 g/m$^2$. Too small coating weight can not give sufficient corrosion resistance, and excessive coating weight degrades the workability of coating layer and increases the production cost. The most preferable coating weight is from 5 to 45 g/m$^2$.

Following is the condition for producing the steel sheet of this invention.

According to the invention, the steel sheet having the composition described above undergoes de-scaling by pickling treatment, and is coated with a Ni-P alloy layer containing P of 8 to 18 wt. % to form a diffused alloy layer. The coating is applied before the annealing, and it may be applied immediately after the pickling at the exit of the pickling line before the cold rolling or may be applied after the cold rolling succeeding to the pickling. Particularly when the coating is given before the cold rolling, there appears an advantage that no pickling is required as the cleaning and activating the sheet before coating.

The Ni-P alloy coating containing P of 8 to 18% forms an amorphous-like structure. When a steel sheet having that type of coating layer is subjected to heat treatment, a uniform diffused alloy layer is formed within a short period compared with the case of common crystalline coating layers. A Ni-P alloy coating layer containing P of less than 8% forms a crystalline structure and gives non-uniform P distribution. As a result, that type of coating layer has non-uniform composition of diffused alloy layer when it is subjected to heat treatment, and the initial stage rust is insufficient in its uniformity and denseness, which gives unstable corrosion resistance. On the other hand, a coating layer containing P of above 18% makes the Ni-P alloy coating brittle and degrades the adhesiveness of the coating layer. Accordingly, that type of coating layer tends to separate from the base steel sheet during cold rolling or the like. Consequently, the P content of the coating layer formed on the steel sheet of this invention is specified in a range of from 8 to 18%. More preferable range is from 10 to 13%.

As described above, the diffused alloy layer consisting essentially of Fe-Ni-P may contain at least one element selected from the group consisting of W, Mo, Cr, and Cu to suppress the corrosion of steel and to further improve the denseness and stability of the initial stage rust. In that case, however, the Ni-P coating layer employs a composite of Ni-P with at least one element selected from the group consisting of N, Mo, Cr, and Cu in an amount of up to 15%. The corrosion resistance increases with the increase of the content of W, Mo, Cr, and Cu. However, when the sum of the added amount of W, Mo, Cr, and Cu exceeds 15%, the adhesiveness of the coating layer degrades, and likely generates the separation of coating layer during cold rolling or the like. Therefore, the content of the sum of W, Mo, Cr, and Cu is specified as 15% or less. A preferable lower limit of the sum of W, Mo, Cr, and Cu to perform the effect of the addition is 0.5%.

The coating weight of the Ni-P alloy layer is specified as 0.05 g/m$^2$ to 8 g/m$^2$. The coating weight of less than 0.05 m$^2$ gives insufficient improvement of corrosion resistance, and the coating weight of above 8 g/m$^2$ degrades the workability of coating layer and induces separation of the layer. Furthermore, an excess coating weight needs to slow the line speed, which is a disadvantage in production yield.

Several methods for forming Ni-P alloy coating layer have been introduced. Among them, the electroplating or electroless coating (chemical coating) are preferred from the viewpoint of simplicity of operation and quality of obtained film.

The next step is the heat treatment of the steel sheet coated with Ni-P alloy layer in a non-oxidizing atmosphere to form a diffused alloy layer consisting essentially of Fe-Ni-P at the interface of the base steel sheet and the Ni-P alloy coating layer. The heat treatment for diffusion also performs the ordinary annealing after the cold rolling, and the heat treatment may be done in a common annealing facility employed for annealing. In particular, a continuous annealing which offers a high productivity is preferred. The continuous annealing may be conducted in a continuous annealing facility for common rolled steel sheets or may be conducted in an annealing facility as the pre-treating unit of hot dip coating line. The continuous annealing preferably uses the heating by a direct-firing furnace at a heating speed of 50° C./ sec. or more.

A preferred maximum steel sheet temperature during the heat treatment is from 500° to 880° C., and more preferably from 800° to 880° C. The heat treatment at below 500° C. can not form a sufficient diffused layer between the Ni-P alloy coating-layer and the steel sheet surface, and the insufficient dense rust formation during the corrosion process gives only a small effect for improving corrosion resistance. On the other hand, the heat treatment at above 880° C. tends to induce a pickup of coating metal to the surface of the rolls in the heat treatment furnace, which may cause the surface defects on the steel sheets. Furthermore, the annealing at above 880° C. induces the growth of coarse ferrite grains which may cause rough surface after press-forming. A preferred range of holding time at the maximum temperature of the steel sheet is 1 to 120 sec., though the holding time depends on the temperature of the steel sheet. Too short holding time results in an insufficient diffused layer, which can not give the effect to improve the corrosion resistance. A holding time above 120 sec. induces an excessive diffusion alloying, which results in a brittle interface layer to degrade the adhesiveness and workability of the coating layer. A preferable depth of appropriate diffused layer formed by the heat treatment is in an approximate range of from 0.1 to 20 μm. During the heat treatment, an excessive aging for several minutes at a temperature range of approximately from 300° to 400° C. may be applied.

When a Ni-P alloy coating layer undergoes heat treatment, two types of coating structure appear. The one is that a part of the Ni-P alloy coating layer forms a diffused alloy layer and forms the steel sheet/diffused alloy layer/Ni-P alloy coating layer structure. The other is that all the Ni-P alloy coating layer forms a diffused alloy layer to give the steel sheet/diffused alloy layer structure. This invention includes both cases.

After the heat treatment for diffusion, a temper rolling is conducted under an appropriate condition, at need.

The steel sheet treated by the above-described procedure is further subjected to zinc electroplating or zinc hot dip coating in a zinc coating line.

Zinc electroplating bath may be sulfuric acid bath or chloride bath which are widely used. For further improvement of corrosion resistance, a chromate treatment may be applied on the zinc electroplating layer, and further an organic composite resin coating may be applied. As for the chromate treatment, either one of reaction type, electrolysis type, and application type is applicable. The chromate film may contain organic compound such as acrylic resin, oxide colloid such as silica colloid and alumina colloid, acid such as molybdenum acid, salt, or other corrosion-resistance-improving agent. The organic resin film which coats the chromate film may use epoxy resin as the base resin. The organic resin film preferably further contains an inhibitor additive such as silica and chromate at an approximate range of from 10 to 60 wt. %.

The steel sheet of this invention treated as described above has an excellent corrosion resistance and an excellent deep drawing performance, and the sheet is quite suitable as an automobile material.

EXAMPLE

The following is the description of the Example of this invention.

EXAMPLE-3

The steels having the chemical composition listed in Table 9 were melted to slabs, heated, and hot-rolled to prepare the hot-rolled steel sheets having the thickness of 4.0 mm. The steel sheets were pickled and cold-rolled to obtain the steel sheets of 0.8 mm thick. The cold-rolled steel sheets were coated by Ni-P layer shown in "A" through "Q" of Table 10, and were subjected to diffusion heat treatment which also acted as annealing, to temper-rolling, and to Zn coating shown in Table 11 to obtain the test pieces.

The test pieces prepared were evaluated in terms of corrosion resistance, paintability, and workability. The method and criteria of the evaluation are the following.

(Method and criteria of evaluation)

(1) Corrosion resistance

The test piece without painting is allowed to stand for 60 days under the corrosive condition of repeated drying and humidifying combined with salt solution spraying. The resulted corrosion depth was measured to evaluate in accordance with the criterion given below.

○: the maximum corrosion depth is deeper than 0.05 mm and not deeper than 0.1 mm Δ: the maximum corrosion depth is deeper than 0.1 mm and not deeper than 0.2 mm X: the maximum corrosion depth is deeper than 0.2 mm (2) Paintability The steel sheet is subjected to phosphate treatment and cation electrocoating. The coating layer is cut to the base steel surface using a knife, and the steel sheet is exposed to the environment of (1) for 100 days. The blister generated at the cut area is observed and evaluated in accordance with the criterion given below.

○: the maximum blister width per side is 1 mm or less,

Δ: the maximum blister width per side is over 1 mm and 3 mm or less,

X: the maximum blister width per side is over 3 mm.

(3) Workability

The test piece undergoes the 180 degree bending test to observe the damage of coating layer at the tip of bent. The evaluation is given in accordance with the following criterion.

○: no damage or only fine cracks are observed

Δ: large crack is observed or partial separation of coating layer is observed

X: coating separation is observed in a wide range

The evaluation results are summarized in Table 12 through Table 19. The designation of "Example" in these tables means that the case fully satisfies all the requirements of this invention, and the designation of "Comparative Example" means that either one of the requirements of this invention comes out of scope thereof.

As these tables clearly show, Examples are superior to Comparative Examples in all items of corrosion resistance, paintability, and workability.

EXAMPLE-4

The steels having the chemical composition listed in Table 9 as the steel No. 1 to 3 were melted to slabs, heated, and hot-rolled to prepare the hot-rolled steel sheets having the thickness of 4.0 mm. The steel sheets were pickled and cold-rolled to obtain the steel sheets of 0.8 mm thick. The cold-rolled steel sheets were coated by Ni-P layer shown in A through C and K through M of Table 10, and were subjected to diffusion heat treatment which also acted as annealing, to temper rolling, and to Zn coating of "a" and "g" listed in Table 11 to obtain the test pieces.

The prepared test pieces were evaluated in terms of corrosion resistance, paintability, and workability by the method and criteria described before. The results are summarized in Table 20.Also in Table 20, similar to Tables 12 through 19, the designation of "Example" in these tables means that the case fully satisfies all the requirements of this invention, and the designation of "Comparative Example" means that either one of the requirements of this invention comes out of scope thereof.

As these tables clearly show, Examples are superior to Comparative Examples in all items of corrosion resistance, paintability, and workability.

EXAMPLE-5

The steels No. 1 through 3 in Table 9, which have the chemical composition of this invention were melted to slabs, heated, and hot-rolled to prepare the hot-rolled steel sheets having the thickness of 4.0 mm. The steel sheets were pickled and cold-rolled to obtain the steel sheets of 0.8 mm thick. The cold-rolled steel sheets were coated by Ni-P layer A shown in Table 10, and were subjected to diffusion-heat treatment which also acted as annealing, to temper-rolling, and to Zn coating of h through 1 shown in Table 11 to obtain the test pieces.

The evaluation results are summarized in Table 21. Similar to Tables 12 through 20, the designation of "Example" in Table 21 means that the case fully satisfies all the requirements of this invention, and the designation of "Comparative Example" means that either one of the requirements of this invention comes out of scope thereof. As clearly shown in Table 21, the steels No. 346 through 348 which contain excess Zn coating weight are inferior in the workability to Examples.

According to the invention, a steel sheet having the basic composition of controlled S content and small amount of Cu, B, and Ti is employed, and a diffused alloy layer consisting essentially of Fe-Ni-P is formed on the steel sheet. With the structure, this invention provides a surface treated steel sheet giving a low production cost and having excellent corrosion resistance with less coating weight while maintaining the superior workability, and provides a method for producing the steel sheet.

TABLE 9

| | Steel | Chemical composition (wt. %) | | | | | | | | | | | |
|---|---|---|---|---|---|---|---|---|---|---|---|---|---|
| | | C | Si | Mn | P | S | N | Cu | sol. Al | Ni | Ti | B | S/Cu |
| Examples of the present invention | 1 | 0.0012 | 0.01 | 0.12 | 0.014 | 0.003 | 0.0018 | 0.29 | 0.047 | 0.21 | 0.072 | 0.0019 | 0.010 |
| | 2 | 0.0015 | 0.02 | 0.18 | 0.019 | 0.003 | 0.0028 | 0.06 | 0.035 | 0.06 | 0.061 | 0.0002 | 0.050 |
| | 3 | 0.0044 | 0.04 | 0.23 | 0.019 | 0.009 | 0.0021 | 0.10 | 0.056 | 0.10 | 0.008 | 0.0002 | 0.090 |
| Comparative examples | 4 | 0.0031 | 0.03 | 0.15 | 0.014 | 0.006 | 0.0035 | 0.13 | 0.045 | 0.11 | 0.061 | Tr. | 0.046 |
| | 5 | 0.0031 | 0.03 | 0.16 | 0.011 | 0.008 | 0.0030 | 0.03 | 0.046 | 0.12 | 0.080 | 0.0008 | 0.270 |
| | 6 | 0.0034 | 0.02 | 0.30 | 0.012 | 0.010 | 0.0025 | 0.15 | 0.033 | 0.13 | Tr. | 0.0005 | 0.067 |

TABLE 10

| | P wt. % | Other constituent wt. % | Coating weight g/m$^2$ |
|---|---|---|---|
| A | 8 | — | 1.0 |
| B | 12 | — | 0.1 |
| C | 12 | — | 1.0 |
| D | 12 | — | 8.0 |
| E | 12 | 12%Cu | 1,0 |
| F | 12 | 8%Mo | 1,0 |
| G | 12 | 12%W | 1.0 |
| H | 12 | 5%Cr | 1.0 |
| I | 12 | 8%Cu—5%W | 1.0 |
| J | 18 | — | 1.0 |
| K | 12 | — | 0.06 |
| L | 6 | — | 1.0 |
| M | 12 | — | 0.05 |
| N | 12 | — | 10.0 |
| O | 12 | 16%W | 1.0 |
| P | 12 | 8%Cu—16%Mo | 1.0 |
| Q | — | — | — |

TABLE 11

| | Coating type | Other component wt. % | Coating weight g/m$^2$ |
|---|---|---|---|
| a | Electrolytic Zn coating | 100%Zn | 20.0 |
| b | Electrolytic Zn—Ni coating | 12%Ni | 5.0 |
| c | Electrolytic Zn—Fe coating | 15%Fe | 10.0 |
| d | Electrolytic Zn—Cr coating | 12%Cr | 10.0 |
| e | Electrolytic Zn—Mn coating | 60%Mn | 10.0 |
| f | Electrolytic Zn—$SiO_2$ coating | 5%$SiO_2$ | 10.0 |
| g | Electrolytic Zn—Co—Cr—$All_2O_3$ coating | 1%Co, 1%Cr, 0.2%$Al_2O_3$ | 10.0 |
| h | Electrolytic Zn—$Cr(OH)_3$ coating | 3%$Cr(OH)_3$ | 10.0 |
| i | Alloy hot dip Zn coating | 11%Fe, 0.13%Al | 45.0 |
| j | Hot dip Zn coating | 0.15%Al | 30.0 |
| k | Alloy hot dip Zn coating | 1%Fe, 0.13%Al | 60.0 |
| l | Electrolytic Zn coating | 100%Zn | 70.0 |

TABLE 12

| No. | Steel sheet | Ni—P coating | Zn coat-ing | Cor-rosion resistance | Paint-abitity | Work-abilty | |
|---|---|---|---|---|---|---|---|
| 1 | 1 | A | a | ○ | ○ | ○ | Examples of the present |
| 2 | 1 | A | b | ○ | ○ | ○ | |
| 3 | 1 | A | c | ○ | ○ | ○ | |

TABLE 12-continued

| No. | Steel sheet | Ni—P coating | Zn coat-ing | Cor-rosion resistance | Paint-abitity | Work-abilty | |
|---|---|---|---|---|---|---|---|
| 4 | 1 | A | d | ○ | ○ | ○ | invention |
| 5 | 1 | A | e | ○ | ○ | ○ | |
| 6 | 1 | A | f | ○ | ○ | X | Com-parative examples |
| 7 | 1 | A | g | ○ | ○ | X | |
| 8 | 2 | A | a | ○ | ○ | ○ | Examples of the present invention |
| 9 | 2 | A | b | ○ | ○ | ○ | |
| 10 | 2 | A | c | ○ | ○ | ○ | |
| 11 | 2 | A | d | ○ | ○ | ○ | |
| 12 | 2 | A | e | ○ | ○ | ○ | |
| 13 | 2 | A | f | ○ | ○ | X | Com-parative examples |
| 14 | 2 | A | g | ○ | ○ | X | |
| 15 | 3 | A | a | ○ | ○ | ○ | Examples of the present invention |
| 16 | 3 | A | b | ○ | ○ | ○ | |
| 17 | 3 | A | c | ○ | ○ | ○ | |
| 18 | 3 | A | d | ○ | ○ | ○ | |
| 19 | 3 | A | e | ○ | ○ | ○ | |
| 20 | 3 | A | f | ○ | ○ | X | Com-parative examples |
| 21 | 3 | A | g | ○ | ○ | X | |
| 22 | 1 | B | a | ○ | ○ | ○ | Examples of the present invention |
| 23 | 1 | B | b | ○ | ○ | ○ | |
| 24 | 1 | B | c | ○ | ○ | ○ | |
| 25 | 1 | B | d | ○ | ○ | ○ | |
| 26 | 1 | B | e | ○ | ○ | ○ | |
| 27 | 1 | B | f | ○ | ○ | X | Com-parative examples |
| 28 | 1 | B | g | ○ | ○ | X | |
| 29 | 2 | B | a | ○ | ○ | ○ | Examples of the present invention |
| 30 | 2 | B | b | ○ | ○ | ○ | |
| 31 | 2 | B | c | ○ | ○ | ○ | |
| 32 | 2 | B | d | ○ | ○ | ○ | |
| 33 | 2 | B | e | ○ | ○ | ○ | |
| 34 | 2 | B | f | ○ | ○ | X | Com-parative examples |
| 35 | 2 | B | g | ○ | ○ | X | |
| 36 | 3 | B | a | ○ | ○ | ○ | Examples of the present invention |
| 37 | 3 | B | b | ○ | ○ | ○ | |

TABLE 13

| No. | Steel sheet | Ni—P coating | Zn coating | Corrosion resistance | Paintability | Workabilty | |
|---|---|---|---|---|---|---|---|
| 38 | 3 | B | c | ○ | ○ | ○ | Examples of the present invention |
| 39 | 3 | B | d | ○ | ○ | ○ | |
| 40 | 3 | B | e | ○ | ○ | ○ | |
| 41 | 3 | B | f | ○ | ○ | X | Comparative examples |
| 42 | 3 | B | g | ○ | ○ | X | |
| 43 | 1 | C | a | ○ | ○ | ○ | Examples of the present invention |
| 44 | 1 | C | b | ○ | ○ | ○ | |
| 45 | 1 | C | c | ○ | ○ | ○ | |
| 46 | 1 | C | d | ○ | ○ | ○ | |
| 47 | 1 | C | e | ○ | ○ | ○ | |
| 48 | 1 | C | f | ○ | ○ | X | Comparative examples |
| 49 | 1 | C | g | ○ | ○ | X | |
| 50 | 2 | C | a | ○ | ○ | ○ | Examples of the present invention |
| 51 | 2 | C | b | ○ | ○ | ○ | |
| 52 | 2 | C | c | ○ | ○ | ○ | |
| 53 | 2 | C | d | ○ | ○ | ○ | |
| 54 | 2 | C | e | ○ | ○ | ○ | |
| 55 | 2 | C | f | ○ | ○ | X | Comparative examples |
| 56 | 2 | C | g | ○ | ○ | X | |
| 57 | 3 | C | a | ○ | ○ | ○ | Examples of the present invention |
| 58 | 3 | C | b | ○ | ○ | ○ | |
| 59 | 3 | C | c | ○ | ○ | ○ | |
| 60 | 3 | C | d | ○ | ○ | ○ | |
| 61 | 3 | C | e | ○ | ○ | ○ | |
| 62 | 3 | C | f | ○ | ○ | X | Comparative examples |
| 63 | 3 | C | g | ○ | ○ | X | |
| 64 | 4 | C | a | Δ | X | ○ | |
| 65 | 4 | C | b | Δ | Δ | ○ | |
| 66 | 4 | C | c | Δ | Δ | ○ | |
| 67 | 4 | C | d | Δ | Δ | ○ | |
| 68 | 4 | C | e | Δ | X | ○ | |
| 69 | 5 | C | a | Δ | X | ○ | |
| 70 | 5 | C | b | Δ | Δ | ○ | |
| 71 | 5 | C | c | Δ | Δ | ○ | |
| 72 | 5 | C | d | Δ | Δ | ○ | |
| 73 | 5 | C | e | Δ | X | ○ | |
| 74 | 6 | C | a | Δ | X | ○ | |

TABLE 14

| No. | Steel sheet | Ni—P coating | Zn coating | Corrosion resistance | Paintability | Workabilty | |
|---|---|---|---|---|---|---|---|
| 75 | 6 | C | b | Δ | Δ | ○ | Comparative examples |
| 76 | 6 | C | c | Δ | Δ | ○ | |
| 77 | 6 | C | d | Δ | Δ | ○ | |
| 78 | 6 | C | e | Δ | X | ○ | |
| 79 | 1 | D | a | ○ | ○ | ○ | Examples of the present invention |
| 80 | 1 | D | b | ○ | ○ | ○ | |
| 81 | 1 | D | c | ○ | ○ | ○ | |
| 82 | 1 | D | d | ○ | ○ | ○ | |
| 83 | 1 | D | e | ○ | ○ | ○ | |
| 84 | 1 | D | f | ○ | ○ | X | Comparative examples |
| 85 | 1 | D | g | ○ | ○ | X | |
| 86 | 2 | D | a | ○ | ○ | ○ | Examples of the present invention |
| 87 | 2 | D | b | ○ | ○ | ○ | |
| 88 | 2 | D | c | ○ | ○ | ○ | |
| 89 | 2 | D | d | ○ | ○ | ○ | |
| 90 | 2 | D | e | ○ | ○ | ○ | |
| 91 | 2 | D | f | ○ | ○ | X | Comparative examples |
| 92 | 2 | D | g | ○ | ○ | X | |
| 93 | 3 | D | a | ○ | ○ | ○ | Examples of the present |
| 94 | 3 | D | b | ○ | ○ | ○ | |
| 95 | 3 | D | c | ○ | ○ | ○ | |

TABLE 14-continued

| No. | Steel sheet | Ni—P coating | Zn coating | Corrosion resistance | Paintability | Workabilty | |
|---|---|---|---|---|---|---|---|
| 96 | 3 | D | d | ○ | ○ | ○ | invention |
| 97 | 3 | D | e | ○ | ○ | ○ | |
| 98 | 3 | D | f | ○ | ○ | X | Comparative examples |
| 99 | 3 | D | g | ○ | ○ | X | |
| 100 | 1 | E | a | ○ | ○ | ○ | Examples of the present invention |
| 101 | 1 | E | b | ○ | ○ | ○ | |
| 102 | 1 | E | c | ○ | ○ | ○ | |
| 103 | 1 | E | d | ○ | ○ | ○ | |
| 104 | 1 | E | e | ○ | ○ | ○ | |
| 105 | 1 | E | f | ○ | ○ | X | Comparative examples |
| 106 | 1 | E | g | ○ | ○ | X | |
| 107 | 2 | E | a | ○ | ○ | ○ | Examples of the present invention |
| 108 | 2 | E | b | ○ | ○ | ○ | |
| 109 | 2 | E | c | ○ | ○ | ○ | |
| 110 | 2 | E | d | ○ | ○ | ○ | |
| 111 | 2 | E | e | ○ | ○ | ○ | |

TABLE 15

| No. | Steel sheet | Ni—P coating | Zn coating | Corrosion resistance | Paintability | Workabilty | |
|---|---|---|---|---|---|---|---|
| 112 | 2 | E | f | ○ | ○ | X | Comparative examples |
| 113 | 2 | E | g | ○ | ○ | X | |
| 114 | 3 | E | a | ○ | ○ | ○ | Examples of the present invention |
| 115 | 3 | E | b | ○ | ○ | ○ | |
| 116 | 3 | E | c | ○ | ○ | ○ | |
| 117 | 3 | E | d | ○ | ○ | ○ | |
| 118 | 3 | E | e | ○ | ○ | ○ | |
| 119 | 3 | E | f | ○ | ○ | X | Comparative examples |
| 120 | 3 | E | g | ○ | ○ | X | |
| 121 | 3 | F | a | ○ | ○ | ○ | Examples of the present invention |
| 122 | 1 | F | b | ○ | ○ | ○ | |
| 123 | 1 | F | c | ○ | ○ | ○ | |
| 124 | 1 | F | d | ○ | ○ | ○ | |
| 125 | 1 | F | e | ○ | ○ | ○ | |
| 126 | 1 | F | f | ○ | ○ | X | Comparative examples |
| 127 | 1 | F | g | ○ | ○ | X | |
| 128 | 1 | F | a | ○ | ○ | ○ | Examples of the present invention |
| 129 | 2 | F | b | ○ | ○ | ○ | |
| 130 | 2 | F | c | ○ | ○ | ○ | |
| 131 | 2 | F | d | ○ | ○ | ○ | |
| 132 | 2 | F | e | ○ | ○ | ○ | |
| 133 | 2 | F | f | ○ | ○ | X | Comparative examples |
| 134 | 2 | F | g | ○ | ○ | X | |
| 135 | 3 | F | a | ○ | ○ | ○ | Examples the present invention |
| 136 | 3 | F | b | ○ | ○ | ○ | |
| 137 | 3 | F | c | ○ | ○ | ○ | |
| 138 | 3 | F | d | ○ | ○ | ○ | |
| 139 | 3 | F | e | ○ | ○ | ○ | |
| 140 | 3 | F | f | ○ | ○ | X | Comparative examples |
| 141 | 3 | F | g | ○ | ○ | X | |
| 142 | 1 | G | a | ○ | ○ | ○ | Examples of the present invention |
| 143 | 1 | G | b | ○ | ○ | ○ | |
| 144 | 1 | G | c | ○ | ○ | ○ | |
| 145 | 1 | G | d | ○ | ○ | ○ | |
| 146 | 1 | G | e | ○ | ○ | ○ | |
| 147 | 1 | G | f | ○ | ○ | X | Comparative examples |
| 148 | 1 | G | g | ○ | ○ | X | |

TABLE 16

| No. | Steel sheet | Ni—P coating | Zn coat-ing | Cor-rosion resistance | Paint-abitity | Work-abilty | |
|---|---|---|---|---|---|---|---|
| 149 | 2 | G | a | ○ | ○ | ○ | Examples of the present invention |
| 150 | 2 | G | b | ○ | ○ | ○ | |
| 151 | 2 | G | c | ○ | ○ | ○ | |
| 152 | 2 | G | d | ○ | ○ | ○ | |
| 153 | 2 | G | e | ○ | ○ | ○ | |
| 154 | 2 | G | f | ○ | ○ | X | Com-parative examples |
| 155 | 2 | G | g | ○ | ○ | X | |
| 156 | 3 | G | a | ○ | ○ | ○ | Examples of the present invention |
| 157 | 3 | G | b | ○ | ○ | ○ | |
| 158 | 3 | G | c | ○ | ○ | ○ | |
| 159 | 3 | G | d | ○ | ○ | ○ | |
| 160 | 3 | G | e | ○ | ○ | ○ | |
| 161 | 3 | G | f | ○ | ○ | X | Com-parative examples |
| 162 | 3 | G | g | ○ | ○ | X | |
| 163 | 1 | H | a | ○ | ○ | ○ | Examples of the present invention |
| 164 | 1 | H | b | ○ | ○ | ○ | |
| 165 | 1 | H | c | ○ | ○ | ○ | |
| 166 | 1 | H | d | ○ | ○ | ○ | |
| 167 | 1 | H | e | ○ | ○ | ○ | |
| 168 | 1 | H | f | ○ | ○ | X | Com-parative examples |
| 169 | 1 | H | g | ○ | ○ | X | |
| 170 | 2 | H | a | ○ | ○ | ○ | Examples of the present invention |
| 171 | 2 | H | b | ○ | ○ | ○ | |
| 172 | 2 | H | c | ○ | ○ | ○ | |
| 173 | 2 | H | d | ○ | ○ | ○ | |
| 174 | 2 | H | e | ○ | ○ | ○ | |
| 175 | 2 | H | f | ○ | ○ | X | Com-parative examples |
| 176 | 2 | H | g | ○ | ○ | X | |
| 177 | 3 | H | a | ○ | ○ | ○ | Examples of the present invention |
| 178 | 3 | H | b | ○ | ○ | ○ | |
| 179 | 3 | H | c | ○ | ○ | ○ | |
| 180 | 3 | H | d | ○ | ○ | ○ | |
| 181 | 3 | H | e | ○ | ○ | ○ | |
| 182 | 3 | H | f | ○ | ○ | X | Com-parative examples |
| 183 | 3 | H | g | ○ | ○ | X | |
| 184 | 4 | H | a | Δ | X | ○ | Examples of the present invention |
| 185 | 4 | H | b | Δ | Δ | ○ | |

TABLE 17

| No. | Steel sheet | Ni—P coating | Zn coat-ing | Cor-rosion resistance | Paint-abitity | Work-abilty | |
|---|---|---|---|---|---|---|---|
| 186 | 4 | H | c | Δ | ○ | ○ | Com-parative examples |
| 187 | 4 | H | d | Δ | ○ | ○ | |
| 188 | 4 | H | e | Δ | X | ○ | Examples of the present invention |
| 189 | 5 | H | a | Δ | X | ○ | |
| 190 | 5 | H | b | Δ | Δ | ○ | |
| 191 | 5 | H | c | Δ | Δ | ○ | |
| 192 | 5 | H | d | Δ | Δ | ○ | |
| 193 | 5 | H | e | Δ | X | ○ | Com-parative examples |
| 194 | 6 | H | a | Δ | X | ○ | |
| 195 | 6 | H | b | Δ | Δ | ○ | |
| 196 | 6 | H | c | Δ | Δ | ○ | |
| 197 | 6 | H | d | Δ | X | ○ | |
| 198 | 6 | H | e | Δ | ○ | ○ | |
| 199 | 1 | I | a | ○ | ○ | ○ | Examples of the present invention |
| 200 | 1 | I | b | ○ | ○ | ○ | |
| 201 | 1 | I | c | ○ | ○ | ○ | |
| 202 | 1 | I | d | ○ | ○ | ○ | |
| 203 | 1 | I | e | ○ | ○ | ○ | |
| 204 | 1 | I | f | ○ | ○ | X | Com-parative examples |
| 205 | 1 | I | g | ○ | ○ | X | |

TABLE 17-continued

| No. | Steel sheet | Ni—P coating | Zn coat-ing | Cor-rosion resistance | Paint-abitity | Work-abilty | |
|---|---|---|---|---|---|---|---|
| | | | | | | | examples |
| 206 | 2 | I | a | ○ | ○ | ○ | Examples of the present invention |
| 207 | 2 | I | b | ○ | ○ | ○ | |
| 208 | 2 | I | c | ○ | ○ | ○ | |
| 209 | 2 | I | d | ○ | ○ | ○ | |
| 210 | 2 | I | e | ○ | ○ | ○ | |
| 211 | 2 | I | f | ○ | ○ | X | Com-parative examples |
| 212 | 2 | I | g | ○ | ○ | X | |
| 213 | 3 | I | a | ○ | ○ | ○ | Examples of the present invention |
| 214 | 3 | I | b | ○ | ○ | ○ | |
| 215 | 3 | I | c | ○ | ○ | ○ | |
| 216 | 3 | I | d | ○ | ○ | ○ | |
| 217 | 3 | I | e | ○ | ○ | ○ | |
| 218 | 3 | I | f | ○ | ○ | X | Com-parative examples |
| 219 | 3 | I | g | ○ | ○ | X | |
| 220 | 4 | I | a | Δ | X | ○ | Examples of the present invention |
| 221 | 4 | I | b | Δ | Δ | ○ | |
| 222 | 4 | I | c | Δ | Δ | ○ | |

TABLE 18

| No. | Steel sheet | Ni—P coating | Zn coat-ing | Cor-rosion resistance | Paint-abitity | Work-abilty | |
|---|---|---|---|---|---|---|---|
| 223 | 4 | I | d | Δ | Δ | ○ | Com-parative examples |
| 224 | 4 | I | e | Δ | X | ○ | |
| 225 | 5 | I | a | Δ | X | ○ | |
| 226 | 5 | I | b | Δ | Δ | ○ | |
| 227 | 5 | I | c | Δ | Δ | ○ | |
| 228 | 5 | I | d | Δ | Δ | ○ | |
| 229 | 5 | I | e | Δ | X | ○ | |
| 230 | 6 | I | a | Δ | X | ○ | |
| 231 | 6 | I | b | Δ | Δ | ○ | |
| 232 | 6 | I | c | Δ | Δ | ○ | |
| 233 | 6 | I | d | Δ | Δ | ○ | |
| 234 | 6 | I | e | Δ | X | ○ | |
| 235 | 1 | J | a | ○ | ○ | ○ | Examples of the present invention |
| 236 | 1 | J | b | ○ | ○ | ○ | |
| 237 | 1 | J | c | ○ | ○ | ○ | |
| 238 | 1 | J | d | ○ | ○ | ○ | |
| 239 | 1 | J | e | ○ | ○ | ○ | |
| 240 | 1 | J | f | ○ | ○ | X | Com-parative examples |
| 241 | 1 | J | g | ○ | ○ | X | |
| 242 | 2 | J | a | ○ | ○ | ○ | Examples of the present invention |
| 243 | 2 | J | b | ○ | ○ | ○ | |
| 244 | 2 | J | c | ○ | ○ | ○ | |
| 245 | 2 | J | d | ○ | ○ | ○ | |
| 246 | 2 | J | e | ○ | ○ | ○ | |
| 247 | 2 | J | f | ○ | ○ | X | Com-parative examples |
| 248 | 2 | J | g | ○ | ○ | X | |
| 249 | 3 | J | a | ○ | ○ | ○ | Examples the the present invention |
| 250 | 3 | J | b | ○ | ○ | ○ | |
| 251 | 3 | J | c | ○ | ○ | ○ | |
| 252 | 3 | J | d | ○ | ○ | ○ | |
| 253 | 3 | J | e | ○ | ○ | ○ | |
| 254 | 3 | J | f | ○ | ○ | X | Com-paraive examples |
| 255 | 3 | J | g | ○ | ○ | X | |
| 256 | 1 | K | a | ○ | ○ | ○ | Examples of the present invention |
| 257 | 1 | K | d | ○ | ○ | ○ | |
| 258 | 2 | K | a | ○ | ○ | ○ | |
| 259 | 2 | K | d | ○ | ○ | ○ | |
| 260 | 3 | K | a | ○ | ○ | ○ | |
| 261 | 3 | K | d | ○ | ○ | ○ | |
| 262 | 1 | L | a | ○ | Δ | ○ | |
| 263 | 1 | L | d | ○ | Δ | ○ | |

TABLE 18-continued

| No. | Steel sheet | Ni—P coating | Zn coat-ing | Cor-rosion resistance | Paint-abitity | Work-abilty | |
|---|---|---|---|---|---|---|---|
| 264 | 2 | L | a | ○ | Δ | ○ | |
| 265 | 2 | L | d | ○ | Δ | ○ | |

TABLE 19

| No. | Steel sheet | Ni—P coating | Zn coat-ing | Cor-rosion resistance | Paint-abitity | Work-abilty | |
|---|---|---|---|---|---|---|---|
| 266 | 3 | L | a | ○ | Δ | ○ | Examples of the present invention |
| 267 | 3 | L | d | ○ | Δ | ○ | |
| 268 | 1 | M | a | Δ | X | ○ | |
| 269 | 1 | M | d | Δ | X | ○ | |
| 270 | 2 | M | a | Δ | X | ○ | |
| 271 | 2 | M | d | Δ | X | ○ | |
| 272 | 3 | M | a | Δ | X | ○ | |
| 273 | 3 | M | d | Δ | X | ○ | |
| 274 | 1 | N | a | ○ | ○ | Δ | Com-parative examples |
| 275 | 1 | N | d | ○ | ○ | Δ | |
| 276 | 2 | N | a | ○ | ○ | Δ | |
| 277 | 2 | N | d | ○ | ○ | Δ | |
| 278 | 3 | N | a | ○ | ○ | Δ | |
| 279 | 3 | N | d | ○ | ○ | Δ | |
| 280 | 1 | O | a | ○ | ○ | Δ | |
| 281 | 1 | O | d | ○ | ○ | Δ | |
| 282 | 2 | O | a | ○ | ○ | Δ | |
| 283 | 2 | O | d | ○ | ○ | Δ | |
| 284 | 3 | O | a | ○ | ○ | Δ | |
| 285 | 3 | O | d | ○ | ○ | Δ | |
| 286 | 1 | P | a | ○ | ○ | Δ | |
| 287 | 1 | P | d | ○ | ○ | Δ | |
| 288 | 2 | P | a | ○ | ○ | Δ | |
| 289 | 2 | P | d | ○ | ○ | Δ | |
| 290 | 3 | P | a | ○ | ○ | Δ | |
| 291 | 3 | P | d | ○ | ○ | Δ | |
| 292 | 1 | Q | a | X | X | ○ | |
| 293 | 1 | Q | d | X | X | ○ | |
| 294 | 2 | Q | a | X | X | ○ | |
| 295 | 2 | Q | d | X | X | ○ | |
| 296 | 3 | Q | a | X | X | ○ | |
| 297 | 3 | Q | d | X | X | ○ | |

TABLE 20

| No. | Steel sheet | Ni—P coating | Zn coat-ing | Cor-rosion resistance | Paint-abitity | Work-abilty | |
|---|---|---|---|---|---|---|---|
| 298 | 1 | A | a | ○ | ○ | ○ | Examples of the preswent in-ventiom |
| 299 | 1 | A | d | ○ | ○ | ○ | |
| 300 | 1 | B | a | ○ | ○ | ○ | |
| 301 | 1 | B | d | ○ | ○ | ○ | |
| 302 | 1 | C | a | ○ | ○ | ○ | |
| 303 | 1 | C | d | ○ | ○ | ○ | |
| 304 | 1 | L | a | ○ | Δ | Δ | Com-parative examples |
| 305 | 1 | L | d | ○ | Δ | Δ | |
| 306 | 1 | M | a | Δ | X | Δ | |
| 307 | 1 | M | d | Δ | X | Δ | |
| 308 | 1 | N | a | ○ | ○ | X | |
| 309 | 1 | N | d | ○ | ○ | X | |
| 310 | 2 | A | a | ○ | ○ | ○ | Examples of the preswent invention |
| 311 | 2 | A | d | ○ | ○ | ○ | |
| 312 | 2 | B | a | ○ | ○ | ○ | |
| 313 | 2 | B | d | ○ | ○ | ○ | |
| 314 | 2 | C | a | ○ | ○ | ○ | |
| 315 | 2 | C | d | ○ | ○ | ○ | |
| 316 | 2 | L | a | ○ | Δ | Δ | Com-parative examples |
| 317 | 2 | L | d | ○ | Δ | Δ | |
| 318 | 2 | M | a | Δ | X | Δ | |
| 319 | 2 | M | d | Δ | X | Δ | |
| 320 | 2 | N | a | ○ | ○ | X | |
| 321 | 2 | N | d | ○ | ○ | X | |

TABLE 20-continued

| No. | Steel sheet | Ni—P coating | Zn coat-ing | Cor-rosion resistance | Paint-abitity | Work-abilty | |
|---|---|---|---|---|---|---|---|
| 322 | 3 | A | a | ○ | ○ | ○ | Examples of the preswent in-ventiom |
| 323 | 3 | A | d | ○ | ○ | ○ | |
| 324 | 3 | B | a | ○ | ○ | ○ | |
| 325 | 3 | B | d | ○ | ○ | ○ | |
| 326 | 3 | C | a | ○ | ○ | ○ | |
| 327 | 3 | C | d | ○ | ○ | ○ | |
| 328 | 3 | L | a | ○ | Δ | Δ | Com-parative examples |
| 329 | 3 | L | d | ○ | Δ | Δ | |
| 330 | 3 | M | a | Δ | X | Δ | |
| 331 | 3 | M | d | Δ | X | Δ | |
| 332 | 3 | N | a | ○ | ○ | X | |
| 333 | 3 | N | d | ○ | ○ | X | |

TABLE 21

| No. | Steel sheet | Ni—P coating | Zn coat-ing | Cor-rosion resistance | Paint-abitity | Work-abilty | |
|---|---|---|---|---|---|---|---|
| 334 | 1 | A | h | ○ | ○ | ○ | Examples of the preswent invention |
| 335 | 2 | A | h | ○ | ○ | ○ | |
| 336 | 3 | A | h | ○ | ○ | ○ | |
| 337 | 1 | A | i | ○ | ○ | ○ | |
| 338 | 2 | A | i | ○ | ○ | ○ | |
| 339 | 3 | A | i | ○ | ○ | ○ | |
| 340 | 1 | A | j | ○ | ○ | ○ | |
| 341 | 2 | A | j | ○ | ○ | ○ | |
| 342 | 3 | A | j | ○ | ○ | ○ | |
| 343 | 1 | A | k | ○ | ○ | ○ | |
| 344 | 2 | A | k | ○ | ○ | ○ | |
| 345 | 3 | A | k | ○ | ○ | ○ | |
| 346 | 1 | A | l | ○ | ○ | X | Com-parative examples |
| 347 | 2 | A | l | ○ | ○ | X | |
| 348 | 3 | A | l | ○ | ○ | X | |

EMBODIMENT-3

Detail description of the invention is given below.

The following is the description of the reason to limit the composition of the steel (hereinafter the composition unit is expressed by wt. %).

C: The content of C is from 0.001 to 0.006%.

Smaller C content is preferred to maintain superior mechanical characteristics of the material. Accordingly, the upper limit of C content not degrading the effect of the invention is specified as 0.006%. Regarding the lower limit, an excessively low C content gives not much improve in the workability, and a very low C content needs to be compensated by the addition of other elements, which causes a cost increase. So the lower limit of C content is specified as 0.001%.

Si: The content of Si is less than 0.35%.

Silicon contributes to the strengthening of steel sheet as a solid-solution hardening element without degrading the press-formability. However, excess Si content degrades the formability and also degrades the coating capability, so the Si content is specified as less than 0.35%.

Mn: The content of Mn is from 0.05 to 0.5%.

Manganese is necessary to fix S which is unavoidably included in steel and to prevent red shortness. Accordingly, the lower limit is specified as 0.05%. Addition of more than 0.5% Mn significantly degrades Lankford value, and is disadvantage in terms of cost. So the upper limit is specified as 0.5%.

P: The content of P is from 0.03 to 0.08%.

Phosphorus is a most inexpensive element to strengthen the steel, and is an element to improve the corrosion resistance of the steel itself. When an IF steel is used as the base material and when P is included more than 0.1%, the steel increases the strength and tends to segregate P at grain boundaries, which induces a problem of poor secondary working. Therefore, the P content is specified as 0.08% or less. On the other hand, for the contribution to corrosion resistance, the P content of 0.03% is required, so the lower limit is specified as 0.03%.

S: The content of S is 0.01% or less.

The S content above 0.01% degrades the ductile property of steel and gives a bad effect to corrosion resistance. So the S content is specified as 0.01% or less. More preferably the S content is 0.007% or less.

sol.Al: The content of sol.Al is from 0.01 to 0.1%.

Aluminum is necessary for de-oxidation and for fixing N. However, excess addition of sol.Al increases the product cost and degrades the surface quality owing to the increase of alumina inclusion. As a result, the sol.Al content is specified in 0.01 to 0.1%.

N: The content of N is 0.0035% or less.

To attain a high Lankford value, less N content is preferred. The upper limit of N content is specified at 0.0035% as the range not degrading the effect of this invention.

Cu: The content of Cu is from 0.1 to 0.5%.

When Cu is added with P, it improves the corrosion resistance of steel itself. The effect appears at 0.1% or more of the content. An excess addition of Cu degrades the deep drawing performance, and tends to induce thermal cracks during hot rolling caused by a surface defect or by coexistence with Sn. So the upper limit is specified as 0.5%.

Ni: The content of Ni is from 0.1 to 0.5%.

Nickel is an effective element to reduce the surface defects caused by the addition of Cu, and to improve the corrosion resistance. Excess addition of Ni, however, degrades the deep drawing performance and increases the product cost. Accordingly, the lower limit is specified as 0.1%, and the upper limit is specified as 0.5%.

Ti: The content of Ti is from 0.01 to 0.06%.

Titanium is an essential element to prevent the degradation of material quality caused by C solid solution and N solid solution. For this purpose, the addition of 0.01% or more Ti is required. The addition of more than 0.06% Ti does not give further effect and induces disadvantage in cost. Therefore, the range of Ti content is specified from 0.01 to 0.06%. To precipitate and fix the C solid solution and N solid solution in steel completely, the following conditions have to be satisfied.

$$4\times C<Ti-(48/14)\times N-(48/32)\times S,$$

Nb: The content of Nb is from 0.003 to 0.015%, and the equation of $0.004\leqq Nb\times(10\times P+Cu+Ni)$ is satisfied Combined addition of Nb with Cu and P enhances the growth of passive film, improves the anti-pitting property, and decreases the anisotropy of rm value. The effect diminishes at the Nb content of less than 0.003%. When the Nb content exceeds 0.015%, the effect saturates and the recrystallizing temperature of steel increases, and increases the cost. Consequently, the content of Nb is specified in 0.003 to 0.015%. The effect does not appear when Nb exists as a precipitate. In other words, Nb is necessary to exist as a solid solution in steel. In the steel of this invention, Ti reacts with C, N, and S, so all of Nb is in a state of solid solution in steel.

Less P, Cu, and Ni content weaken the passive film, so the amount of Nb to improve the anti-pitting characteristic is needed to compensate the insufficient amount of P, Cu, and Ni. In concrete terms, the necessary amount of Nb is defined as:

$$0.004\leqq Nb\times(10\times P+2X\ Cu+Ni).$$

Figure 2:
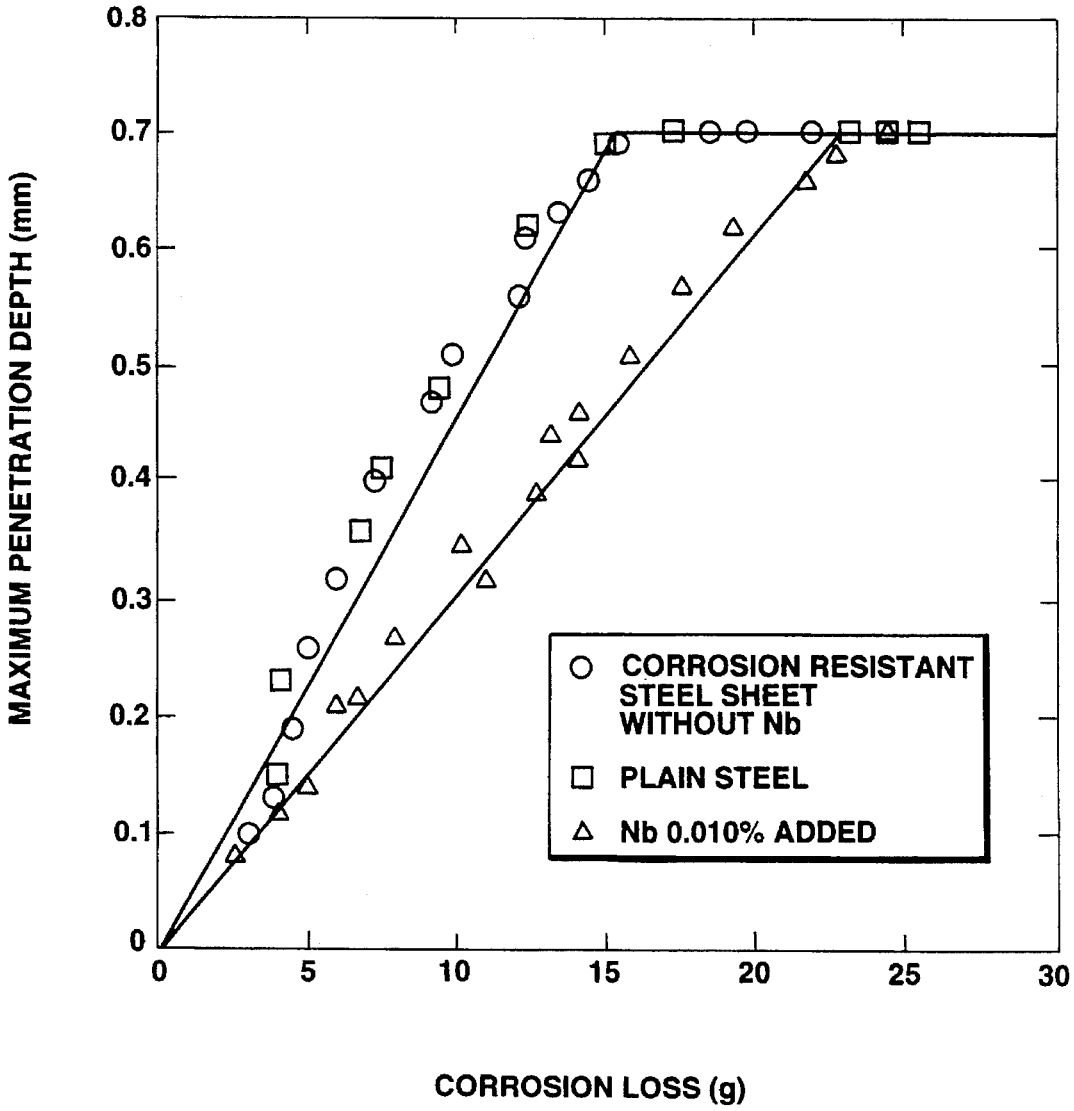
FIG. 2 is a graphical representation showing the relationship between corrosion loss and maximum penetration depth of the present invention.
Figure 3:
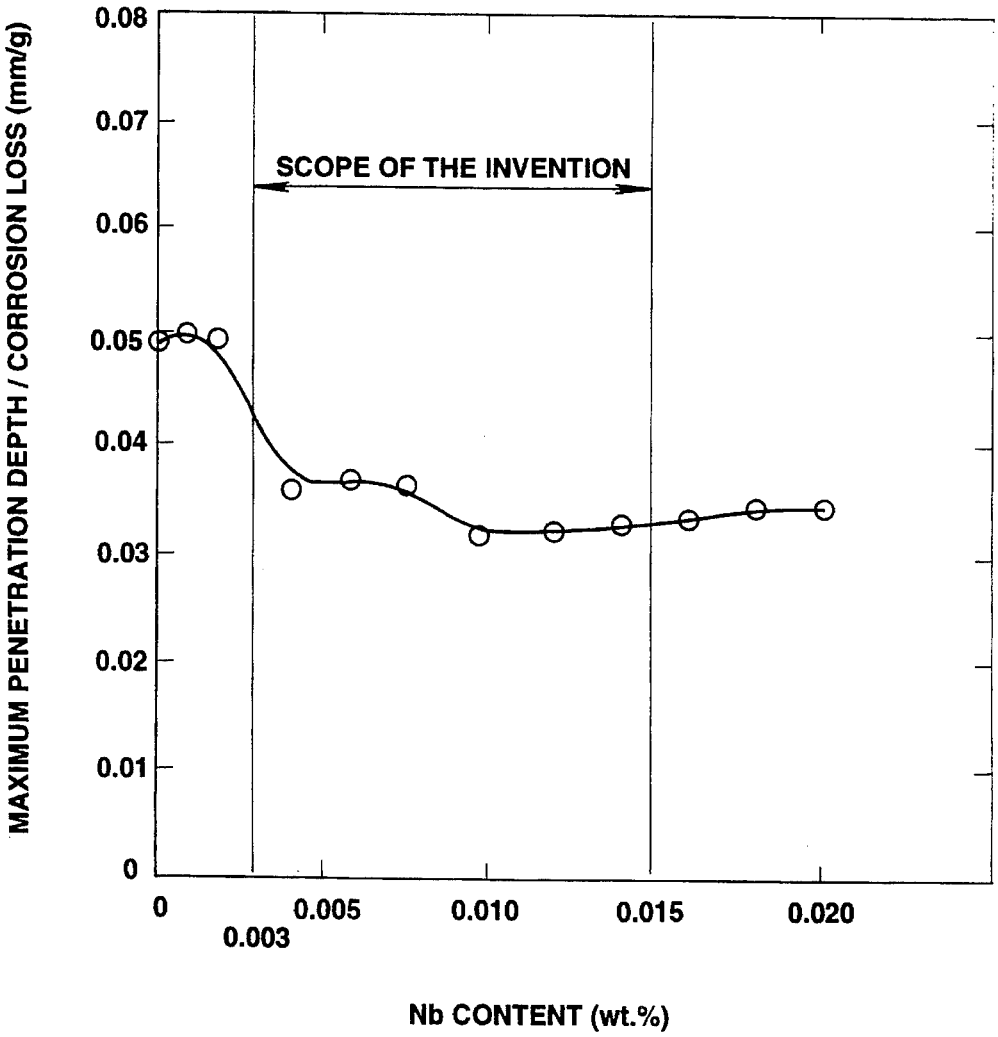
FIG. 3 is a graphical representation showing the relationship between Nb content and maximum penetration depth divided by corrosion loss of the present invention.
Figure 4:
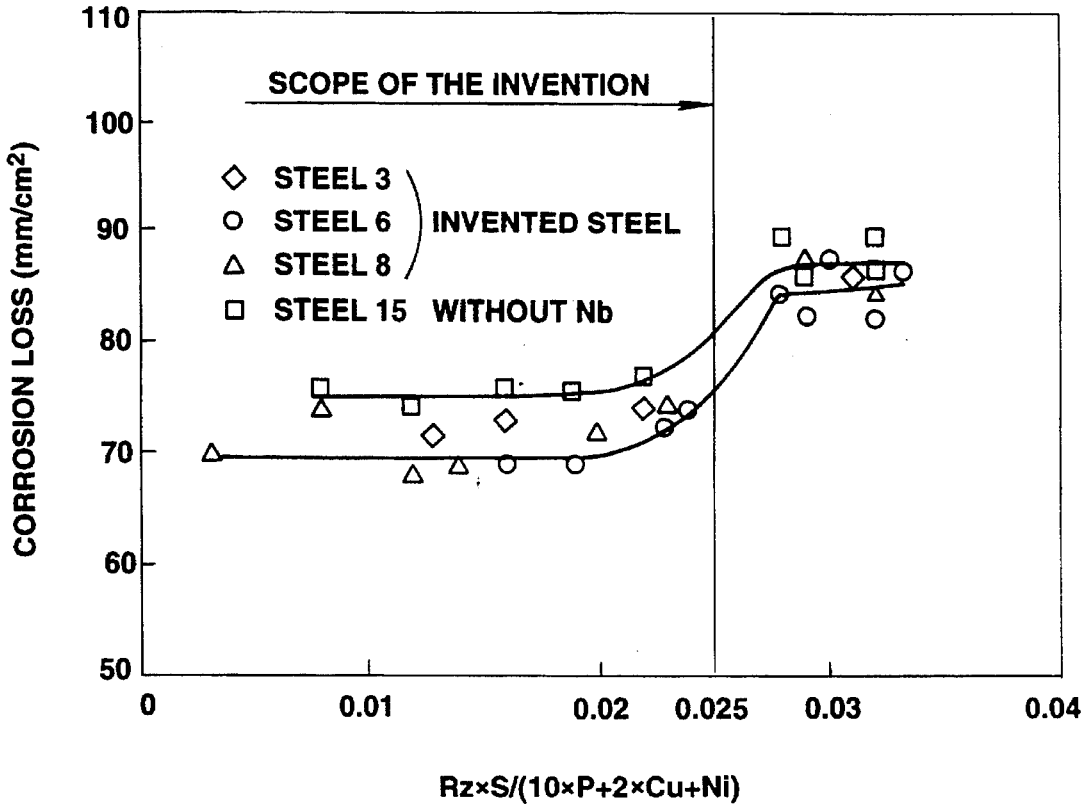
FIG. 4 is a graphical representation showing the relationship between Rz×S/(10×P+2×Cu+Ni) and corrosion loss of the present invention.

As for the effect of Nb on anti-pitting performance, a test method described after in an example is employed to compare the ordinary steel sheet, corrosion resistant steel containing 0.4% Cu, 0.05% P, 0.2% Ni as the base (Comparative steel), with the steel further containing 0.010% Nb (Example of this invention) for the maximum erosion depth and the mass loss. The result is shown in FIG. 2. The anti-pitting performance based on the ratio of the maximum erosion depth to the mass loss is compared between the corrosion resistant steel containing 0.4% Cu, 0.05% P, 0.2% Ni as the base (Comparative steel) and the steel with different Nb content (Example of this invention). The result is shown in FIG. 4. FIG. 2 and FIG. 3 show that the corrosion resistant steel sheet without containing Nb gives similar anti-pitting performance with ordinary steel sheet (SPCC) and that the corrosion resistant steel sheet containing Nb solid solution gives significantly superior anti-pitting performance.

B: The content of B is from 0.0002 to 0.002%, and is selected as $(P/200)<B$.

Boron is effective for improving the secondary working brittleness. A steel of this invention containing P tends to induce secondary working brittleness. Accordingly, B gives a significant effect to that type of steel. However, the effect is not performed below 0.0002% of P content. The P content of more than 0.002% hardens the steel so that the specified range of the B content is settled as given above. The reason to adopt the limitation, $(P/200)<B$, is to reduce the effect of P to make the steel brittle.

The above described composition of steel gives sufficient corrosion resistance to the steel sheet. However, the corrosion resistance is not satisfactory for automobile steel sheets which are used under a severe environment. For obtaining further corrosion resistance and mechanical characteristics, this invention forms a diffused alloy layer consisting of Fe-Ni-P on a steel sheet having the composition above described. The Ni-P alloy coating containing P of 8 to 18% forms an amorphous-like structure. When a steel sheet having that type of coating is subjected to heat treatment, a uniform diffused alloy layer is formed within a short period compared with the case of common crystalline coating layers. The diffused alloy layer protects the base steel material from corrosion and, once the corrosion of the base steel sheet begins, makes the iron corrosion product promptly dense structure. As a result, the steel sheet obtains excellent corrosion resistance which could not attained in the prior arts.

A Ni-P coating containing P of less than 8% forms a crystalline layer and gives non-uniform P distribution. As a result, that type of coating has non-uniform composition of diffused alloy layer when it is subjected to heat treatment, and the initial stage rust is insufficient in its uniformity and denseness, which gives unstable corrosion resistance. On the other hand, a coating containing P of above 18% makes the Ni-P alloy coating brittle and degrades the adhesiveness of the coating layer.

As a result, that type of coating tends to separate from the base steel sheet during heat treatment. Therefore, the P content of the coating layer formed on the steel sheet of this invention is specified to 8 to 18%. Preferred range is from 8 to 15%, and more preferable range is from 10 to 13%.

The Ni-P alloy coating composition may further contain at least one element selected from the group consisting of N, Mo, Cr, and Cu to form a composite alloy coating. Those additional elements play a role of inhibitor to steel corrosion and show an effect to improve the denseness and stability of initial stage rust by the synergistic effect with Ni and P. Regarding the content of N, Mo, Cr, and Cu, a preferred content of the sum of them is not more than 15%. The corrosion resistance increases with the increase of the content of W, Mo, Cr, and Cu.

However, when the sum of the added amount of W, Mo, Cr, and Cu exceeds 15%, the adhesiveness of the coating layer degrades, and likely generates the separation of coating layer in the succeeding steps. Therefore, the content of the sum of W, Mo, Cr, and Cu is specified as 15% or less. A preferable lower limit of the sum of W, Mo, Cr, and Cu to perform the effect of the addition is 0.5%.

The coating weight of the Ni-P layer is not specifically defined. Nevertheless, a preferable range is from 0.1 to 8 $g/m^2$. The coating weight of less than 0.1 $g/m^2$ gives insufficient improvement of corrosion resistance, and the coating weight of above 8$g/m^2$ degrades the workability of coating layer and induces separation of the layer. Furthermore, excess coating weight needs to slow the line speed, which is a disadvantage in production yield.

When the steel sheets described above satisfy the condition of surface roughness given below, the corrosion resistance further improves.

$$Rz(\mu m):1 \text{ to } 8, \text{ and } Rz\times S/(10\times P+2\times Cu+Ni)\leqq 0.025.$$

Increase of the surface roughness degrades the corrosion resistance. Therefore, $Rz\leqq 8$ μm is specified. However, Rz less than 1 μm only increases the cost and does not affect the corrosion resistance. Accordingly, $Rz\leqq 1$ μm is preferred. The effect of Rz on the corrosion resistance differs with steel composition, and when the condition, $Rz\times S/(10\times P+2\times Cu+Ni)\leqq 0.25$ is satisfied, the corrosion resistance further improves. The relation of $Rz\times S/(10\times P+2\times Cu+Ni)$ and the mass loss is shown in FIG. 4. From the figure, the range of $Rz\times S/(10\times P+2\times Cu+Ni)>0.025$ gives an inferior corrosion resistance. Also the figure shows that the steel No. 15 without Nb gives a slightly inferior corrosion resistance to the steels of this invention.

The following is a preferred condition for producing the cold-rolled steel sheets which are described above. A steel having the composition shown before is formed into a slab by, for example, continuous casting method or ingot making method, and the slab is treated by the following procedure.

The heating temperature of the slab is arbitrary if only it is a level for making the precipitate within the slab to a solid solution again. For a steel having the composition described above, the heating temperature at 1100° C. or more is preferred.

As for the finish temperature, the temperature at $Ar_3$ point or less results in a degraded deep drawing performance, so the rolling at or above $Ar_3$ point is preferred. The coiling temperature at 550° C. or more yields coarse ferrite grains and gives good workability, but an excessively high coiling temperature accelerates the segregation of P to grain boundaries to degrade the secondary working brittleness. An increased P content likely induces the grain boundary segregation, and an increased B content suppresses the grain boundary segregation. Accordingly, the coiling temperature is preferably at or less that specified by the equation:

$$\{650+200\times(200\times B-P)\}°C.$$

The Ni-P coating is applied before the annealing, and it may be applied immediately after the pickling at the exit of the pickling line before the cold rolling or may be applied after the cold rolling succeeding to the pickling. Particularly when the coating is given before the cold rolling, there appears an advantage that no pickling is required as the cleaning and activating the sheet before coating.

Although no specific condition for cold rolling is defined, it is preferable to select the reduction ratio of 50% or more to maintain excellent deep drawing performance.

Several methods for forming Ni-P alloy coating layer have been introduced. Among them, the electroplating or electroless coating (chemical coating) are preferred from the viewpoint of simplicity of operation and quality of obtained film.

The steel sheet coated with Ni-P alloy coating layer undergoes a heat treatment in a non-oxidizing atmosphere to form a diffused alloy layer consisting mainly of Fe-Ni-P at the interface between the base steel plate and the coating layer. The heat treatment for diffusion may be carried out in an ordinary annealing facility after cold rolling. In particular, a continuous annealing which has a high productivity is preferred. The continuous annealing may be carried out by a common continuous annealing facility for cold-rolled steel sheets and an annealing facility used as a pre-treatment unit of hot dip coating line. A preferred maximum temperature of the heat treatment is 750° C. or more, more preferably at 820° C. or more because higher temperature gives better deep drawing performance. The temperature below 750° C. can not form a sufficient diffused layer between the Ni-P alloy coating layer and the steel sheet surface, and the insufficient dense-rust formation during the corrosion process gives only a small effect for improving corrosion resistance. On the other hand, the heat treatment at above 900° C. tends to induce a pickup of coating metal onto the rolls in the heating furnace, which likely generates surface defects on steel sheets. The annealing at above 900° C. induces the growth of coarse ferrite grains, which likely generates rough surface after the press-forming. A preferred range of holding time at the maximum temperature of the steel sheet is 1 to 120 sec, though the holding time depends on the temperature. Too short holding time does not give the improving effect of corrosion resistance because sufficient diffusion layer can not be formed. An excessive holding time over 120 sec. induces an excessive diffusion alloying, which results in a brittle interface layer to degrade the adhesiveness and workability of the coating layer because the sufficient diffused layer can not be formed. During the heat treatment, an overaging may be applied for several minutes at an approximate temperature range of from 300° to 400° C. A preferable depth of appropriate diffused layer formed by the heat treatment is in a range of from 0.1 to 20 μm. Regarding the re-crystallization annealing, a production method using a continuous annealing is preferred. The reason is that the box annealing makes P segregate to the grain boundaries during the gradual cooling after annealing, and degrades the workability and the corrosion resistance.

On applying heat treatment, the roll pickup within the furnace is avoidable when a direct fired furnace is used and the heating speed is at 50° C./sec. or more.

When a Ni-P alloy coating layer undergoes heat treatment, two types of coating structure appear. The one is that a part of the Ni-P alloy coating layer forms a diffused alloy layer and forms the steel sheet/diffused alloy layer/Ni-P alloy coating layer structure. The other is that all the Ni-P alloy coating layer forms a diffused alloy layer to give the steel sheet/diffused alloy layer structure. This invention includes both cases. After the heat treatment for diffusion, a temper rolling is conducted under an appropriate condition, at need.

The Rz control is carried out by polishing the rolling rolls and post-annealing temper rolls with grinder, Cr or Ni coating after the polishing with grinder, shot blast, electrical discharge machining, laser processing, etching, EBT processing, etc. The key factor is to control the Rz of roll at a lower level than usual.

The cold-rolled steel sheets having both such a corrosion resistance and workability are quite useful as an automobile material.

EXAMPLE

The following is the description of an example of this invention. Nevertheless, this invention naturally not restricted by the example.

The test pieces prepared were evaluated in terms of corrosion resistance and adhesiveness of coating layer. The method and criteria of the evaluation are the following.

(1) Corrosion resistance

The test piece is exposed to a corrosive condition of repeated drying and humidifying combined with salt solution spraying at a rate of 1 cycle per day. The resulted corrosion depth is measured to evaluate in accordance with the criterion given below.

○: the maximum corrosion depth is 0.2 mm or less

Δ: the maximum corrosion depth is deeper than 0.2 mm and not deeper than 0.4 mm

X: the maximum corrosion depth is deeper than 0.4 mm (2) Workability

The test piece undergoes the 180 degree bending test to observe the damage of coating layer at the tip of bend. The evaluation is given in accordance with the following criterion.

○: no damage or only fine cracks are observed

Δ: large crack is observed or partial separation of coating layer is observed

X: coating separation is observed in a wide range

EXAMPLE-6

Examples of this invention are described below.

The steels of this invention and the comparative steels each having the composition listed in Table 22 were melted and formed into slabs. Each of the slabs was heated to 1250° C., hot-rolled at 900° C. to form a sheet of 2.8 mm thick. Then the sheet was coiled at 620° C. to obtain a hot-rolled sheet. After pickling, the sheet was cold-rolled to a thickness of 0.7 mm at a reduction rate of 75%, and the sheet was coated with Ni-P layer containing 18% P at a coating weight of 1 g/m$^2$. The sheet was subjected to a heat treatment at 850° C. and a temper-rolling of 0.5% to obtain the cold-rolled steel sheet. The reference symbols X and Y in Table 22 designate:

$$X=Ti-(48/14)\times N-(48/32)\times S-4\times C,$$

$$Y=Nb\times(10\times P+2\times Cu+Ni)-0.004,$$

and the region $X\geqq 0$ includes Ti at an excess amount of equivalent to C, N, and S.

Table 23 shows the determined mechanical characteristics of obtained steel sheets. The tensile test was carried out using JIS No.5 test piece. The values of $r_m$ was calculated by the equation:

$$r_{m=(Ro}+2\times r_{45}+r_{90})/4,$$

$$\Delta r=(r_o-2\times r_{45}+r_{90})/2.$$

The fracture appearance transition temperature is a temperature which does not induce brittle fracture when a cup forming is given at a drawing ratio of 2.1 followed by press-fitting a conical punch from the edge of the cup. The anti-longitudinal crack performance was evaluated by the fracture appearance transition temperature.

As for Rz, the surface roughness of the steel sheet was measured for three times, and the average of them was adopted as Rz. The reference character Z is defined by the equation of:

$$Z=Rz\times S/(10\times P+2\times Cu+P).$$

Table 23 clearly shows that the steels No. 1 and No. 2 contain less P and give inferior corrosion resistance. The steels No. 9 and No. 10 contain excess amount of P so that they show poor formability. The steels No. 11 and No. 12 contain too small amount of Cu so that they are inferior in corrosion resistance. The steels No. 13 and No. 14 contain excess amount of Cu so that the formability is poor. The steel No. 15 contains no Nb so that it gives a large Δr and likely induces pitting. The steels No. 15 and No. 16 contain no B so that they generate the secondary working brittleness. The steel No. 19 contains excess amount of C, Si, and Nb, so it is inferior in formability, and it contains no Ni so that the corrosion resistance is not satisfactory. The steels No. 10, 15, 18, and 19, which have X<0 property does not perfectly fix the C solid solution or N solid solution so that they are inferior in the workability such as deep drawing performance. The steels No. 2, 15, and 21 which have Y<0 property are inferior in the anti-pitting performance. The steels No. 10, 11, 12, 15, 17, 19, and 20 which have Rz>0.025 property are also inferior in corrosion resistance.

EXAMPLE-7

The steels of this invention (steel No. 3 and 5) each having the composition listed in Table 22 were melted and formed into slabs. Each of the slabs was heated to 1250° C, hot-rolled at 900° C. to form a sheet of 2.8 mm thick. Then the sheet was coiled at 620° C. to obtain a hot-rolled sheet. After pickling, the sheet was cold-rolled to a thickness of 0.7 mm at a reduction rate of 75%, and the sheet was coated with Ni-P layer in a range listed in Table 24, followed by the continuos annealing at 850° C. and by the temper-rolling of 0.5% to prepare the test piece. The test result is summarized in Table 26. The steels of this invention gave excellent corrosion resistance and adhesiveness of coating layer.

EXAMPLE-8

The steels of this invention (steel No. 3 and 5) each having the composition listed in Table 22 were melted and formed into slabs. Each of the slabs was heated to 1250° C., hot-rolled at 900° C. to form a sheet of 2.8 mm thick. Then the sheet was coiled at 620° C. to obtain a hot-rolled sheet. After pickling, the sheet was coated by Ni-P layer within a range listed in Table 24, then the sheet was cold-rolled to a thickness of 0.7 mm at a reduction rate of 75%. The sheet underwent the continuos annealing at 850° C. and by the refining rolling of 0.5% to prepare the test piece. The test result is summarized in Table 25. The steels of this invention gave excellent corrosion resistance and adhesiveness of coating layer.

TABLE 22

| Steel | Chemical composition (wt. %) | | | | | | | | | | | | B-P/200 | Remarks | |
|---|---|---|---|---|---|---|---|---|---|---|---|---|---|---|---|
| | C | Si | Mn | P | S | sol. Al | N | Cu | Ni | Ti | Nb | B | ($10^{-4}$) | X | Y |
| 1 | 0.0030 | 0.04 | 0.20 | 0.011* | 0.003 | 0.032 | 0.0019 | 0.451 | 0.230 | 0.041 | 0.011 | 0.0008 | 7.45 | 0.018 | 0.0097 |
| 2 | 0.0027 | 0.06 | 0.06 | 0.024* | 0.002 | 0.061 | 0.0015 | 0.246 | 0.211 | 0.023 | 0.006 | 0.0010 | 8.80 | 0.004 | 0.0017 |
| 3 | 0.0019 | 0.15 | 0.19 | 0.033 | 0.004 | 0.019 | 0.0031 | 0.410 | 0.310 | 0.025 | 0.013 | 0.0005 | 3.35 | 0.008 | 0.0150 |
| 4 | 0.0056 | 0.09 | 0.20 | 0.038 | 0.004 | 0.037 | 0.0028 | 0.453 | 0.308 | 0.047 | 0.011 | 0.0007 | 5.10 | 0.009 | 0.0135 |
| 5 | 0.0038 | 0.11 | 0.12 | 0.045 | 0.003 | 0.029 | 0.0030 | 0.189 | 0.159 | 0.034 | 0.009 | 0.0011 | 8.75 | 0.004 | 0.0049 |
| 6 | 0.0023 | 0.04 | 0.14 | 0.064 | 0.006 | 0.046 | 0.0025 | 0.280 | 0.189 | 0.380 | 0.011 | 0.0010 | 6.80 | 0.011 | 0.0110 |
| 7 | 0.0039 | 0.02 | 0.26 | 0.070 | 0.004 | 0.053 | 0.0014 | 0.248 | 0.204 | 0.050 | 0.008 | 0.0009 | 5.50 | 0.024 | 0.0072 |
| 8 | 0.0041 | 0.22 | 0.28 | 0.077 | 0.001 | 0.073 | 0.0017 | 0.199 | 0.289 | 0.048 | 0.010 | 0.0007 | 3.15 | 0.024 | 0.0106 |
| 9 | 0.0040 | 0.10 | 0.30 | 0.086* | 0.002 | 0.040 | 0.0022 | 0.230 | 0.198 | 0.031 | 0.013 | 0.0017 | 12.70 | 0.004 | 0.0157 |
| 10 | 0.0098* | 0.11 | 0.32 | 0.108* | 0.009 | 0.020 | 0.0031 | 0.201 | 0.286 | 0.053 | 0.006 | 0.0001* | −4.40* | −0.010* | 0.0066 |
| 11 | 0.0045 | 0.30 | 0.20 | 0.052 | 0.007 | 0.045 | 0.0028 | 0.064* | 0.197 | 0.047 | 0.012 | 0.0012 | 9.40 | 0.009 | 0.0061 |
| 12 | 0.0027 | 0.15 | 0.18 | 0.045 | 0.006 | 0.022 | 0.0032 | 0.087* | 0.233 | 0.040 | 0.010 | 0.0010 | 7.75 | 0.009 | 0.0046 |
| 13 | 0.0045 | 0.17 | 0.22 | 0.051 | 0.003 | 0.077 | 0.0020 | 0.586* | 0.310 | 0.034 | 0.008 | 0.0008 | 5.45 | 0.005 | 0.0119 |
| 14 | 0.0038 | 0.21 | 0.14 | 0.068 | 0.005 | 0.082 | 0.0019 | 0.609* | 0.459 | 0.036 | 0.012 | 0.0010 | 6.60 | 0.007 | 0.0243 |
| 15 | 0.0059 | 0.33 | 0.31 | 0.066 | 0.009 | 0.015 | 0.0015 | 0.298 | 0.103 | 0.020 | Tr.* | Tr.* | −3.30* | −0.022* | −0.0040* |
| 16 | 0.0052 | 0.01 | 0.09 | 0.052 | 0.004 | 0.035 | 0.0028 | 0.310 | 0.128 | 0.046 | 0.005 | Tr.* | −2.60* | 0.010 | 0.0023 |
| 17 | 0.0030 | 0.22 | 0.23 | 0.049 | 0.006 | 0.037 | 0.0015 | 0.268 | 0.168 | 0.031 | 0.009 | 0.0009 | 6.55 | 0.005 | 0.0067 |
| 18 | 0.0046 | 0.18 | 0.39 | 0.052 | 0.003 | 0.058 | 0.0022 | 0.295 | 0.300 | 0.020 | 0.006 | 0.0010 | 7.40 | −0.010* | 0.0045 |
| 19 | 0.0081* | 0.42* | 0.13 | 0.071 | 0.006 | 0.038 | 0.0021 | 0.249 | Tr.* | 0.021 | 0.072* | 0.0012 | 8.45 | −0.028* | 0.0830 |
| 20 | 0.0040 | 0.02 | 0.21 | 0.040 | 0.006 | 0.028 | 0.0030 | 0.303 | 0.185 | 0.038 | 0.008 | 0.0009 | 7.00 | 0.003 | 0.0055 |
| 21 | 0.0033 | 0.05 | 0.16 | 0.039 | 0.003 | 0.025 | 0.0019 | 0.251 | 0.123 | 0.040 | 0.003 | 0.0013 | 11.05 | 0.016 | −0.0009* |

Note)
Figures with (*) mark indicate that those are out of the range of the present invention
$X = Ti - (48/14) \times N - (48/32) \times S - 4 \times C$
$Y = Nb \times (10 \times P + 2 \times Cu + Ni) - 0.004$

TABLE 23

| Steel | Mechanical property | | | | | | | | Corrosion resistance 100 cycles |
|---|---|---|---|---|---|---|---|---|---|
| | YP ($Kgf/mm^2$) | TS ($Kgf/mm^2$) | Er (%) | rm | Δr | Fracture appearance transition temperature (°C.) | Rz (μm) | Z | |
| 1 | 18 | 34 | 45 | 2.10 | 0.21 | −80 | 6.5 | 0.016 | Δ |
| 2 | 20 | 37 | 43 | 2.10 | 0.29 | −70 | 4.2 | 0.009 | Δ |
| 3 | 21 | 35 | 42 | 2.05 | 0.17 | −70 | 5.8 | 0.016 | ○ |
| 4 | 22 | 35 | 42 | 2.12 | 0.20 | −80 | 6.2 | 0.016 | ○ |
| 5 | 20 | 36 | 42 | 2.15 | 0.20 | −80 | 3.8 | 0.012 | ○ |
| 6 | 21 | 36 | 43 | 2.20 | 0.32 | −80 | 4.5 | 0.019 | ○ |
| 7 | 20 | 36 | 44 | 2.20 | 0.18 | −70 | 5.0 | 0.014 | ○ |
| 8 | 20 | 36 | 43 | 2.12 | 0.24 | −80 | 4.0 | 0.005 | ○ |
| 9 | 24 | 38 | 38 | 1.60 | 0.40 | −60 | 6.0 | 0.008 | ○ |
| 10 | 23 | 40 | 37 | 1.39 | 0.50 | 0 | 5.2 | 0.026* | Δ |
| 11 | 16 | 32 | 45 | 1.95 | 0.40 | −70 | 4.8 | 0.040* | Δ |
| 12 | 16 | 34 | 42 | 1.90 | 0.23 | −80 | 5.5 | 0.039* | Δ |
| 13 | 22 | 39 | 36 | 1.78 | 0.36 | −80 | 7.1 | 0.011 | ○ |
| 14 | 25 | 38 | 36 | 1.68 | 0.36 | −70 | 2.8 | 0.006 | ○ |
| 15 | 20 | 36 | 40 | 1.81 | 0.68 | −10 | 4.5 | 0.030* | Δ |
| 16 | 21 | 37 | 41 | 1.98 | 0.44 | −10 | 4.0 | 0.013 | ○ |
| 17 | 21 | 37 | 40 | 2.11 | 0.25 | −70 | 5.6 | 0.028* | ○ |
| 18 | 23 | 38 | 36 | 1.70 | 0.50 | −80 | 6.7 | 0.014 | ○ |
| 19 | 25 | 48 | 35 | 1.78 | 0.25 | −70 | 7.1 | 0.035* | Δ |
| 20 | 20 | 34 | 41 | 2.10 | 0.25 | −70 | 10.2* | 0.051* | Δ |
| 21 | 22 | 35 | 42 | 2.07 | 0.35 | −70 | 4.5 | 0.013 | Δ |

Note)
The (*) marks on Rz and Z indicate that the figure are out of the range of the present invention.

TABLE 24

| | P wt. % | Other component wt. % | Coating weight $g/m^2$ | |
|---|---|---|---|---|
| A | 8 | — | 1.0 | Examples of the present invention |
| B | 12 | — | 0.1 | |
| C | 12 | — | 1.0 | |

TABLE 24-continued

| | P wt. % | Other component wt. % | Coating weight $g/m^2$ |
|---|---|---|---|
| D | 12 | — | 8.0 |
| E | 12 | 12%Cu | 1.0 |
| F | 12 | 8%Mo | 1.0 |

TABLE 24-continued

| | P wt. % | Other component wt. % | Coating weight g/m$^2$ | |
|---|---|---|---|---|
| G | 12 | 12%W | 1.0 | |
| H | 12 | 5%Cr | 1.0 | |
| I | 12 | 1%Mo—5%Cu | 1.0 | |
| J | 12 | 8%Cu—5%Cr | 1.0 | |
| K | 12 | 8%Cu—5%W | 1.0 | |
| L | 18 | — | 1.0 | |
| M | 6 | — | 1.0 | Comparative examples |
| N | 12 | — | 0.05 | |
| O | 12 | — | 10.0 | |
| P | 12 | 16%W | 1.0 | |
| Q | 12 | 16%Mo | 1.0 | |
| R | 12 | 8%Cu—16%W | 1.0 | |
| S | 12 | 8%Cu—16%Mo | 1.0 | |
| T | — | — | — | |

TABLE 25

| No. | Steel sheet | Ni—P coating | Corrosion resistance 100 cycles | Adhesiveness of coating layer | Remarks |
|---|---|---|---|---|---|
| 1 | 3 | A | ○ | ○ | |
| 2 | 3 | B | ○ | ○ | |
| 3 | 3 | C | ○ | ○ | |
| 4 | 3 | D | ○ | ○ | |
| 5 | 3 | E | ○ | ○ | |
| 6 | 3 | F | ○ | ○ | |
| 7 | 3 | G | ○ | ○ | |
| 8 | 3 | H | ○ | ○ | |
| 9 | 3 | I | ○ | ○ | |
| 10 | 3 | J | ○ | ○ | |
| 11 | 3 | K | ○ | ○ | |
| 12 | 3 | L | ○ | ○ | |
| 13 | 3 | M | X | ○ | Comparative example |
| 14 | 3 | N | X | ○ | Comparative example |
| 15 | 3 | O | ○ | X | Comparative example |
| 16 | 3 | P | ○ | X | Comparative example |
| 17 | 3 | Q | ○ | X | Comparative example |
| 18 | 3 | R | ○ | X | Comparative example |
| 19 | 3 | S | ○ | X | Comparative example |
| 20 | 3 | T | X | — | Comparative example |
| 21 | 5 | A | ○ | ○ | |
| 22 | 5 | B | ○ | ○ | |
| 23 | 5 | C | ○ | ○ | |
| 24 | 5 | D | ○ | ○ | |
| 25 | 5 | E | ○ | ○ | |
| 26 | 5 | F | ○ | ○ | |
| 27 | 5 | G | ○ | ○ | |
| 28 | 5 | H | ○ | ○ | |
| 29 | 5 | I | ○ | ○ | |
| 30 | 5 | J | ○ | ○ | |
| 31 | 5 | K | ○ | ○ | |
| 32 | 5 | L | ○ | ○ | |
| 33 | 5 | M | X | ○ | Comparative example |
| 34 | 5 | N | X | ○ | Comparative example |
| 35 | 5 | O | ○ | X | Comparative example |
| 36 | 5 | P | ○ | X | Comparative example |
| 37 | 5 | Q | ○ | X | Comparative example |
| 38 | 5 | R | ○ | X | Comparative example |

TABLE 25-continued

| No. | Steel sheet | Ni—P coating | Corrosion resistance 100 cycles | Adhesiveness of coating layer | Remarks |
|---|---|---|---|---|---|
| 39 | 5 | S | ○ | X | Comparative example |
| 40 | 5 | T | X | — | Comparative example |

EMBODIMENT-4

The surface treated steel sheets having the diffused alloy layer obtained in EMBODIMENT-3 gives an anti-pitting effect. However, it is not sufficient to suppress the rust generation resulted from a damage on external coating caused by jumping stone or the like.

To give a post-painting corrosion resistance to the steel sheets, this invention applies a coating on the diffused alloy layer, which coating is Zn coating or a coating using Zn as the matrix and containing at least one metal selected from the group consisting of Ni, Fe, Co, Cr, Mn, Ti, Mo, Si, Al, or at least one oxide in a form of alloy or dispersed particles. That type of coating contributes to the corrosion resistance during the progress of coating corrosion owing to the sacrifice corrosion protection of the coating. It also gives an effect of stabilizing and densifying the base iron during the corrosion of base iron owing to the synergistic effect of the components in the Zn matrix and the components such as Ni and P in the diffused alloy layer.

A preferable zinc coating weight of zinc electroplating or zinc coating is from 5 to 60 g/m$^2$. Too small coating weight can not give a sufficient corrosion resistance, and excessive coating weight degrades the workability of coating layer and increases the production cost. The most preferable coating weight is from 5 to 45 g/m$^2$.

The following is a preferred condition for producing the cold-rolled steel sheets which are described above. A steel having the composition shown before is formed into a slab by, for example, continuous casting method or ingot making method, and the slab is treated by the following procedure.

The heating temperature of the slab is arbitrary if only it is a level for making the precipitate within the slab to a solid solution again. For a steel having the composition described above, the heating temperature at 1100° C. or more is preferred.

As for the finish temperature, the temperature at $Ar_3$ point or below results in a degraded deep drawing performance, so the rolling at or above $Ar_3$ point is preferred. The coiling temperature at 550° C. or more induces the growth of coarse ferrite grains and gives good workability, but an excessively high coiling temperature accelerates the segregation of P to grain boundaries and degrades the secondary working brittleness. An increased P content likely induces the grain boundary segregation, and an increased B content suppresses the grain boundary segregation. Accordingly, the coiling temperature is preferably at or below that specified by the equation:

$$\{650+200\times(200\times B-P)\}°C.$$

The Ni-P coating is applied before the annealing, and it may be applied immediately after the pickling at the exit of the pickling line before the cold rolling or may be applied after the cold rolling succeeding to the pickling. Particularly when the coating is given before the cold rolling, there appears an advantage that no pickling is required as the cleaning and activating the sheet before coating.

Although no specific condition for cold rolling is defined, it is preferable to select the reduction ratio of 50% or more to maintain excellent deep drawing performance.

Several methods for forming Ni-P alloy coating layer have been introduced. Among them, the electroplating or electroless coating (chemical coating) are preferred from the viewpoint of simplicity of operation and quality of obtained film.

The steel sheet coated with Ni-P alloy coating layer undergoes a heat treatment in a non-oxidizing atmosphere to form a diffused alloy layer consisting mainly of Fe-Ni-P at the interface between the base steel plate and the coating layer. The heat treatment for diffusion may be carried out in an ordinary annealing facility after cold rolling. In particular, a continuous annealing which has a high productivity is preferred. The continuous annealing may be carried out by a common continuous annealing facility for cold-rolled steel sheets and an annealing facility used as a pre-treatment unit of hot dip coating line. A preferred maximum temperature of the heat treatment is 750° C. or more, most preferably at 820° C. or above because higher temperature gives better deep drawing performance. The temperature below 750° C. can not form a sufficient diffused layer between the Ni-P alloy coating layer and the steel sheet surface, and the insufficient dense-rust formation during the corrosion process gives only a small effect for improving corrosion resistance. On the otherhand, heat treatment at above 900° C. tends to induce a pickup of coating metal onto the rolls in the heating furnace, which likely generates surface defects on steel sheets. The annealing at above 900° C. induces the growth of coarse ferrite grains, which likely generates rough surface after the press-forming. A preferred range of holding time at the maximum temperature of the steel sheet is 1 to 120 see, though the holding time depends on the temperature. Too short holding time does not give the improving effect of corrosion resistance because sufficient diffusion layer can not be formed. An excessive holding time over 120 sec. induces an excessive diffusion alloying, which results in a brittle interface layer to degrade the adhesiveness and workability of the coating layer because the sufficient diffused layer can not be formed. During the heat treatment, an excessive aging may be applied for several minutes at an approximate temperature range of from 300° to 400° C. A preferable depth of appropriate diffusion layer formed by the heat treatment is in a range of from 0.1 to 20 μm. Regarding the re-crystallization annealing, a production method using a continuous annealing is preferred. The reason is that the box annealing makes P segregate to the grain boundaries during the gradual cooling after annealing, and degrades the workability and the corrosion resistance.

On applying heat treatment, the roll pickup within the furnace is avoidable when a direct fired furnace is used and the heating speed at 50° C./sec. or more.

When a Ni-P alloy coating layer undergoes heat treatment, two types of coating structure appear. The one is that a part of the Ni-P alloy coating layer forms a diffused alloy layer and forms the steel sheet/diffused alloy layer/Ni-P alloy coating layer structure. The other is that all the Ni-P alloy coating layer forms a diffused alloy layer to give the steel sheet/diffused alloy layer structure. This invention includes both cases.

After the heat treatment for diffusion, a temper rolling is conducted under an appropriate condition, at need.

The Rz control is carried out by polishing the rolling rolls and post-annealing temper rolls with grinder, Cr or Ni coating after the polishing with grinder, shot blast, electrical discharge machining, laser processing, etching, EBT processing, etc. The key factor is to control the Rz of roll at a lower level than usual.

The steel sheet treated by the above-described procedure is further subjected to zinc electroplating or zinc hot dip coating in a zinc coating line.

Zinc electroplating bath may be sulfuric acid bath or chloride bath which are widely used. For further improvement of corrosion resistance, a chromate treatment may be applied on the zinc coating layer, and further an organic composite resin coating may be applied. As for the chromate treatment, either one of reaction type, electrolysis type, and application type is applicable. The chromate film may contain organic compound such as acrylic resin, oxide colloid such as silica colloid and alumina colloid, acid such as molybdenum acid, salt, or other corrosion-resistance-improving agent. The organic resin film which coats the chromate film may use epoxy resin as the base resin. The organic resin film preferably further contains an inhibitor additive such as silica and chromate at an approximate range of from 10 to 60 wt. %.

The steel sheets having the corrosion resistance and the workability above described are quite suitable for automobile materials.

EXAMPLE

The following is the description of an example of this invention. Nevertheless, this invention naturally not restricted by the example.

(Method and criteria of evaluation)

(1) Corrosion resistance

The test piece is exposed to a corrosive condition of repeated drying and humidifying combined with salt solution spraying at a rate of 1 cycle per day. The resulted corrosion depth is measured to evaluate in accordance with the criterion given below.

○: the maximum corrosion depth is not deeper than 0.1 mm

Δ: the maximum corrosion depth is deeper than 0.1 mm and not deeper than 0.2 mm

X: the maximum corrosion depth is deeper than 0.2 mm (2) Paintability

The steel sheet is subjected to phosphate treatment and cation electroplating. The coating layer is cut to the base steel surface using a knife, and the steel sheet is exposed to the environment of (1) for 100 days. The blister generated a the cut area is observed and evaluated in accordance with the criterion given below.

○: the maximum blister width per side is not more than 1 mm 0.05 mm and not deeper than 0.1 mm Δ: the maximum blister width per side is larger than 1 mm and not more than 3 mm X: the maximum blister width per side is larger than 3 mm (3) Workability The test piece undergoes the 180 degree bending test to observe the damage of coating layer at the tip of bent. The evaluation is given in accordance with the following criterion.

○: no damage or only fine cracks are observed

Δ: large crack is observed or partial separation of coating layer is observed

X: coating separation is observed in a wide range

EXAMPLE-9

Examples of this invention are described below.

The steels of this invention and the comparative steels each having the composition listed in Table 26 were melted and formed into slabs. Each of the slabs was heated to 1250° C., hot-rolled at 900° C. to form a sheet of 2.8 mm thick. Then the sheet was coiled at 620° C. to obtain a hot-rolled sheet. After pickling, the sheet was cold-rolled to a thickness of 0.7 mm at a reduction rate of 75%, and the sheet was coated with Ni-P layer containing 11% P to a coating weight of 1 g/m$^2$. The sheet underwent heat treatment at 850° C. and temper-rolling of 0.5% to become a cold-rolled sheet. The reference symbols X and Y in Table 26 designate:

$$X=Ti-(48/14)\times N-(48/32)\times S-4\times C,$$

$$Y=Nb\times(10\times P+2\times Cu+Ni)-0.004,$$

and the region $X\geqq 0$ includes Ti at an excess amount to C, N, and S.

Table 27 shows the determined mechanical characteristics of obtained steel sheets. The tensile test was carried out using JIS No.5 test piece. The values of rm was calculated by the equation:

$$r_m=(r_0+2\times r_{45}+r_{90})/4,$$

$$\Delta r=(r_0-2\times r_{45}+r_{90})/2.$$

The fracture appearance transition temperature is a temperature which does not induce brittle fracture when a cup forming is given at a drawing ratio of 2.1 followed by press-fitting a conical punch from the edge of the cup. The anti-longitudinal crack performance was evaluated by the fracture appearance transition temperature.

As for Rz, the surface roughness of the steel sheet was measured for three times, and the average of them was adopted as Rz. The reference character Z in Table 27 is defined by the equation of: $Z=Rz\times S/(10\times P+2\times Cu+P)$.

Table 27 clearly shows that the steels No. 1 and No. 2 contain less P and give inferior corrosion resistance. The steels No. 9 and No. 10 contain excess amount of P so that they show poor formability. The steels No. 11 and No. 12 contain too small amount of Cu so that they are inferior in corrosion resistance. The steels No. 13 and No. 14 contain excess amount of Cu so that the formability is poor. The steel No. 15 contains no Nb so that it gives a large Δr and likely induces pitting. The steels No. 15 and No. 16 contain no B so that they generate the secondary working brittleness. The steel No. 19 contains excess amount of C, Si, and Nb, so it is inferior in formability, and it contains no Ni so that the corrosion resistance is not satisfactory. The steels No. 10, 5, 18, and 19, which have X<0 property does not perfectly fix the C solid solution or N solid solution so that they are inferior in the workability such as deep drawing performance. The steels No. 2, 15, and 21 which have Y<0 are property inferior in the anti-pitting performance. The steels No. 10, 11, 12, 15, 17, 19, and 20 which have Rz>0.025 property are also inferior in corrosion resistance.

EXAMPLE-10

The steels of this invention (steel No. 3 and 5) each having the composition listed in Table 26 were melted and formed into slabs. Each of the slabs was heated to 1250° C., hot-rolled at 900° C. to form a sheet of 2.8 mm thick. Then the sheet was coiled at 620° C. to obtain a hot-rolled sheet. After pickling, the sheet was cold-rolled to a thickness of 0.7 mm at a reduction rate of 75%, and the sheet was coated with Ni-P layer in a range listed in Table 28, followed by the continuos annealing at 850° C. and by the refining rolling of 0.5%, then by Zn coating shown in Table 29 to prepare the test piece. The test result is summarized in Table 30 through Table 34. The steels of this invention give excellent corrosion resistance, paintability, and workability.

EXAMPLE-11

The steel of this invention (steel No. 3) having the composition listed in Table 26 was melted and formed into a slab. The slab was heated to 1250° C., hot-rolled at 900° C. to form a sheet of 2.8 mm thick. Then the sheet was coiled at 620° C. to obtain a hot-rolled sheet. After pickling, the sheet was coated by Ni-P layer (No. A, B, C, M, N, O, and T, separately) listed in Table 28, then each of the coated sheets was cold-rolled to a thickness of 0.7 mm at a reduction rate of 75%. The sheet underwent the continuos annealing at 850° C. and by the temper rolling of 0.5% and by Zinc coating (No. I, IV) shown in Table 29 to prepare the test pieces. The test result is summarized in Table 35. The steels of this invention give excellent corrosion resistance, paintability, and workability.

TABLE 26

| | Chemical composition (wt. %) | | | | | | | | | | | | B-P/200 | Remarks | |
|---|---|---|---|---|---|---|---|---|---|---|---|---|---|---|---|
| Steel | C | Si | Mn | P | S | sol. Al | N | Cu | Ni | Ti | Nb | B | ($10^{-4}$) | X | Y |
| 1 | 0.0030 | 0.04 | 0.20 | 0.011* | 0.003 | 0.032 | 0.0019 | 0.451 | 0.230 | 0.041 | 0.011 | 0.0008 | 7.45 | 0.018 | 0.0097 |
| 2 | 0.0027 | 0.06 | 0.06 | 0.024* | 0.002 | 0.061 | 0.0015 | 0.246 | 0.211 | 0.023 | 0.006 | 0.0010 | 8.80 | 0.004 | 0.0017 |
| 3 | 0.0019 | 0.15 | 0.19 | 0.033 | 0.004 | 0.019 | 0.0031 | 0.410 | 0.310 | 0.025 | 0.013 | 0.0005 | 3.35 | 0.008 | 0.0150 |
| 4 | 0.0056 | 0.09 | 0.20 | 0.038 | 0.004 | 0.037 | 0.0028 | 0.453 | 0.308 | 0.047 | 0.011 | 0.0007 | 5.10 | 0.009 | 0.0135 |
| 5 | 0.0038 | 0.11 | 0.12 | 0.045 | 0.003 | 0.029 | 0.0030 | 0.189 | 0.159 | 0.034 | 0.009 | 0.0011 | 8.75 | 0.004 | 0.0049 |
| 6 | 0.0023 | 0.04 | 0.14 | 0.064 | 0.006 | 0.046 | 0.0025 | 0.280 | 0.189 | 0.380 | 0.011 | 0.0010 | 6.80 | 0.011 | 0.0110 |
| 7 | 0.0039 | 0.02 | 0.26 | 0.070 | 0.004 | 0.053 | 0.0014 | 0.248 | 0.204 | 0.050 | 0.008 | 0.0009 | 5.50 | 0.024 | 0.0072 |
| 8 | 0.0041 | 0.22 | 0.28 | 0.077 | 0.001 | 0.073 | 0.0017 | 0.199 | 0.289 | 0.048 | 0.010 | 0.0007 | 3.15 | 0.024 | 0.0106 |
| 9 | 0.0040 | 0.10 | 0.30 | 0.086* | 0.002 | 0.040 | 0.0022 | 0.230 | 0.198 | 0.031 | 0.013 | 0.0017 | 12.70 | 0.004 | 0.0157 |
| 10 | 0.0098* | 0.11 | 0.32 | 0.108* | 0.009 | 0.020 | 0.0031 | 0.201 | 0.286 | 0.053 | 0.006 | 0.0001* | −4.40* | −0.010* | 0.0066 |
| 11 | 0.0045 | 0.30 | 0.20 | 0.052 | 0.007 | 0.045 | 0.0028 | 0.064* | 0.197 | 0.047 | 0.012 | 0.0012 | 9.40 | 0.009 | 0.0061 |
| 12 | 0.0027 | 0.15 | 0.18 | 0.045 | 0.006 | 0.022 | 0.0032 | 0.087* | 0.233 | 0.040 | 0.010 | 0.0010 | 7.75 | 0.009 | 0.0046 |
| 13 | 0.0045 | 0.17 | 0.22 | 0.051 | 0.003 | 0.077 | 0.0020 | 0.586* | 0.310 | 0.034 | 0.008 | 0.0008 | 5.45 | 0.005 | 0.0119 |
| 14 | 0.0038 | 0.21 | 0.14 | 0.068 | 0.005 | 0.082 | 0.0019 | 0.609 | 0.459 | 0.036 | 0.012 | 0.0010 | 6.60 | 0.007 | 0.0243 |
| 15 | 0.0059 | 0.33 | 0.31 | 0.066 | 0.009 | 0.015 | 0.0015 | 0.298 | 0.103 | 0.020 | Tr.* | Tr.* | −3.30* | −0.022* | −0.0040* |
| 16 | 0.0052 | 0.01 | 0.09 | 0.052 | 0.004 | 0.035 | 0.0028 | 0.310 | 0.128 | 0.046 | 0.005 | Tr.* | −2.60* | 0.010 | 0.0023 |
| 17 | 0.0030 | 0.22 | 0.23 | 0.049 | 0.006 | 0.037 | 0.0015 | 0.268 | 0.168 | 0.031 | 0.009 | 0.0009 | 6.55 | 0.005 | 0.0067 |

TABLE 26-continued

| Steel | Chemical composition (wt. %) C | Si | Mn | P | S | sol. Al | N | Cu | Ni | Ti | Nb | B | B-P/200 ($10^{-4}$) | Remarks X | Y |
|---|---|---|---|---|---|---|---|---|---|---|---|---|---|---|---|
| 18 | 0.0046 | 0.18 | 0.39 | 0.052 | 0.003 | 0.058 | 0.0022 | 0.295 | 0.300 | 0.020 | 0.006 | 0.0010 | 7.40 | −0.010* | 0.0045 |
| 19 | 0.0081* | 0.42* | 0.13 | 0.071 | 0.006 | 0.038 | 0.0021 | 0.249 | Tr.* | 0.021 | 0.072* | 0.0012 | 8.45 | −0.028* | 0.0830 |
| 20 | 0.0040 | 0.02 | 0.21 | 0.040 | 0.006 | 0.028 | 0.0030 | 0.303 | 0.185 | 0.038 | 0.008 | 0.0009 | 7.00 | 0.003 | 0.0055 |
| 21 | 0.0033 | 0.05 | 0.16 | 0.039 | 0.003 | 0.025 | 0.0019 | 0.251 | 0.123 | 0.040 | 0.003 | 0.0013 | 11.05 | 0.016 | −0.0009* |

Note)
Figures with (*) mark indicate that those are out of the range of the present invention
$X = Ti - (48/14) \times N - (48/32) \times S - 4 \times C$
$Y = Nb \times (10 \times P + 2 \times Cu + Ni) - 0.004$

TABLE 27

| Steel | Mechnical Property YP (Kg/mm²) | TS (Kg/mm²) | El (%) | rm | Δr | Fracture appearance transition Temp. (°C.) | Rz (μm) | Z | Corrosion resistance 100 cycle |
|---|---|---|---|---|---|---|---|---|---|
| 1 | 18 | 34 | 45 | 2.10 | 0.21 | −80 | 6.5 | 0.016 | Δ |
| 2 | 20 | 37 | 43 | 2.10 | 0.29 | −70 | 4.2 | 0.009 | Δ |
| 3 | 21 | 35 | 42 | 2.05 | 0.17 | −70 | 5.8 | 0.016 | ○ |
| 4 | 22 | 35 | 42 | 2.12 | 0.20 | −80 | 6.2 | 0.016 | ○ |
| 5 | 20 | 36 | 42 | 2.15 | 0.20 | −80 | 3.8 | 0.012 | ○ |
| 6 | 21 | 36 | 43 | 2.20 | 0.32 | −80 | 4.5 | 0.019 | ○ |
| 7 | 20 | 36 | 44 | 2.20 | 0.18 | −70 | 5.0 | 0.014 | ○ |
| 8 | 20 | 36 | 43 | 2.12 | 0.24 | −80 | 4.0 | 0.005 | ○ |
| 9 | 24 | 38 | 38 | 1.60 | 0.40 | −60 | 6.0 | 0.008 | ○ |
| 10 | 23 | 40 | 37 | 1.39 | 0.50 | 0 | 5.2 | 0.026* | Δ |
| 11 | 16 | 32 | 45 | 1.95 | 0.40 | −70 | 4.8 | 0.040* | Δ |
| 12 | 16 | 34 | 42 | 1.90 | 0.23 | −80 | 5.5 | 0.039* | Δ |
| 13 | 22 | 39 | 36 | 1.78 | 0.36 | −80 | 7.1 | 0.011 | ○ |
| 14 | 25 | 38 | 36 | 1.68 | 0.36 | −70 | 2.8 | 0.006 | ○ |
| 15 | 20 | 36 | 40 | 1.81 | 0.68 | −10 | 4.5 | 0.030* | Δ |
| 16 | 21 | 37 | 41 | 1.98 | 0.44 | −10 | 4.0 | 0.013 | ○ |
| 17 | 21 | 37 | 40 | 2.11 | 0.25 | −70 | 5.6 | 0.028* | ○ |
| 18 | 23 | 38 | 36 | 1.70 | 0.50 | −80 | 6.7 | 0.014 | ○ |
| 19 | 25 | 48 | 35 | 1.78 | 0.25 | −70 | 7.1 | 0.035* | Δ |
| 20 | 20 | 34 | 41 | 2.10 | 0.25 | −70 | 10.2* | 0.051* | Δ |
| 21 | 22 | 35 | 42 | 2.07 | 0.35 | −70 | 4.5 | 0.013 | Δ |

Notes: Figures with (*) mark of Rz and Z indicate that those are out of the range of the present invention.

TABLE 28

| | P wt. % | Other constituent wt. % | Coating g/m² | |
|---|---|---|---|---|
| A | 8 | — | 1.0 | Examples of the present invention |
| B | 12 | — | 0.1 | |
| C | 12 | — | 1.0 | |
| D | 12 | — | 8.0 | |
| E | 12 | 12%Cu | 1,0 | |
| F | 12 | 8%Mo | 1,0 | |
| G | 12 | 12%W | 1.0 | |
| H | 12 | 5%Cr | 1.0 | |
| I | 12 | 1%Mo—5%Cu | 1.0 | |
| J | 12 | 8%Cu—5%Cr | 1.0 | |
| K | 12 | 8%Cu—5%W | 1.0 | |
| L | 18 | — | 1.0 | |
| M | 6 | — | 1.0 | Comparative examples |
| N | 12 | — | 0.05 | |
| O | 12 | — | 10.0 | |
| P | 12 | 16%W | 1.0 | |
| Q | 12 | 16%Mo | 1.0 | |
| R | 12 | 8%Cu—16%W | 1.0 | |
| S | 12 | 8%Cu—16%Mo | 1.0 | |
| T | — | — | — | |

TABLE 29

| No. | Coating type | Other component wt. % | Coating weight g/m² |
|---|---|---|---|
| I | Electrolytic Zn coating | 100%Zn | 20.0 |
| II | Electrolytic Zn—Ni coating | 12%Ni | 5.0 |
| III | Electrolytic Zn—Fe coating | 15%Fe | 10.0 |
| IV | Electrolytic Zn—Cr coating | 12%Cr | 10.0 |
| V | Electrolytic Zn—Mn coating | 60%Mn | 10.0 |
| VI | Electrolytic Zn—$SiO_2$ coating | 5%$SiO_2$ | 10.0 |
| VII | Electrolytic Zn—Co—Cr—$Al_2O_3$ coating | 1%Co, 1%Cr, 0.2%$Al_2O_3$ | 10.0 |
| VIII | Electrolytic Zn—$Cr(OH)_3$ coating | 3%$Cr(OH)_3$ | 10.0 |
| IX | Alloy hot dip Zn coating | 11%Fe, 0.13%Al | 45.0 |
| X | Hot dip Zn coating | 0.15%Al | 30.0 |
| XI | Alloy hot dip Zn coating | 11%Fe, 0.13%Al | 60.0 |
| XII | Electrolytic Zn coating | 100%Zn | 70.0 |

Notes)
XII: Comparative example.

TABLE 30

| No. | Steel sheet | Ni—P coating | Zn coating | Corrosion resistance 100 cycles | Paintability 100 cycles | Workability | Remarks |
|---|---|---|---|---|---|---|---|
| 1 | 3 | A | I | ○ | ○ | ○ | |
| 2 | 3 | A | II | ○ | ○ | ○ | |
| 3 | 3 | A | III | ○ | ○ | ○ | |
| 4 | 3 | A | IV | ○ | ○ | ○ | |
| 5 | 3 | A | V | ○ | ○ | ○ | |
| 6 | 3 | A | VI | ○ | ○ | ○ | |
| 7 | 3 | A | VII | ○ | ○ | ○ | |
| 8 | 3 | A | VIII | ○ | ○ | ○ | |
| 9 | 3 | A | IX | ○ | ○ | ○ | |
| 10 | 3 | A | X | ○ | ○ | ○ | |
| 11 | 3 | A | XI | ○ | ○ | ○ | |
| 12 | 3 | A | XII | ○ | ○ | X | Comparative example |
| 13 | 3 | B | I | ○ | ○ | ○ | |
| 14 | 3 | B | II | ○ | ○ | ○ | |
| 15 | 3 | B | III | ○ | ○ | ○ | |
| 16 | 3 | B | IV | ○ | ○ | ○ | |
| 17 | 3 | B | V | ○ | ○ | ○ | |
| 18 | 3 | B | VI | ○ | ○ | ○ | |
| 19 | 3 | B | VII | ○ | ○ | ○ | |
| 20 | 3 | B | VIII | ○ | ○ | ○ | |
| 21 | 3 | B | IX | ○ | ○ | ○ | |
| 22 | 3 | B | X | ○ | ○ | ○ | |
| 23 | 3 | B | XI | ○ | ○ | ○ | |
| 24 | 3 | B | XII | ○ | ○ | X | Comparative example |
| 25 | 3 | C | I | ○ | ○ | ○ | |
| 26 | 3 | C | II | ○ | ○ | ○ | |
| 27 | 3 | C | III | ○ | ○ | ○ | |
| 28 | 3 | C | IV | ○ | ○ | ○ | |
| 29 | 3 | C | V | ○ | ○ | ○ | |
| 30 | 3 | C | VI | ○ | ○ | ○ | |
| 31 | 3 | C | VII | ○ | ○ | ○ | |
| 32 | 3 | C | VIII | ○ | ○ | ○ | |
| 33 | 3 | C | IX | ○ | ○ | ○ | |
| 34 | 3 | C | X | ○ | ○ | ○ | |
| 35 | 3 | C | XI | ○ | ○ | ○ | |
| 36 | 3 | C | XII | ○ | ○ | X | Comparative example |
| 37 | 3 | D | I | ○ | ○ | ○ | |
| 38 | 3 | D | II | ○ | ○ | ○ | |
| 39 | 3 | D | III | ○ | ○ | ○ | |
| 40 | 3 | D | IV | ○ | ○ | ○ | |
| 41 | 3 | D | V | ○ | ○ | ○ | |
| 42 | 3 | D | VI | ○ | ○ | ○ | |
| 43 | 3 | D | VII | ○ | ○ | ○ | |
| 44 | 3 | D | VIII | ○ | ○ | ○ | |
| 45 | 3 | D | IX | ○ | ○ | ○ | |
| 46 | 3 | D | X | ○ | ○ | ○ | |
| 47 | 3 | D | XI | ○ | ○ | ○ | |
| 48 | 3 | D | XII | ○ | ○ | X | Comparative example |
| 49 | 3 | E | I | ○ | ○ | ○ | |
| 50 | 3 | E | II | ○ | ○ | ○ | |
| 51 | 3 | E | III | ○ | ○ | ○ | |
| 52 | 3 | E | IV | ○ | ○ | ○ | |
| 53 | 3 | E | V | ○ | ○ | ○ | |
| 54 | 3 | E | VI | ○ | ○ | ○ | |
| 55 | 3 | E | VII | ○ | ○ | ○ | |
| 56 | 3 | E | VIII | ○ | ○ | ○ | |
| 57 | 3 | E | IX | ○ | ○ | ○ | |
| 58 | 3 | E | X | ○ | ○ | ○ | |
| 59 | 3 | E | XI | ○ | ○ | ○ | |
| 60 | 3 | E | XII | ○ | ○ | X | Comparative example |
| 61 | 3 | F | I | ○ | ○ | ○ | |
| 62 | 3 | F | II | ○ | ○ | ○ | |

TABLE 30-continued

| No. | Steel sheet | Ni—P coating | Zn coating | Corrosion resistance 100 cycles | Paintability 100 cycles | Workability | Remarks |
|---|---|---|---|---|---|---|---|
| 63 | 3 | F | III | ○ | ○ | ○ | |
| 64 | 3 | F | IV | ○ | ○ | ○ | |
| 65 | 3 | F | V | ○ | ○ | ○ | |
| 66 | 3 | F | VI | ○ | ○ | ○ | |
| 67 | 3 | F | VII | ○ | ○ | ○ | |
| 68 | 3 | F | VIII | ○ | ○ | ○ | |
| 69 | 3 | F | IX | ○ | ○ | ○ | |
| 70 | 3 | F | X | ○ | ○ | ○ | |
| 71 | 3 | F | XI | ○ | ○ | ○ | |
| 72 | 3 | F | XII | ○ | ○ | X | Comparative example |
| 73 | 3 | G | I | ○ | ○ | ○ | |
| 74 | 3 | G | II | ○ | ○ | ○ | |
| 75 | 3 | G | III | ○ | ○ | ○ | |
| 76 | 3 | G | IV | ○ | ○ | ○ | |
| 77 | 3 | G | V | ○ | ○ | ○ | |
| 78 | 3 | G | VI | ○ | ○ | ○ | |
| 79 | 3 | G | VII | ○ | ○ | ○ | |
| 80 | 3 | G | VIII | ○ | ○ | ○ | |
| 81 | 3 | G | IX | ○ | ○ | ○ | |
| 82 | 3 | G | X | ○ | ○ | ○ | |
| 83 | 3 | G | XI | ○ | ○ | ○ | |
| 84 | 3 | G | XII | ○ | ○ | X | Comparative example |
| 85 | 3 | H | I | ○ | ○ | ○ | |
| 86 | 3 | H | II | ○ | ○ | ○ | |
| 87 | 3 | H | III | ○ | ○ | ○ | |
| 88 | 3 | H | IV | ○ | ○ | ○ | |
| 89 | 3 | H | V | ○ | ○ | ○ | |
| 90 | 3 | H | VI | ○ | ○ | ○ | |
| 91 | 3 | H | VII | ○ | ○ | ○ | |
| 92 | 3 | H | VIII | ○ | ○ | ○ | |
| 93 | 3 | H | IX | ○ | ○ | ○ | |
| 94 | 3 | H | X | ○ | ○ | ○ | |
| 95 | 3 | H | XI | ○ | ○ | ○ | |
| 96 | 3 | H | XII | ○ | ○ | X | Comparative example |

TABLE 31

| No. | Steel sheet | Ni—P coating | Zn coating | Corrosion resistance 100 cycles | Paintability 100 cycles | Workability | Remarks |
|---|---|---|---|---|---|---|---|
| 97 | 3 | I | I | ○ | ○ | ○ | |
| 98 | 3 | I | II | ○ | ○ | ○ | |
| 99 | 3 | I | III | ○ | ○ | ○ | |
| 100 | 3 | I | IV | ○ | ○ | ○ | |
| 101 | 3 | I | V | ○ | ○ | ○ | |
| 102 | 3 | I | VI | ○ | ○ | ○ | |
| 103 | 3 | I | VII | ○ | ○ | ○ | |
| 104 | 3 | I | VIII | ○ | ○ | ○ | |
| 105 | 3 | I | IX | ○ | ○ | ○ | |
| 106 | 3 | I | X | ○ | ○ | ○ | |
| 107 | 3 | I | XI | ○ | ○ | ○ | |
| 108 | 3 | I | XII | ○ | ○ | X | Comparative example |
| 109 | 3 | J | I | ○ | ○ | ○ | |
| 110 | 3 | J | II | ○ | ○ | ○ | |
| 111 | 3 | J | III | ○ | ○ | ○ | |
| 112 | 3 | J | IV | ○ | ○ | ○ | |
| 113 | 3 | J | V | ○ | ○ | ○ | |
| 114 | 3 | J | VI | ○ | ○ | ○ | |
| 115 | 3 | J | VII | ○ | ○ | ○ | |

TABLE 31-continued

| No. | Steel sheet | Ni—P coating | Zn coating | Corrosion resistance 100 cycles | Paintability 100 cycles | Workability | Remarks |
|---|---|---|---|---|---|---|---|
| 116 | 3 | J | VIII | ○ | ○ | ○ | |
| 117 | 3 | J | IX | ○ | ○ | ○ | |
| 118 | 3 | J | X | ○ | ○ | ○ | |
| 119 | 3 | J | XI | ○ | ○ | ○ | |
| 120 | 3 | J | XII | ○ | ○ | X | Comparative example |
| 121 | 3 | K | I | ○ | ○ | ○ | |
| 122 | 3 | K | II | ○ | ○ | ○ | |
| 123 | 3 | K | III | ○ | ○ | ○ | |
| 124 | 3 | K | IV | ○ | ○ | ○ | |
| 125 | 3 | K | V | ○ | ○ | ○ | |
| 126 | 3 | K | VI | ○ | ○ | ○ | |
| 127 | 3 | K | VII | ○ | ○ | ○ | |
| 128 | 3 | K | VIII | ○ | ○ | ○ | |
| 129 | 3 | K | IX | ○ | ○ | ○ | |
| 130 | 3 | K | X | ○ | ○ | ○ | |
| 131 | 3 | K | XI | ○ | ○ | ○ | |
| 132 | 3 | K | XII | ○ | ○ | X | Comparative example |
| 133 | 3 | L | I | ○ | ○ | ○ | |
| 134 | 3 | L | II | ○ | ○ | ○ | |
| 135 | 3 | L | III | ○ | ○ | ○ | |
| 136 | 3 | L | IV | ○ | ○ | ○ | |
| 137 | 3 | L | V | ○ | ○ | ○ | |
| 138 | 3 | L | VI | ○ | ○ | ○ | |
| 139 | 3 | L | VII | ○ | ○ | ○ | |
| 140 | 3 | L | VIII | ○ | ○ | ○ | |
| 141 | 3 | L | IX | ○ | ○ | ○ | |
| 142 | 3 | L | X | ○ | ○ | ○ | |
| 143 | 3 | L | XI | ○ | ○ | ○ | |
| 144 | 3 | L | XII | ○ | ○ | X | Comparative example |
| 145 | 3 | M | I | Δ | Δ | ○ | Comparative example |
| 146 | 3 | M | II | Δ | Δ | ○ | Comparative example |
| 147 | 3 | M | III | Δ | Δ | ○ | Comparative example |
| 148 | 3 | M | IV | Δ | Δ | ○ | Comparative example |
| 149 | 3 | M | V | Δ | Δ | ○ | Comparative example |
| 150 | 3 | M | VI | Δ | Δ | ○ | Comparative example |
| 151 | 3 | M | VII | Δ | Δ | ○ | Comparative example |
| 152 | 3 | M | VIII | Δ | Δ | ○ | Comparative example |
| 153 | 3 | M | IX | Δ | Δ | ○ | Comparative example |
| 154 | 3 | M | X | Δ | Δ | ○ | Comparative example |
| 155 | 3 | M | XI | Δ | Δ | ○ | Comparative example |
| 156 | 3 | M | XII | Δ | Δ | X | Comparative example |
| 157 | 3 | N | I | Δ | Δ | ○ | Comparative example |

TABLE 31-continued

| No. | Steel sheet | Ni—P coating | Zn coating | Corrosion resistance 100 cycles | Paintability 100 cycles | Workability | Remarks |
|---|---|---|---|---|---|---|---|
| 158 | 3 | N | II | Δ | Δ | ○ | Comparative example |
| 159 | 3 | N | III | Δ | Δ | ○ | Comparative example |
| 160 | 3 | N | IV | Δ | Δ | ○ | Comparative example |
| 161 | 3 | N | V | Δ | Δ | ○ | Comparative example |
| 162 | 3 | N | VI | Δ | Δ | ○ | Comparative example |
| 163 | 3 | N | VII | Δ | Δ | ○ | Comparative example |
| 164 | 3 | N | VIII | Δ | Δ | ○ | Comparative example |
| 165 | 3 | N | IX | Δ | Δ | ○ | Comparative example |
| 166 | 3 | N | X | Δ | Δ | ○ | Comparative example |
| 167 | 3 | N | XI | Δ | Δ | ○ | Comparative example |
| 168 | 3 | N | XII | Δ | Δ | X | Comparative example |
| 169 | 3 | O | I | ○ | ○ | X | Comparative example |
| 170 | 3 | O | II | ○ | ○ | X | Comparative example |
| 171 | 3 | O | III | ○ | ○ | X | Comparative example |
| 172 | 3 | O | IV | ○ | ○ | X | Comparative example |
| 173 | 3 | O | V | ○ | ○ | X | Comparative example |
| 174 | 3 | O | VI | ○ | ○ | X | Comparative example |
| 175 | 3 | O | VII | ○ | ○ | X | Comparative example |
| 176 | 3 | O | VIII | ○ | ○ | X | Comparative example |
| 177 | 3 | O | IX | ○ | ○ | X | Comparative example |
| 178 | 3 | O | X | ○ | ○ | X | Comparative example |
| 179 | 3 | O | XI | ○ | ○ | X | Comparative example |
| 180 | 3 | O | XII | ○ | ○ | X | Comparative example |
| 181 | 3 | P | I | ○ | ○ | Δ | Comparative example |

TABLE 31-continued

| No. | Steel sheet | Ni—P coating | Zn coating | Corrosion resistance 100 cycles | Paintability 100 cycles | Workability | Remarks |
|---|---|---|---|---|---|---|---|
| 182 | 3 | P | II | ○ | ○ | Δ | Comparative example |
| 183 | 3 | P | III | ○ | ○ | Δ | Comparative example |
| 184 | 3 | P | IV | ○ | ○ | Δ | Comparative example |
| 185 | 3 | P | V | ○ | ○ | Δ | Comparative example |
| 186 | 3 | P | VI | ○ | ○ | Δ | Comparative example |
| 187 | 3 | P | VII | ○ | ○ | Δ | Comparative example |
| 188 | 3 | P | VIII | ○ | ○ | Δ | Comparative example |
| 189 | 3 | P | IX | ○ | ○ | Δ | Comparative example |
| 191 | 3 | P | X | ○ | ○ | Δ | Comparative example |
| 191 | 3 | P | XI | ○ | ○ | Δ | Comparative example |
| 192 | 3 | P | XII | ○ | ○ | X | Comparative example |

TABLE 32

| No. | Steel sheet | Ni—P coating | Zn coating | Corrosion resistance 100 cycles | Paintability 100 cycles | Workability | Remarks |
|---|---|---|---|---|---|---|---|
| 193 | 3 | Q | I | ○ | ○ | Δ | Comparative example |
| 194 | 3 | Q | II | ○ | ○ | Δ | Comparative example |
| 195 | 3 | Q | III | ○ | ○ | Δ | Comparative example |
| 196 | 3 | Q | IV | ○ | ○ | Δ | Comparative example |
| 197 | 3 | Q | V | ○ | ○ | Δ | Comparative example |
| 198 | 3 | Q | VI | ○ | ○ | Δ | Comparative example |
| 199 | 3 | Q | VII | ○ | ○ | Δ | Comparative example |
| 200 | 3 | Q | VIII | ○ | ○ | Δ | Comparative example |
| 201 | 3 | Q | IX | ○ | ○ | Δ | Comparative example |
| 202 | 3 | Q | X | ○ | ○ | Δ | Comparative example |

TABLE 32-continued

| No. | Steel sheet | Ni—P coating | Zn coating | Corrosion resistance 100 cycles | Paintability 100 cycles | Workability | Remarks |
|---|---|---|---|---|---|---|---|
| 203 | 3 | Q | XI | ○ | ○ | Δ | Comparative example |
| 204 | 3 | Q | XII | ○ | ○ | X | Comparative example |
| 205 | 3 | R | I | ○ | ○ | X | Comparative example |
| 206 | 3 | R | II | ○ | ○ | X | Comparative example |
| 207 | 3 | R | III | ○ | ○ | X | Comparative example |
| 208 | 3 | R | IV | ○ | ○ | X | Comparative example |
| 209 | 3 | R | V | ○ | ○ | X | Comparative example |
| 210 | 3 | R | VI | ○ | ○ | X | Comparative example |
| 211 | 3 | R | VII | ○ | ○ | X | Comparative example |
| 212 | 3 | R | VIII | ○ | ○ | X | Comparative example |
| 213 | 3 | R | IX | ○ | ○ | X | Comparative example |
| 214 | 3 | R | X | ○ | ○ | X | Comparative example |
| 215 | 3 | R | XI | ○ | ○ | X | Comparative example |
| 216 | 3 | R | XII | ○ | ○ | X | Comparative example |
| 217 | 3 | S | I | ○ | ○ | X | Comparative example |
| 218 | 3 | S | II | ○ | ○ | X | Comparative example |
| 219 | 3 | S | III | ○ | ○ | X | Comparative example |
| 220 | 3 | S | IV | ○ | ○ | X | Comparative example |
| 221 | 3 | S | V | ○ | ○ | X | Comparative example |
| 222 | 3 | S | VI | ○ | ○ | X | Comparative example |
| 223 | 3 | S | VII | ○ | ○ | X | Comparative example |
| 224 | 3 | S | VIII | ○ | ○ | X | Comparative example |
| 225 | 3 | S | IX | ○ | ○ | X | Comparative example |
| 226 | 3 | S | X | ○ | ○ | X | Comparative example |

TABLE 32-continued

| No. | Steel sheet | Ni—P coating | Zn coating | Corrosion resistance 100 cycles | Paintability 100 cycles | Workability | Remarks |
|---|---|---|---|---|---|---|---|
| 227 | 3 | S | XI | ○ | ○ | X | Comparative example |
| 228 | 3 | S | XII | ○ | ○ | X | Comparative example |
| 229 | 3 | T | I | X | X | ○ | Comparative example |
| 230 | 3 | T | II | X | X | ○ | Comparative example |
| 231 | 3 | T | III | X | X | ○ | Comparative example |
| 232 | 3 | T | IV | X | X | ○ | Comparative example |
| 233 | 3 | T | V | X | X | ○ | Comparative example |
| 234 | 3 | T | VI | X | X | ○ | Comparative example |
| 235 | 3 | T | VII | X | X | ○ | Comparative example |
| 236 | 3 | T | VIII | X | X | ○ | Comparative example |
| 237 | 3 | T | IX | X | X | ○ | Comparative example |
| 238 | 3 | T | X | X | X | ○ | Comparative example |
| 239 | 3 | T | XI | X | X | ○ | Comparative example |
| 240 | 3 | T | XII | X | X | X | Comparative example |
| 241 | 5 | A | I | ○ | ○ | ○ | |
| 242 | 5 | A | II | ○ | ○ | ○ | |
| 243 | 5 | A | III | ○ | ○ | ○ | |
| 244 | 5 | A | IV | ○ | ○ | ○ | |
| 245 | 5 | A | V | ○ | ○ | ○ | |
| 246 | 5 | A | VI | ○ | ○ | ○ | |
| 247 | 5 | A | VII | ○ | ○ | ○ | |
| 248 | 5 | A | VIII | ○ | ○ | ○ | |
| 249 | 5 | A | IX | ○ | ○ | ○ | |
| 250 | 5 | A | X | ○ | ○ | ○ | |
| 251 | 5 | A | XI | ○ | ○ | ○ | |
| 252 | 5 | A | XII | ○ | ○ | X | Comparative example |
| 253 | 5 | B | I | ○ | ○ | ○ | |
| 254 | 5 | B | II | ○ | ○ | ○ | |
| 255 | 5 | B | III | ○ | ○ | ○ | |
| 256 | 5 | B | IV | ○ | ○ | ○ | |
| 257 | 5 | B | V | ○ | ○ | ○ | |
| 258 | 5 | B | VI | ○ | ○ | ○ | |
| 259 | 5 | B | VII | ○ | ○ | ○ | |
| 260 | 5 | B | VIII | ○ | ○ | ○ | |
| 261 | 5 | B | IX | ○ | ○ | ○ | |
| 262 | 5 | B | X | ○ | ○ | ○ | |
| 263 | 5 | B | XI | ○ | ○ | ○ | |
| 264 | 5 | B | XII | ○ | ○ | X | Comparative example |
| 265 | 5 | C | I | ○ | ○ | ○ | |
| 266 | 5 | C | II | ○ | ○ | ○ | |

TABLE 32-continued

| No. | Steel sheet | Ni—P coating | Zn coating | Corrosion resistance 100 cycles | Paintability 100 cycles | Workability | Remarks |
|---|---|---|---|---|---|---|---|
| 267 | 5 | C | III | ○ | ○ | ○ | |
| 268 | 5 | C | IV | ○ | ○ | ○ | |
| 269 | 5 | C | V | ○ | ○ | ○ | |
| 270 | 5 | C | VI | ○ | ○ | ○ | |
| 271 | 5 | C | VII | ○ | ○ | ○ | |
| 272 | 5 | C | VIII | ○ | ○ | ○ | |
| 273 | 5 | C | IX | ○ | ○ | ○ | |
| 274 | 5 | C | X | ○ | ○ | ○ | |
| 275 | 5 | C | XI | ○ | ○ | ○ | |
| 276 | 5 | C | XII | ○ | ○ | X | Comparative example |
| 277 | 5 | D | I | ○ | ○ | ○ | |
| 278 | 5 | D | II | ○ | ○ | ○ | |
| 279 | 5 | D | III | ○ | ○ | ○ | |
| 280 | 5 | D | IV | ○ | ○ | ○ | |
| 281 | 5 | D | V | ○ | ○ | ○ | |
| 282 | 5 | D | VI | ○ | ○ | ○ | |
| 283 | 5 | D | VII | ○ | ○ | ○ | |
| 284 | 5 | D | VIII | ○ | ○ | ○ | |
| 285 | 5 | D | IX | ○ | ○ | ○ | |
| 286 | 5 | D | X | ○ | ○ | ○ | |
| 287 | 5 | D | XI | ○ | ○ | ○ | |
| 288 | 5 | D | XII | ○ | ○ | X | Comparative example |

TABLE 33

| No. | Steel sheet | Ni—P coating | Zn coating | Corrosion resistance 100 cycles | Paintability 100 cycles | Workability | Remarks |
|---|---|---|---|---|---|---|---|
| 289 | 5 | E | I | ○ | ○ | ○ | |
| 290 | 5 | E | II | ○ | ○ | ○ | |
| 291 | 5 | E | III | ○ | ○ | ○ | |
| 292 | 5 | E | IV | ○ | ○ | ○ | |
| 293 | 5 | E | V | ○ | ○ | ○ | |
| 294 | 5 | E | VI | ○ | ○ | ○ | |
| 295 | 5 | E | VII | ○ | ○ | ○ | |
| 296 | 5 | E | VIII | ○ | ○ | ○ | |
| 297 | 5 | E | IX | ○ | ○ | ○ | |
| 298 | 5 | E | X | ○ | ○ | ○ | |
| 299 | 5 | E | XI | ○ | ○ | ○ | |
| 300 | 5 | E | XII | ○ | ○ | X | Comparative example |
| 301 | 5 | F | I | ○ | ○ | ○ | |
| 302 | 5 | F | II | ○ | ○ | ○ | |
| 303 | 5 | F | III | ○ | ○ | ○ | |
| 304 | 5 | F | IV | ○ | ○ | ○ | |
| 305 | 5 | F | V | ○ | ○ | ○ | |
| 306 | 5 | F | VI | ○ | ○ | ○ | |
| 307 | 5 | F | VII | ○ | ○ | ○ | |
| 308 | 5 | F | VIII | ○ | ○ | ○ | |
| 309 | 5 | F | IX | ○ | ○ | ○ | |
| 310 | 5 | F | X | ○ | ○ | ○ | |
| 311 | 5 | F | XI | ○ | ○ | ○ | |
| 312 | 5 | F | XII | ○ | ○ | X | Comparative example |
| 313 | 5 | G | I | ○ | ○ | ○ | |
| 314 | 5 | G | II | ○ | ○ | ○ | |
| 315 | 5 | G | III | ○ | ○ | ○ | |
| 316 | 5 | G | IV | ○ | ○ | ○ | |
| 317 | 5 | G | V | ○ | ○ | ○ | |
| 318 | 5 | G | VI | ○ | ○ | ○ | |
| 319 | 5 | G | VII | ○ | ○ | ○ | |

TABLE 33-continued

| No. | Steel sheet | Ni—P coating | Zn coating | Corrosion resistance 100 cycles | Paintability 100 cycles | Workability | Remarks |
|---|---|---|---|---|---|---|---|
| 320 | 5 | G | VIII | ○ | ○ | ○ | |
| 321 | 5 | G | IX | ○ | ○ | ○ | |
| 322 | 5 | G | X | ○ | ○ | ○ | |
| 323 | 5 | G | XI | ○ | ○ | ○ | |
| 324 | 5 | G | XII | ○ | ○ | X | Comparative example |
| 325 | 5 | H | I | ○ | ○ | ○ | |
| 326 | 5 | H | II | ○ | ○ | ○ | |
| 327 | 5 | H | III | ○ | ○ | ○ | |
| 328 | 5 | H | IV | ○ | ○ | ○ | |
| 329 | 5 | H | V | ○ | ○ | ○ | |
| 330 | 5 | H | VI | ○ | ○ | ○ | |
| 331 | 5 | H | VII | ○ | ○ | ○ | |
| 332 | 5 | H | VIII | ○ | ○ | ○ | |
| 333 | 5 | H | IX | ○ | ○ | ○ | |
| 334 | 5 | H | X | ○ | ○ | ○ | |
| 335 | 5 | H | XI | ○ | ○ | ○ | |
| 336 | 5 | H | XII | ○ | ○ | X | Comparative example |
| 337 | 5 | I | I | ○ | ○ | ○ | |
| 338 | 5 | I | II | ○ | ○ | ○ | |
| 339 | 5 | I | III | ○ | ○ | ○ | |
| 340 | 5 | I | IV | ○ | ○ | ○ | |
| 341 | 5 | I | V | ○ | ○ | ○ | |
| 342 | 5 | I | VI | ○ | ○ | ○ | |
| 343 | 5 | I | VII | ○ | ○ | ○ | |
| 344 | 5 | I | VIII | ○ | ○ | ○ | |
| 345 | 5 | I | IX | ○ | ○ | ○ | |
| 346 | 5 | I | X | ○ | ○ | ○ | |
| 347 | 5 | I | XI | ○ | ○ | ○ | |
| 348 | 5 | I | XII | ○ | ○ | X | Comparative example |
| 349 | 5 | J | I | ○ | ○ | ○ | |
| 350 | 5 | J | II | ○ | ○ | ○ | |
| 351 | 5 | J | III | ○ | ○ | ○ | |
| 352 | 5 | J | IV | ○ | ○ | ○ | |
| 353 | 5 | J | V | ○ | ○ | ○ | |
| 354 | 5 | J | VI | ○ | ○ | ○ | |
| 355 | 5 | J | VII | ○ | ○ | ○ | |
| 356 | 5 | J | VIII | ○ | ○ | ○ | |
| 357 | 5 | J | IX | ○ | ○ | ○ | |
| 358 | 5 | J | X | ○ | ○ | ○ | |
| 359 | 5 | J | XI | ○ | ○ | ○ | |
| 360 | 5 | J | XII | ○ | ○ | X | Comparative example |
| 361 | 5 | K | I | ○ | ○ | ○ | |
| 362 | 5 | K | II | ○ | ○ | ○ | |
| 363 | 5 | K | III | ○ | ○ | ○ | |
| 364 | 5 | K | IV | ○ | ○ | ○ | |
| 365 | 5 | K | V | ○ | ○ | ○ | |
| 366 | 5 | K | VI | ○ | ○ | ○ | |
| 367 | 5 | K | VII | ○ | ○ | ○ | |
| 368 | 5 | K | VIII | ○ | ○ | ○ | |
| 369 | 5 | K | IX | ○ | ○ | ○ | |
| 370 | 5 | K | X | ○ | ○ | ○ | |
| 371 | 5 | K | XI | ○ | ○ | ○ | |
| 372 | 5 | K | XII | ○ | ○ | X | Comparative example |
| 373 | 5 | L | I | ○ | ○ | ○ | |
| 374 | 5 | L | II | ○ | ○ | ○ | |
| 375 | 5 | L | III | ○ | ○ | ○ | |
| 376 | 5 | L | IV | ○ | ○ | ○ | |
| 377 | 5 | L | V | ○ | ○ | ○ | |
| 378 | 5 | L | VI | ○ | ○ | ○ | |
| 379 | 5 | L | VII | ○ | ○ | ○ | |
| 380 | 5 | L | VIII | ○ | ○ | ○ | |
| 381 | 5 | L | IX | ○ | ○ | ○ | |

TABLE 33-continued

| No. | Steel sheet | Ni—P coating | Zn coating | Corrosion resistance 100 cycles | Paintability 100 cycles | Workability | Remarks |
|---|---|---|---|---|---|---|---|
| 382 | 5 | L | X | ○ | ○ | ○ | |
| 383 | 5 | L | XI | ○ | ○ | ○ | |
| 384 | 5 | L | XII | ○ | ○ | X | Comparative example |

TABLE 34

| No. | Steel sheet | Ni—P coating | Zn coating | Corrosion resistance 100 cycles | Paintability 100 cycles | Workability | Remarks |
|---|---|---|---|---|---|---|---|
| 385 | 5 | M | I | Δ | Δ | ○ | Comparative example |
| 386 | 5 | M | II | Δ | Δ | ○ | Comparative example |
| 387 | 5 | M | III | Δ | Δ | ○ | Comparative example |
| 388 | 5 | M | IV | Δ | Δ | ○ | Comparative example |
| 389 | 5 | M | V | Δ | Δ | ○ | Comparative example |
| 390 | 5 | M | VI | Δ | Δ | ○ | Comparative example |
| 391 | 5 | M | VII | Δ | Δ | ○ | Comparative example |
| 392 | 5 | M | VIII | Δ | Δ | ○ | Comparative example |
| 393 | 5 | M | IX | Δ | Δ | ○ | Comparative example |
| 394 | 5 | M | X | Δ | Δ | ○ | Comparative example |
| 395 | 5 | M | XI | Δ | Δ | ○ | Comparative example |
| 396 | 5 | M | XII | Δ | Δ | X | Comparative example |
| 397 | 5 | N | I | Δ | Δ | ○ | Comparative example |
| 398 | 5 | N | II | Δ | Δ | ○ | Comparative example |
| 399 | 5 | N | III | Δ | Δ | ○ | Comparative example |
| 400 | 5 | N | IV | Δ | Δ | ○ | Comparative example |
| 401 | 5 | N | V | Δ | Δ | ○ | Comparative example |
| 402 | 5 | N | VI | Δ | Δ | ○ | Comparative example |
| 403 | 5 | N | VII | Δ | Δ | ○ | Comparative |

TABLE 34-continued

| No. | Steel sheet | Ni—P coating | Zn coating | Corrosion resistance 100 cycles | Paintability 100 cycles | Workability | Remarks |
|---|---|---|---|---|---|---|---|
| 404 | 5 | N | VIII | Δ | Δ | ○ | Comparative example |
| 405 | 5 | N | IX | Δ | Δ | ○ | Comparative example |
| 406 | 5 | N | X | Δ | Δ | ○ | Comparative example |
| 407 | 5 | N | XI | Δ | Δ | ○ | Comparative example |
| 408 | 5 | N | XII | Δ | Δ | X | Comparative example |
| 409 | 5 | O | I | ○ | ○ | X | Comparative example |
| 410 | 5 | O | II | ○ | ○ | X | Comparative example |
| 411 | 5 | O | III | ○ | ○ | X | Comparative example |
| 412 | 5 | O | IV | ○ | ○ | X | Comparative example |
| 413 | 5 | O | V | ○ | ○ | X | Comparative example |
| 414 | 5 | O | VI | ○ | ○ | X | Comparative example |
| 415 | 5 | O | VII | ○ | ○ | X | Comparative example |
| 416 | 5 | O | VIII | ○ | ○ | X | Comparative example |
| 417 | 5 | O | IX | ○ | ○ | X | Comparative example |
| 418 | 5 | O | X | ○ | ○ | X | Comparative example |
| 419 | 5 | O | XI | ○ | ○ | X | Comparative example |
| 420 | 5 | O | XII | ○ | ○ | X | Comparative example |
| 421 | 5 | P | I | ○ | ○ | Δ | Comparative example |
| 422 | 5 | P | II | ○ | ○ | Δ | Comparative example |
| 423 | 5 | P | III | ○ | ○ | Δ | Comparative example |
| 424 | 5 | P | IV | ○ | ○ | Δ | Comparative example |
| 425 | 5 | P | V | ○ | ○ | Δ | Comparative example |
| 426 | 5 | P | VI | ○ | ○ | Δ | Comparative example |
| 427 | 5 | P | VII | ○ | ○ | Δ | Comparative example |

TABLE 34-continued

| No. | Steel sheet | Ni—P coating | Zn coating | Corrosion resistance 100 cycles | Paintability 100 cycles | Workability | Remarks |
|---|---|---|---|---|---|---|---|
| 428 | 5 | P | VIII | ○ | ○ | Δ | Comparative example |
| 429 | 5 | P | IX | ○ | ○ | Δ | Comparative example |
| 430 | 5 | P | X | ○ | ○ | Δ | Comparative example |
| 431 | 5 | P | XI | ○ | ○ | Δ | Comparative example |
| 432 | 5 | P | XII | ○ | ○ | X | Comparative example |
| 433 | 5 | Q | I | ○ | ○ | Δ | Comparative example |
| 434 | 5 | Q | II | ○ | ○ | Δ | Comparative example |
| 435 | 5 | Q | III | ○ | ○ | Δ | Comparative example |
| 436 | 5 | Q | IV | ○ | ○ | Δ | Comparative example |
| 437 | 5 | Q | V | ○ | ○ | Δ | Comparative example |
| 438 | 5 | Q | VI | ○ | ○ | Δ | Comparative example |
| 439 | 5 | Q | VII | ○ | ○ | Δ | Comparative example |
| 440 | 5 | Q | VIII | ○ | ○ | Δ | Comparative example |
| 441 | 5 | Q | IX | ○ | ○ | Δ | Comparative example |
| 442 | 5 | Q | X | ○ | ○ | Δ | Comparative example |
| 443 | 5 | Q | XI | ○ | ○ | Δ | Comparative example |
| 444 | 5 | Q | XII | ○ | ○ | X | Comparative example |
| 445 | 5 | R | I | ○ | ○ | X | Comparative example |
| 446 | 5 | R | II | ○ | ○ | X | Comparative example |
| 447 | 5 | R | III | ○ | ○ | X | Comparative example |
| 448 | 5 | R | IV | ○ | ○ | X | Comparative example |
| 449 | 5 | R | V | ○ | ○ | X | Comparative example |
| 450 | 5 | R | VI | ○ | ○ | X | Comparative example |
| 451 | 5 | R | VII | ○ | ○ | X | Comparative example |
| 452 | 5 | R | VIII | ○ | ○ | X | Com- |

TABLE 34-continued

| No. | Steel sheet | Ni—P coating | Zn coating | Corrosion resistance 100 cycles | Paintability 100 cycles | Workability | Remarks |
|---|---|---|---|---|---|---|---|
| | | | | | | | parative example |
| 453 | 5 | R | IX | ○ | ○ | X | Comparative example |
| 454 | 5 | R | X | ○ | ○ | X | Comparative example |
| 455 | 5 | R | XI | ○ | ○ | X | Comparative example |
| 456 | 5 | R | XII | ○ | ○ | X | Comparative example |
| 457 | 5 | S | I | ○ | ○ | X | Comparative example |
| 458 | 5 | S | II | ○ | ○ | X | Comparative example |
| 459 | 5 | S | III | ○ | ○ | X | Comparative example |
| 460 | 5 | S | IV | ○ | ○ | X | Comparative example |
| 461 | 5 | S | V | ○ | ○ | X | Comparative example |
| 462 | 5 | S | VI | ○ | ○ | X | Comparative example |
| 463 | 5 | S | VII | ○ | ○ | X | Comparative example |
| 464 | 5 | S | VIII | ○ | ○ | X | Comparative example |
| 465 | 5 | S | IX | ○ | ○ | X | Comparative example |
| 466 | 5 | S | X | ○ | ○ | X | Comparative example |
| 467 | 5 | S | XI | ○ | ○ | X | Comparative example |
| 468 | 5 | S | XII | ○ | ○ | X | Comparative example |
| 469 | 5 | T | I | X | X | ○ | Comparative example |
| 470 | 5 | T | II | X | X | ○ | Comparative example |
| 471 | 5 | T | III | X | X | ○ | Comparative example |
| 472 | 5 | T | IV | X | X | ○ | Comparative example |
| 473 | 5 | T | V | X | X | ○ | Comparative example |
| 474 | 5 | T | VI | X | X | ○ | Comparative example |
| 475 | 5 | T | VII | X | X | ○ | Comparative example |
| 476 | 5 | T | VIII | X | X | ○ | Comparative example |
| 477 | 5 | T | IX | X | X | ○ | Comparative example |
| 478 | 5 | T | X | X | X | ○ | Comparative example |
| 479 | 5 | T | XI | X | X | ○ | Comparative example |
| 480 | 5 | T | XII | X | X | X | Comparative example |

TABLE 35

| No. | Steel sheet | Ni—P coating | Zn coating | Corrosion resistance 100 cycle | Paintability 100 cycle | Workabilty | Remarks |
|---|---|---|---|---|---|---|---|
| 1 | 3 | A | I | ○ | ○ | ○ | |
| 2 | 3 | A | IX | ○ | ○ | ○ | |
| 3 | 3 | B | I | ○ | ○ | ○ | |
| 4 | 3 | B | IX | ○ | ○ | ○ | |
| 5 | 3 | C | I | ○ | ○ | ○ | |
| 6 | 3 | C | IX | ○ | ○ | ○ | |
| 7 | 3 | M | I | Δ | Δ | ○ | Comparative excample |
| 8 | 3 | M | IX | Δ | Δ | ○ | Comparative excample |
| 9 | 3 | N | I | Δ | Δ | ○ | Comparative excample |
| 10 | 3 | N | IX | Δ | Δ | ○ | Comparative excample |
| 11 | 3 | O | I | ○ | ○ | X | Comparative excample |
| 12 | 3 | O | IX | ○ | ○ | X | Comparative excample |
| 13 | 3 | T | I | X | X | ○ | Comparative excample |
| 14 | 3 | T | IX | X | X | ○ | Comparative excample |

Note)
C: Comparative example

EMBODIMENT-5

This invention is further described in detail in the following.

The steel sheets of this invention contain P, Cu, and Ni, and further contain Sn as an element for improving corrosion resistance to successfully secure the corrosion resistance and the workability of IF steel. The detailed specification is described below focusing on the reason of limiting individual components of the steel (the composition in the following description is given by wt. %).

C: The content of C is specified in 0.002 to 0.01%.

Smaller C content is preferred to maintain superior mechanical characteristics of the material. Accordingly, the upper limit of C content not degrading the effect of the invention is specified as 0.01%, more preferably as 0.006%. Regarding the lower limit, an excessively low C content gives not much improve in the workability, and the very low C content needs to be compensated by the addition of other elements, which causes a cost increase. So the lower limit of C content is specified as 0.002%.

Si: The content of Si is specified as 1% or less.

Silicon contributes to the strengthening of steel sheet as an element for enhancing solid solution strength without degrading the press-formability. However, Si content above 1% significantly increases the scale generated during heating period in the hot rolling stage, and degrades the deep drawing performance, and further worsens the chemical conversion capability. As a result, the upper limit of the Si content is specified as 1%.

Mn: The content of Mn is specified in 0.05 to 1%.

Manganese is necessary to fix S which is unavoidably included in steel and to prevent red shortness. Accordingly, the lower limit is specified as 0.05%. Addition of Mn higher than 1% significantly degrades Lankford value, and is a disadvantage in terms of cost. So the upper limit is specified as 1%.

P: The content of P is specified in 0.02 to 0.1%.

Phosphorus is one of the most inexpensive elements to strengthen the steel, and is an element to improve the corrosion resistance of the steel itself. When an IF steel is used as the base material and when P is included more than 0.1%, the resulted steel increases the strength and tends to segregate P at grain boundaries, which induces a problem of poor secondary working. Therefore, the P content is specified as 0.1% or less. On the other hand, for the contribution to corrosion resistance, the P content of 0.02% is required, so the lower limit is specified as 0.02%.

S: The content of S is specified as 0.01% or less.

The S content above 0.01% degrades the ductile property of steel and gives a bad effect to corrosion resistance. So the S content is specified as 0.01% or less. Most preferably the S content is 0.007% or less.

sol.Al: The content of sol.Al is specified as 0.1% or less.

Aluminum is necessary for de-oxidation and for fixing N. However, excess addition of sol.Al increases the product cost and degrades the surface quality owing to the increase of alumina inclusion. As a result, the sol.Al content is specified as 0.1% or less, and most preferably 0.06% or less.

N: The content of N is specified as 0.004% or less.

To attain a high Lankford value, less N content is preferred. The upper limit of N content is specified at 0.004% as the range not degrading the effect of this invention.

Cu: The content of Cu is specified in a range of from 0.2 to 0.5%.

When Cu is added with P, it improves the corrosion resistance of steel itself. The effect appears at 0.2% or more of the content. Excess addition of Cu degrades the deep drawing performance, and tends to induce thermal cracks during hot rolling caused by a surface defect or by the coexistence of Sn. So the upper limit is specified as 0.5%.

Ni: The content of Ni is specified in 0.1 to 0.5%.

Nickel is an effective element to reduce the surface defects caused by the addition of Cu, and to improve the corrosion resistance. Excess addition of Ni, however, degrades the deep drawing performance and increases the product cost. Accordingly, the lower limit is specified as 0.1%, and the upper limit is specified as 0.5%.

B: The content of B is specified in a range of from 0.0005 to 0.002%.

Boron segregates to grain boundaries and strengthens the grain boundaries. In particular, when P is added to the IF steel, the addition of B is essential to avoid the problem of secondary working brittleness. The addition of B less than 0.0005% gives not sufficient effect, and the addition of B above 0.002% increases the re-crystallize temperature and degrades Lankford value. Accordingly, the range is specified.

Ti: The content of Ti is specified in a range of from 0.005 to 0.1%.

Titanium fixes C in steel and increases Lankford value. The addition of less than 0.005% Ti gives not sufficient effect, and excess addition induces cost increase and causes the surface defects and degrades the chemical conversion capability. Therefore, the upper limit of Ti content is specified as 0.1%.

Nb: The content of Nb is specified in a range of from 0.002 to 0.05%.

Similar to Ti, Nb fixes C in steel, and the combined addition with Ti further increases Lankford value. The addition of Nb less than 0.002% gives not sufficient effect, and excess addition induces the cost increase. So the upper limit is specified as 0.05%.

Sn: The content of Sn is specified in a range of from 0.002 to 0.05%, and is specified to satisfy the relation of:

$$2 \leqq 1000 \times Sn \times (2 \times P + Cu + Ni) \leqq 20$$

As described before, Sn is an important element in this invention, and the addition of Sn is essential for improving the corrosion resistance of the steel sheets. The addition of Sn above 0.05% degrades the hot ductility of steel sheet and also degrades both the ductility of steel sheet and the deep drawing performance. So the upper limit of Sn addition is specified as 0.05%. To improve the corrosion resistance, the lower limit is specified as 0.002%. Furthermore, the Sn content is limited by the equation:

$$2 \leqq 1000 \times Sn \times (2 \times P + Cu + Ni) \leqq 20.$$

The above described limitation was defined by the experiment given below. The unit of components is wt. %.

A steel sheet contains: 0.002 to 0.01% C., 1% or less Si, 0.05 to 1% Mn, 0.02 to 0.1% P, 0.01% or less S, 0.1% or less sol.Al, 0.004% or less N, 0.0005 to 0.002% B, 0.2 to 0.5% Cu, 0.1 to 0.5% Ni, and 0.002 to 0.05% Sn; and the composition satisfies the relation of $$2 \leqq 1000 \times Sn \times (2 \times P + Cu + Ni) \leqq 20,$$

and further containing either one or both of Ti in a range of from 0.005 to 0.1% and Nb in a range of from 0.002 to 0.05%, and balance of Fe and inevitable impurities. The steel sheet has a diffused alloy layer consisting mainly of Fe-Ni-P and further containing at least one element selected from the group consisting of W, Mo, Cr, and Cu on at least one surface thereof.

That type of steel sheet was studied for its corrosion resistance.

The evaluation of corrosion resistance was given under the corrosion environment combined dry/humid repetition with salt spray for 60 days to determine the corrosion depth on a non-painted steel sheet.

Figure 5:
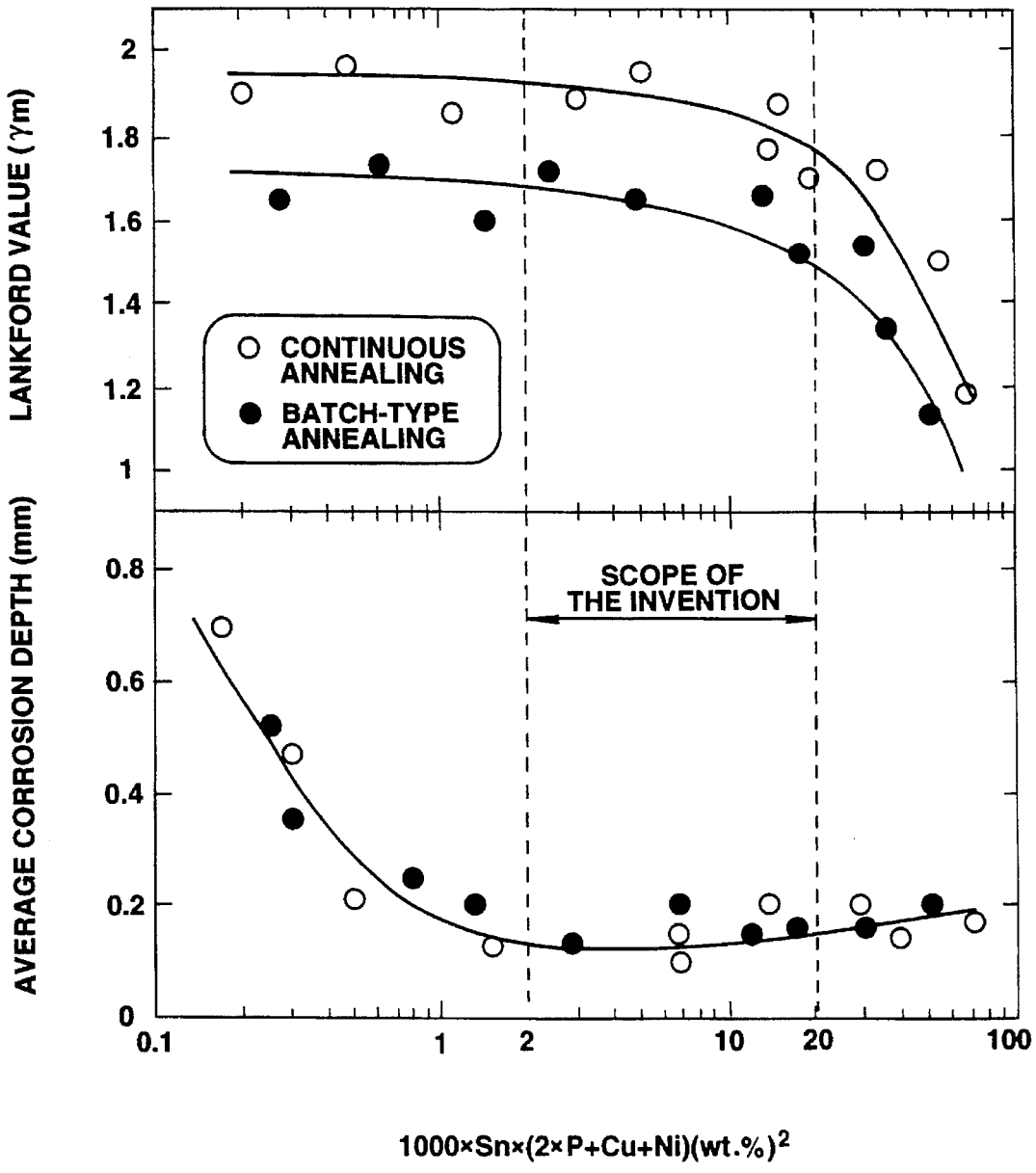
FIG. 5 is a graphical representation showing the relationships between 1000×Sn×(2×P+Cu+Ni) and Lankford value, and between 1000×Sn××(2×P+Cu+Ni) and average corrosion depth of the present invention.

FIG. 5 shows the relation of average corrosion depth and Lankford value (rm) using the parameter representing the relation between the average corrosion depth and the composition of steel, 1000×Sn×(2×P+Cu+Ni). As clearly seen in FIG. 5, the corrosion resistance and the deep drawing performance significantly depend on the content of Sn, P, Cu, and Ni.

From FIG. 5, it is understood that when the value of 1000×Sn×(2×P+Cu+Ni) is above 2, the corrosion resistance is favorable independent of annealing method. However, when the value of 1000×Sn×(2×P+Cu+Ni) exceeds 20, the addition of elements to give the corrosion resistance increases so that the Lankford value decreases. As a result, corrosion resistance and deep drawing performance can not be satisfied at a time. Accordingly, the content of Sn is limited by the relation, $2 \leqq 1000 \times Sn \times (2 \times P + Cu + Ni) \leqq 20$.

Since the content of Sn, P, Cu, and Ni significantly affects the corrosion resistance independent of the type of annealing, a balanced and adequate combination of Sn, P, Cu, and Ni content contribute to the improvement of corrosion resistance.

The above described composition of steel gives sufficient corrosion resistance to the steel sheet. However, the corrosion resistance is not satisfactory for automobile steel sheets which are used under a severe environment.

For obtaining further corrosion resistance, this invention forms a diffused alloy layer consisting of Fe-Ni-P on a steel sheet having the composition above described. The Ni-P coating containing P at a rate of 8 to 18% forms an amorphous-like structure. When a steel sheet having that type of coating is subjected to heat treatment, a uniform diffused alloy layer is formed within a short period compared with the case of common crystalline coating layers. The diffused alloy layer protects the base steel material from corrosion and, once the corrosion of the base steel sheet begins, makes the iron corrosion product formed promptly dense structure. As a result, the steel sheet obtains excellent corrosion resistance which could not attained in the prior arts.

A Ni-P alloy coating containing P at less than 8% forms a crystalline layer and gives non-uniform P distribution. Consequently, that type of coating has non-uniform composition of diffused alloy layer when it is subjected to heat treatment, and the initial stage rust is insufficient in its uniformity and denseness, which gives unstable corrosion resistance. On the other hand, a coating containing P at above 18% makes the Ni-P alloy coating brittle and degrades the adhesiveness of the coating layer. As a result, that type of coating tends to separate from the base steel sheet during heat treatment. Therefore, the P content of the coating layer formed on the steel sheet of this invention is specified to a range of from 8 to 18%. Preferred range is from 8 to 15%, and more preferable range is from 10 to 13%.

The Ni-P coating composition may further contain at least one of W, Mo, Cr, and Cu to form a composite alloy coating at a rate of 15% or less. Those additional elements play a role of inhibitor to steel corrosion and show an effect to improve the denseness and stability of initial stage rust by the synergistic effect with Ni and P. Regarding the content of W, Mo, Cr, and Cu, a preferred content of the sum of them is not more than 15%. The corrosion resistance increases with the increase of the content of W, Mo, Cr, and Cu. However, when the sum of the added amount of W, Mo, Cr, and Cu exceeds 15%, the adhesiveness of the coating layer degrades, and likely generates the separation of coating layer in the succeeding steps. Therefore, the content of the sum of W, Mo, Cr, and Cu is specified as 15% or less. A preferable lower limit of the sum of W, Mo,. Cr, and Cu to perform the effect of the addition is 0.5%.

The coating weight of the Ni-P layer is not specifically defined. Nevertheless, a preferable range is from 0.1 to 8 $g/m^2$. The coating weight of less than 0.1 $g/m^2$ gives insufficient improvement of corrosion resistance, and the coating weight of above 8 $g/m^2$ degrades the workability of coating layer and induces separation of the layer. Furthermore, excess coating weight needs to slow the line speed, which is a disadvantage in production yield.

The following is a description of the production condition of this invention. This invention is effective independent of the condition of hot rolling and of annealing. The hot rolling stage performs the hot rolling of high temperature cast pieces directly sent from the continuous casting machine, of high temperature cast pieces obtained by heating, or of slabs prepared by blooming an ingot at a temperature of $Ar_3$ transformation point of the composition or higher level. The hot rolling below the $Ar_3$ transformation temperature degrades Lankford value after annealing, and that range of temperature is specified. Nevertheless, under a condition where the hot rolling lubrication is sufficiently provided, the application of hot rolling in ferrite region does not degrade the characteristics of this invention.

As for the coiling of hot-rolled sheet, the coiling temperature is maintained in a range of:

$$610-2000 \times Sn \leqq CT(°C.) \leqq 710-2000 \times Sn.$$

Figure 6:
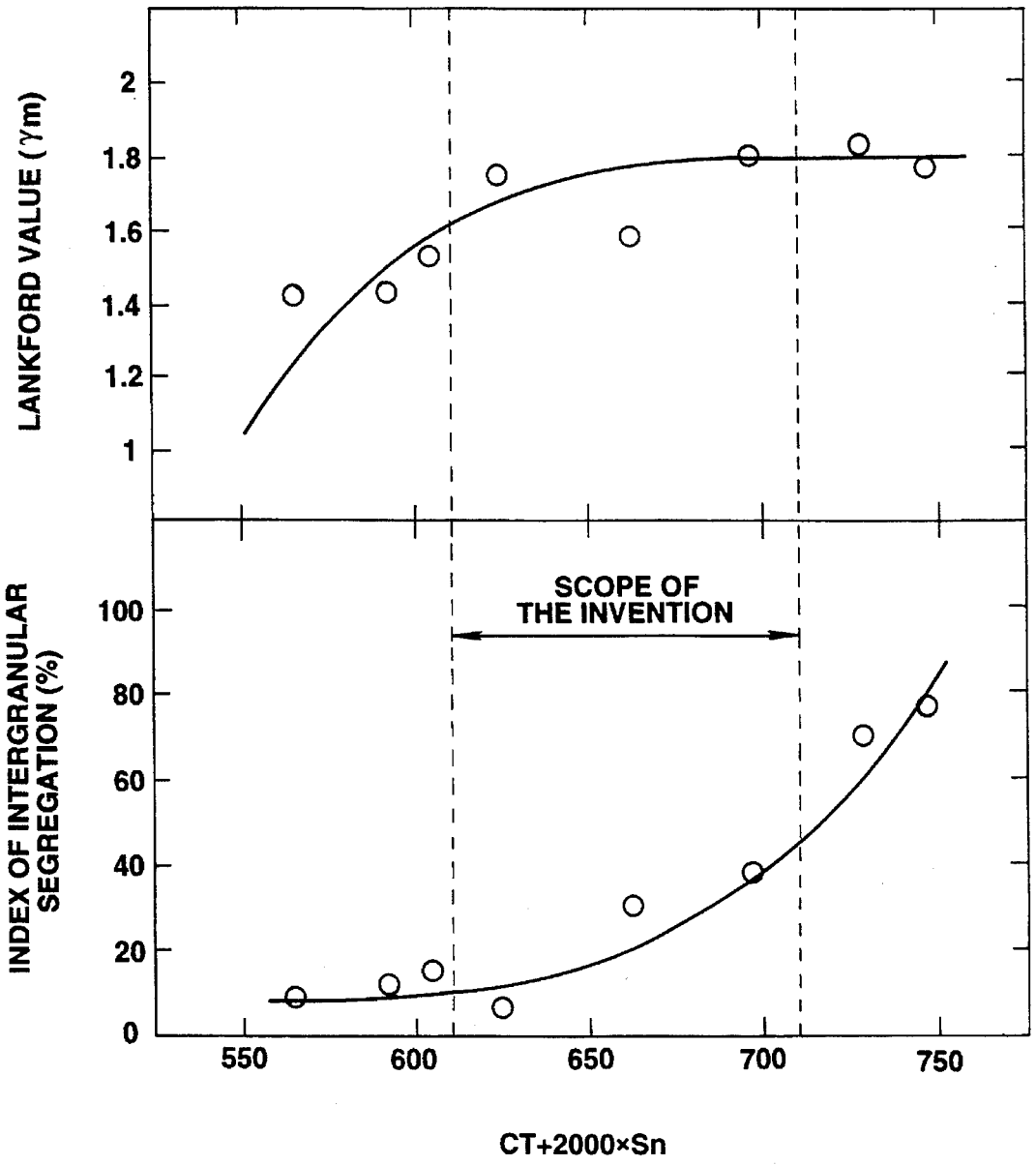
FIG. 6 is a graphical representation showing the influence of CT+2000×Sn on Lankford value and Index of intergranular segregation of the present invention.

From the property, Sn is known as an element likely to segregate to grain boundaries. Therefore, the coiling is necessary to be carried out at a temperature corresponding to the Sn content to prevent excessive segregation of Sn to grain boundaries. FIG. 6 shows a relation between the grain boundary segregation index and Lankford value using the parameter of (CT+2000×Sn). The grain boundary segregation index increases with the increase of (CT+200×Sn) value.

The grain boundary segregation index expresses the rate of Sn segregating to the grain boundaries to total amount of Sn added. In a region of (CT+200×Sn) less than 610, the grain boundary segregation index is small, and the grain boundary segregation is suppressed. However, Lankford value becomes small, instead. In a region of (CT+200×Sn) above 710, the Lankford value increases, but the grain boundary segregation index also increases. In both above cases, the characteristics of steel sheet become insufficient, so that the coiling is needed to carry out in a temperature range of: $610-2000 \times Sn \leqq CI\ (°C.) \leqq 710-2000 \times Sn$.

The cold rolling after the coiling at the above specified temperature range and after the pickling allows to increase Lankford value with the increase of reduction ratio. However, a reduction ratio less than 70% can not give a high Lankford value, and a reduction ratio at 90% or above gives less effect of rolling. Accordingly, the reduction ratio is specified in that range.

The Ni-P coating is applied before the annealing, and it may be applied immediately after the pickling at the exit of the pickling line before the cold rolling or may be applied after the cold rolling succeeding to the pickling. Particularly when the coating is given before the cold rolling, there appears an advantage that no pickling is required as the cleaning and activating the sheet before coating.

Several methods for forming Ni-P alloy coating layer have been introduced. Among them, the electroplating or electroless coating (chemical coating) are preferred from the viewpoint of simplicity of operation and quality of obtained film.

The steel sheet coated with Ni-P alloy coating layer undergoes a heat treatment in a non-oxidizing atmosphere to form a diffused alloy layer consisting mainly of Fe-Ni-P at the interface between the base steel plate and the coating layer. The heat treatment for diffusion may be carried out in an ordinary annealing facility after cold rolling. In particular, a continuous annealing which has a high productivity is preferred. The continuous annealing may be carried out by a common continuous annealing facility for cold-rolled steel sheets and an annealing facility used as a pre-treatment unit of hot dip coating line. A preferred maximum temperature of the heat treatment is in a range of from 500° to 880° C. most preferably in a range of from 800° to 880°C. The temperature below 500° C. can not sufficiently form the diffused layer between the Ni-P alloy layer and the steel surface, and results in an insufficient dense rust formation during the corrosion process, which gives less improving effect on corrosion resistance. To obtain a higher Lankford value, the temperature of 800° C. or more is preferred, and 820° C. is the most preferable lower limit. The annealing at above 880° C. likely generates pickup of metal onto the rolls in the heat treatment furnace, and tends to induce surface defects. The annealing at above 880° C. induces the growth of coarse ferrite grains to generate rough surface after press-forming. A preferred range of holding time at the maximum temperature of the steel sheet is 1 to 120 sec, though the holding time depends on the temperature.

Too short holding time does not give the improving effect of corrosion resistance because sufficient diffused layer can not be formed. An excessive holding time over 120 sec. induces an excessive diffusion alloying, which results in a brittle interface layer to degrade the adhesiveness and workability of the coating layer because the sufficient diffused layer can not be formed. During the heat treatment, an excessive aging may be applied for several minutes at an approximate temperature range of from 300° to 400°C. A preferable depth of appropriate diffusion layer formed by the heat treatment is in a range of from 0.1 to 20 μm.

The heat treatment may be done in a direct-fired heating furnace at a heating rate of 50° C./min. or more.

When a Ni-P alloy coating layer undergoes heat treatment, two types of coating structure appear. The one is that a part of the Ni-P alloy coating layer forms a diffused alloy layer and forms the steel sheet/diffused alloy layer/Ni-P alloy coating layer structure. The other is that all the Ni-P alloy coating layer forms a diffused alloy layer to give the steel sheet/diffused alloy layer structure. This invention includes both cases. After the heat treatment for diffusion, a temper rolling is conducted under an appropriate condition, at need.

The cold-rolled steel sheets having both such a corrosion resistance and deep drawing performance are quite useful as an automobile material.

EXAMPLE

The following is the description of an example of this invention. Nevertheless, this invention naturally not restricted by the example.

The test pieces prepared were evaluated in terms of corrosion resistance and workability of coating layer. The method and criteria of the evaluation are the following.

(Method and criteria of evaluation)

(1) Corrosion resistance

The test piece is exposed to a corrosive condition of repeated drying and humidifying combined with salt solution spraying at a rate of 1 cycle per day. The resulted corrosion depth is measured to evaluate in accordance with the criterion given below.

○: the maximum corrosion depth is 0.2 mm or less

Δ: the maximum corrosion depth is deeper than 0.2 mm and not deeper than 0.4 mm

X: the maximum corrosion depth is deeper than 0.4 mm (2) Workability

The test piece undergoes the 180 degree bending test to observe the damage of coating layer at the tip of bent. The evaluation is given in accordance with the following criterion.

○: no damage or only fine cracks are observed

Δ: large crack is observed or partial separation of coating layer is observed

X: coating separation is observed in a wide range

EXAMPLE-12

The steels having the composition listed in Table 36 were melted and formed into slabs. Each of the slabs was heated to 1200° C. hot-rolled at 900° C., and coiled at 650° C. to obtain a hot-rolled sheet of 4.0 mm thick.

Then, the steel sheet was pickled and cold-rolled to 0.8 mm. The steel sheet was coated with Ni-P with P content of 12% and coating weight of 1 g/m$^2$. Two types of annealing were applied for separate steel sheet: namely, box annealing at 700° C., and continuous annealing at 850°C. After giving temper rolling of 0.5%, the test pieces were taken for tensile test. The result is listed in Table 37. The table shows that the steels of this invention give higher Lankford value and superior corrosion resistance to comparative steels.

EXAMPLE-13

The steel sheets (No. 4, 9, 15, and 19) of this invention listed in Table 36 underwent the Ni-P coating with the P content of 12% and the coating weight of 1 g/m$^2$. These steel sheets were then treated under various conditions of hot rolling and coiling temperature, cold rolling reduction ratio, and annealing temperature listed in Table 38. The characteristics of these prepared steel sheets were analyzed. As seen in Table 39, all the tested steel sheets treated by the method of this invention have excellent properties giving Lankford value of 1.6 or higher.

EXAMPLE-14

The steels (No. 4, 9, 15, and 19) of this invention listed in Table 36 were melted to form slabs. These slabs were hot-rolled under the condition of heating temperature of 1200°C., finish temperature of 900°C., and coiling temperature of 650°C., to prepare the hot-rolled steel sheets of 4.0 mm thickness.

These sheets were pickled and cold-rolled to 0.8 mm thick. Then they were coated with Ni-P layer in a range specified in Table 40, followed by continuous annealing in a temperature range of from 800° to 880° C. and by refining-rolling of 0.5% to prepare test pieces. The test result is summarized in Table 41.

All the steel sheets of this invention tested showed excellent corrosion resistance and workability.

EXAMPLE-15

The steels (No. 4, 9, 15, and 19) of this invention listed in Table 36 were melted to form slabs. These slabs were hot-rolled under the condition of heating temperature of 1200° C., finish temperature of 900° C., and coiling temperature of 650° C., to prepare the hot-rolled steel sheets of 4.0 mm thickness.

These sheets were pickled and coated with Ni-P (No. A, B, C, M, N, and O) in a range specified in Table 40, followed by cold rolling to 0.8 mm thick and by continuous annealing in a temperature range of from 800° to 880° C. and by temper-rolling of 0.5% to prepare test pieces. The test result is summarized in Table 42. All the steel sheets of this invention tested showed excellent corrosion resistance and workability.

TABLE 36

| | | Chemical composition (wt. %) | | | | | | | | | | | | | | | |
|---|---|---|---|---|---|---|---|---|---|---|---|---|---|---|---|---|---|
| I or C** | Steel | C | Si | Mn | P | S | sol. Al | N | Cu | Ni | Ti | Nb | B | Sn | F | P1 | P2 |
| C | 1 | 0.0034 | 0.02 | 0.20 | 0.024 | 0.005 | 0.041 | 0.0031 | 0.28 | 0.30 | 0.044 | 0.020 | 0.0010 | 0.0018* | 1.1* | 606 | 706 |
| I | 2 | 0.0021 | 0.01 | 0.17 | 0.027 | 0.007 | 0.034 | 0.0026 | 0.30 | 0.33 | 0.007 | 0.024 | 0.0007 | 0.003 | 2.1 | 604 | 704 |
| I | 3 | 0.0028 | 0.01 | 0.22 | 0.025 | 0.004 | 0.037 | 0.0023 | 0.32 | 0.32 | 0.016 | 0.043 | 0.0008 | 0.014 | 9.7 | 582 | 682 |
| I | 4 | 0.0033 | 0.02 | 0.19 | 0.022 | 0.009 | 0.040 | 0.0034 | 0.27 | 0.36 | 0.024 | 0.012 | 0.0011 | 0.029 | 19.5 | 552 | 652 |
| C | 5 | 0.0026 | 0.02 | 0.18 | 0.023 | 0.006 | 0.053 | 0.0025 | 0.29 | 0.31 | 0.034 | 0.032 | 0.0013 | 0.055* | 35.5* | 500 | 600 |
| C | 6 | 0.0032 | 0.02 | 0.18 | 0.017* | 0.005 | 0.053 | 0.0027 | 0.28 | 0.34 | 0.022 | 0.031 | 0.0008 | 0.021 | 13.7 | 568 | 668 |
| I | 7 | 0.0027 | 0.03 | 0.23 | 0.023 | 0.009 | 0.049 | 0.0031 | 0.41 | 0.37 | 0.007 | 0.040 | 0.0014 | 0.024 | 19.8 | 562 | 662 |
| I | 8 | 0.0041 | 0.01 | 0.21 | 0.044 | 0.006 | 0.041 | 0.0024 | 0.33 | 0.28 | 0.072 | 0.008 | 0.0018 | 0.018 | 12.6 | 574 | 674 |
| I | 9 | 0.0029 | 0.02 | 0.20 | 0.067 | 0.007 | 0.060 | 0.0030 | 0.29 | 0.12 | 0.057 | 0.021 | 0.0011 | 0.022 | 12.0 | 566 | 666 |
| I | 10 | 0.0030 | 0.01 | 0.22 | 0.093 | 0.008 | 0.054 | 0.0032 | 0.22 | 0.40 | 0.043 | 0.030 | 0.0006 | 0.020 | 16.1 | 570 | 670 |
| C | 11 | 0.0025 | 0.01 | 0.19 | 0.104* | 0.007 | 0.057 | 0.0029 | 0.47 | 0.25 | 0.024 | 0.015 | 0.0009 | 0.021 | 19.5 | 568 | 668 |
| C | 12 | 0.0045 | 0.03 | 0.15 | 0.058 | 0.006 | 0.058 | 0.0033 | 0.16* | 0.38 | 0.063 | 0.047 | 0.0014 | 0.015 | 9.8 | 580 | 680 |
| I | 13 | 0.0024 | 0.01 | 0.26 | 0.052 | 0.004 | 0.037 | 0.0019 | 0.23 | 0.45 | 0.054 | 0.019 | 0.0009 | 0.024 | 18.8 | 562 | 662 |
| I | 14 | 0.0033 | 0.02 | 0.18 | 0.046 | 0.009 | 0.045 | 0.0022 | 0.35 | 0.37 | 0.047 | 0.014 | 0.0011 | 0.008 | 6.5 | 594 | 694 |
| I | 15 | 0.0029 | 0.02 | 0.17 | 0.047 | 0.005 | 0.050 | 0.0035 | 0.47 | 0.34 | 0.095 | 0.035 | 0.0018 | 0.018 | 16.3* | 574 | 674 |
| C | 16 | 0.0027 | 0.01 | 0.23 | 0.045 | 0.007 | 0.048 | 0.0024 | 0.53* | 0.42 | 0.042 | 0.033 | 0.0008 | 0.040 | 41.6* | 530 | 630 |
| C | 17 | 0.0016 | 0.12 | 0.14 | 0.049 | 0.008 | 0.060 | 0.0018 | 0.33 | 0.07* | 0.094 | 0.042 | 0.0011 | 0.018 | 9.0 | 574 | 674 |
| I | 18 | 0.0025 | 0.07 | 0.17 | 0.048 | 0.004 | 0.044 | 0.0031 | 0.31 | 0.12 | 0.063 | 0.031 | 0.0009 | 0.020 | 10.5 | 570 | 670 |
| I | 19 | 0.0014 | 0.41 | 0.13 | 0.052 | 0.006 | 0.049 | 0.0020 | 0.36 | 0.29 | 0.010 | 0.021 | 0.0013 | 0.023 | 17.3 | 564 | 664 |
| I | 20 | 0.0033 | 0.08 | 0.16 | 0.050 | 0.005 | 0.045 | 0.0024 | 0.35 | 0.48 | 0.027 | 0.015 | 0.0007 | 0.021 | 19.5 | 568 | 668 |
| C | 21 | 0.0041 | 0.31 | 0.19 | 0.047 | 0.007 | 0.052 | 0.0029 | 0.28 | 0.55* | 0.060 | 0.023 | 0.0010 | 0.025 | 23.1 | 560 | 660 |

Notes)
(**)mark indicates that; I: Example of the present invention, C: Comparative example
(*)mark indicates that those are out of the range of the present invention
F: 1000 × Sn × (2 × P + Cu + Ni) (Unit of Sn, P, Cu, and Ni is wt. %)
P1: 610 − 2000 × Sn
P2: 710 − 2000 × Sn

TABLE 37

| I | | Continious Annealinng | | | Box Annealing | | |
|---|---|---|---|---|---|---|---|
| or C** | Steel | TS (N/mm²) | rm | d | TS (N/mm²) | rm | d |
| C | 1 | 319 | 1.93 | Δ | 323 | 1.84 | Δ |
| I | 2 | 325 | 1.89 | ○ | 330 | 1.75 | ○ |
| I | 3 | 340 | 1.89 | ○ | 336 | 1.83 | ○ |
| I | 4 | 353 | 1.83 | ○ | 355 | 1.68 | ○ |
| C | 5 | 360 | 1.60 | ○ | 365 | 1.45 | ○ |
| C | 6 | 312 | 1.92 | Δ | 311 | 1.76 | Δ |
| I | 7 | 326 | 1.89 | ○ | 331 | 1.72 | ○ |
| I | 8 | 341 | 1.83 | ○ | 345 | 1.68 | ○ |
| I | 9 | 359 | 1.77 | ○ | 368 | 1.64 | ○ |
| I | 10 | 386 | 1.70 | ○ | 392 | 1.56 | ○ |
| C | 11 | 390 | 1.29 | ○ | 399 | 1.11 | ○ |
| C | 12 | 317 | 1.95 | Δ | 318 | 1.81 | Δ |
| I | 13 | 325 | 1.92 | ○ | 329 | 1.76 | ○ |
| I | 14 | 327 | 1.86 | ○ | 325 | 1.74 | ○ |
| I | 15 | 335 | 1.71 | ○ | 331 | 1.60 | ○ |
| C | 16 | 340 | 1.50 | ○ | 337 | 1.40 | ○ |
| C | 17 | 312 | 1.75 | Δ | 315 | 1.64 | Δ |
| I | 18 | 320 | 1.73 | ○ | 323 | 1.55 | ○ |
| I | 19 | 327 | 1.68 | ○ | 331 | 1.53 | ○ |
| I | 20 | 340 | 1.65 | ○ | 343 | 1.54 | ○ |
| C | 21 | 341 | 1.41 | ○ | 344 | 1.27 | ○ |

Notes)
(**)mark indicates that I: Example of the present invention; and C: Comparative example.
rm: Lankford value of annealed sheet (average of three direction)
TS: tensile strength of anealed sheet
d: evaluation of corrosion resistance (100 cycle)

TABLE 38

| I or C** | No. | Steel | CT (°C.) | CR (%) | Ann. (°C.) |
|---|---|---|---|---|---|
| I | 1 | 4 | 630 | 80 | 830 |

TABLE 38-continued

| I or C** | No. | Steel | CT (°C.) | CR (%) | Ann. (°C.) |
|---|---|---|---|---|---|
| 1 | 2 | 4 | 620 | 80 | 870 |
| C | 3 | 4 | 530* | 80 | 850 |
| C | 4 | 9 | 540* | 78 | 850 |
| C | 5 | 9 | 690* | 78 | 850 |
| I | 6 | 9 | 640 | 80 | 860 |
| I | 7 | 9 | 645 | 85 | 860 |
| C | 8 | 15 | 630 | 83 | 780* |
| C | 9 | 15 | 630 | 83 | 890* |
| I | 10 | 15 | 650 | 80 | 820 |
| I | 11 | 15 | 655 | 80 | 880 |
| C | 12 | 19 | 650 | 66* | 860 |
| I | 13 | 19 | 645 | 75 | 860 |
| I | 14 | 19 | 640 | 84 | 860 |
| C | 15 | 19 | 650 | 92* | 860 |

Notes)
(**)mark indicates that I: Example of the present invention; and C: Comparative example. (Those with (*) mark are out of the range of the present invention).
CT: coiling temperaturer
CR: cold reduction ratio
Ann.: annealing temperature

TABLE 39

| | | | YP | TS | El | | |
|---|---|---|---|---|---|---|---|
| I or C** | No. | Steel | N/mm² | | % | n value | r value |
| I | 1 | 4 | 211 | 355 | 40.0 | 0.239 | 1.78 |
| 1 | 2 | 4 | 196 | 338 | 42.3 | 0.260 | 1.83 |
| C | 3 | 4 | 202 | 348 | 36.0 | 0.235 | 1.55 |
| C | 4 | 9 | 209 | 370 | 35.5 | 0.227 | 1.45 |
| C | 5 | 9 | 214 | 373 | 37.8 | 0.232 | 1.61 |
| I | 6 | 9 | 211 | 366 | 42.1 | 0.244 | 1.75 |
| I | 7 | 9 | 220 | 362 | 42.8 | 0.253 | 1.83 |

TABLE 39-continued

| I or C** | No. | Steel | YP N/mm² | TS N/mm² | El % | n value | r value |
|---|---|---|---|---|---|---|---|
| C | 8 | 15 | 208 | 349 | 38.3 | 0.246 | 1.62 |
| C | 9 | 15 | 191 | 333 | 42.1 | 0.251 | 1.79 |
| I | 10 | 15 | 210 | 350 | 41.6 | 0.243 | 1.84 |
| I | 11 | 15 | 208 | 348 | 40.9 | 0.248 | 1.82 |
| C | 12 | 19 | 209 | 343 | 36.5 | 0.222 | 1.57 |
| I | 13 | 19 | 210 | 333 | 38.7 | 0.240 | 1.66 |
| I | 14 | 19 | 202 | 323 | 41.4 | 0.250 | 1.75 |
| C | 15 | 19 | 193 | 320 | 42.1 | 0.250 | 1.77 |

Notes)
(**)mark indicates that I: Example of the present invention; and C: Comparative example.
YP: yield strength
TS: tensile strength
El: elongation
r: Lankford value

TABLE 40

| | P wt. % | Other component wt. % | Coating weight g/m² | |
|---|---|---|---|---|
| A | 8 | — | 1.0 | Example of the present invention |
| B | 12 | — | 0.1 | |
| C | 12 | — | 1.0 | |
| D | 12 | — | 8.0 | |
| E | 12 | 12%Cu | 1.0 | |
| F | 12 | 8%Mo | 1.0 | |
| G | 12 | 12%W | 1.0 | |
| H | 12 | 5%Cr | 1.0 | |
| I | 12 | 1%Mo—5%Cu | 1.0 | |
| J | 12 | 8%Cu—5%Cr | 1.0 | |
| K | 12 | 8%Cu—5%W | 1.0 | |
| L | 18 | — | 1.0 | |
| M | 6 | — | 1.0 | Comparative example |
| N | 12 | — | 0.05 | |
| O | 12 | — | 10.0 | |
| P | 12 | 16%W | 1.0 | |
| Q | 12 | 16%Mo | 1.0 | |
| R | 12 | 8%Cu—16%W | 1.0 | |
| S | 12 | 8%Cu—16%Mo | 1.0 | |
| T | — | — | | |

TABLE 41

| No. | Steel sheet | Ni—P coating | Corrosion resistance 100 cycles | Work-ability | Remarks |
|---|---|---|---|---|---|
| 1 | 4 | A | ○ | ○ | |
| 2 | 9 | A | ○ | ○ | |
| 3 | 15 | A | ○ | ○ | |
| 4 | 19 | A | ○ | ○ | |
| 5 | 4 | B | ○ | ○ | |
| 6 | 9 | B | ○ | ○ | |
| 7 | 15 | B | ○ | ○ | |
| 8 | 19 | B | ○ | ○ | |
| 9 | 4 | C | ○ | ○ | |
| 10 | 9 | C | ○ | ○ | |
| 11 | 15 | C | ○ | ○ | |
| 12 | 19 | C | ○ | ○ | |
| 13 | 4 | D | ○ | ○ | |
| 14 | 9 | D | ○ | ○ | |
| 15 | 15 | D | ○ | ○ | |
| 16 | 19 | D | ○ | ○ | |
| 17 | 4 | E | ○ | ○ | |
| 18 | 9 | E | ○ | ○ | |
| 19 | 15 | E | ○ | ○ | |
| 20 | 19 | E | ○ | ○ | |
| 21 | 4 | F | ○ | ○ | |
| 22 | 9 | F | ○ | ○ | |
| 23 | 15 | F | ○ | ○ | |

TABLE 41-continued

| No. | Steel sheet | Ni—P coating | Corrosion resistance 100 cycles | Work-ability | Remarks |
|---|---|---|---|---|---|
| 24 | 19 | F | ○ | ○ | |
| 25 | 4 | G | ○ | ○ | |
| 26 | 9 | G | ○ | ○ | |
| 27 | 15 | G | ○ | ○ | |
| 28 | 19 | G | ○ | ○ | |
| 29 | 4 | H | ○ | ○ | |
| 30 | 9 | H | ○ | ○ | |
| 31 | 15 | H | ○ | ○ | |
| 32 | 19 | H | ○ | ○ | |
| 33 | 4 | I | ○ | ○ | |
| 34 | 9 | I | ○ | ○ | |
| 35 | 15 | I | ○ | ○ | |
| 36 | 19 | I | ○ | ○ | |
| 37 | 4 | J | ○ | ○ | |
| 38 | 9 | J | ○ | ○ | |
| 39 | 15 | J | ○ | ○ | |
| 40 | 19 | J | ○ | ○ | |
| 41 | 4 | K | ○ | ○ | |
| 42 | 9 | K | ○ | ○ | |
| 43 | 15 | K | ○ | ○ | |
| 44 | 19 | K | ○ | ○ | |
| 45 | 4 | L | ○ | ○ | |
| 46 | 9 | L | ○ | ○ | |
| 47 | 15 | L | ○ | ○ | |
| 48 | 19 | L | ○ | ○ | |
| 49 | 4 | M | Δ | ○ | Comparative example |
| 50 | 9 | M | Δ | ○ | Comparative example |
| 51 | 15 | M | Δ | ○ | Comparative example |
| 52 | 19 | M | Δ | ○ | Comparative example |
| 53 | 4 | N | Δ | ○ | Comparative example |
| 54 | 9 | N | Δ | ○ | Comparative example |
| 55 | 15 | N | Δ | ○ | Comparative example |
| 56 | 19 | N | Δ | ○ | Comparative example |
| 57 | 4 | O | ○ | X | Comparative example |
| 58 | 9 | O | ○ | X | Comparative example |
| 59 | 15 | O | ○ | X | Comparative example |
| 60 | 19 | O | ○ | X | Comparative example |
| 61 | 4 | P | ○ | X | Comparative example |
| 62 | 9 | P | ○ | X | Comparative example |
| 63 | 15 | P | ○ | X | Comparative example |
| 64 | 19 | P | ○ | X | Comparative example |
| 65 | 4 | Q | ○ | X | Comparative example |
| 66 | 9 | Q | ○ | X | Comparative example |
| 67 | 15 | Q | ○ | X | Comparative example |
| 68 | 19 | Q | ○ | X | Comparative example |
| 69 | 4 | R | ○ | X | Comparative example |
| 70 | 9 | R | ○ | X | Comparative example |
| 71 | 15 | R | ○ | X | Comparative example |
| 72 | 19 | R | ○ | X | Comparative example |
| 73 | 4 | S | ○ | X | Comparative example |
| 74 | 9 | S | ○ | X | Comparative example |
| 75 | 15 | S | ○ | X | Comparative example |
| 76 | 19 | S | ○ | X | Comparative example |
| 77 | 4 | T | X | — | Comparative example |
| 78 | 9 | T | X | — | Comparative example |
| 79 | 15 | T | X | — | Comparative example |
| 80 | 19 | T | X | — | Comparative example |

TABLE 42

| No. | Steel sheet | Ni—P coating wt. % | Corrosion resistance 100 cycle | Paint-ability 100 cycle | Remarks |
|---|---|---|---|---|---|
| 1 | 4 | A | ○ | ○ | |
| 2 | 9 | A | ○ | ○ | |
| 3 | 15 | A | ○ | ○ | |
| 4 | 19 | A | ○ | ○ | |
| 5 | 4 | B | ○ | ○ | |
| 6 | 9 | B | ○ | ○ | |
| 7 | 15 | B | ○ | ○ | |
| 8 | 19 | B | ○ | ○ | |

TABLE 42-continued

| No. | Steel sheet | Ni—P coating wt. % | Corrosion resistance 100 cycle | Paint-ability 100 cycle | Remarks |
|---|---|---|---|---|---|
| 9 | 4 | C | ○ | ○ | |
| 10 | 9 | C | ○ | ○ | |
| 11 | 15 | C | ○ | ○ | |
| 12 | 19 | C | ○ | ○ | |
| 13 | 4 | M | Δ | ○ | Comparative example |
| 14 | 9 | M | Δ | ○ | Comparative example |
| 15 | 15 | M | Δ | ○ | Comparative example |
| 16 | 19 | M | Δ | ○ | Comparative example |
| 17 | 4 | N | Δ | ○ | Comparative example |
| 18 | 9 | N | Δ | ○ | Comparative example |
| 19 | 15 | N | Δ | ○ | Comparative example |
| 20 | 19 | N | Δ | ○ | Comparative example |
| 21 | 4 | O | ○ | X | Comparative example |
| 22 | 9 | O | ○ | X | Comparative example |
| 23 | 15 | O | ○ | X | Comparative example |
| 24 | 19 | O | ○ | X | Comparative example |

EMBODIMENT-6

The surface treated steel sheets having the diffused alloy layer prepared in EMBODIMENT-5 gives an anti-pitting effect. However, it is not sufficient to suppress the rust generation resulted from a damage on external coating caused by jumping stone or the like.

To give a post-painting corrosion resistance to those steel sheets, this invention applies a coating on the diffused alloy layer, which coating is Zn coating or a coating using Zn as the matrix and containing at least one metal selected from the group consisting of Ni, Fe, Co, Cr, Mn, Ti, Mo, Si and Al,or at least one oxide selected from the group consisting of Ni, Fe, Co, Cr, Mn, Ti, Mo, Si and Al in a form of alloy or dispersed particles.

That type of coating contributes to the corrosion resistance during the progress of coating corrosion owing to the sacrifice corrosion protection of the coating. It also gives an effect of stabilizing and densifying the base iron during the corrosion of base iron owing to the synergistic effect of the components in the Zn matrix and the components such as Ni and P in the diffused alloy layer.

A preferable zinc coating weight of zinc coating is from 5 to 60 g/m$^2$. Too small coating weight can not give a sufficient corrosion resistance, and excessive coating weight degrades the workability of coating layer and increases the production cost. The most preferable coating weight is in a range of from 5 to 45 g/m$^2$.

Following is the condition for production of the steel sheet of this invention.

This invention is effective independent of the condition of hot rolling and of annealing. The hot rolling stage performs the hot rolling of high temperature cast pieces directly sent from the continuous casting machine, of high temperature cast pieces obtained by heating, or of slab prepared by blooming an ingot at a temperature of $Ar_3$ transformation point of the composition or higher level. The hot rolling below the $Ar_3$ transformation temperature degrades Lankford value after annealing, and that range of temperature is specified. Nevertheless, under a condition where the hot rolling lubrication is sufficiently provided, the application of hot rolling in ferrite region does not degrade the characteristics of this invention.

As for the coiling of hot rolled sheet, the coiling temperature is maintained in a range of:

$$610-2000\times Sn \leqq CT(°C.) \leqq 710-2000\times Sn.$$

From the property, Sn is known as an element likely to segregate to grain boundaries. Therefore, the coiling is necessary to be carried out at a temperature corresponding to the Sn content to prevent excessive segregation of Sn to grain boundaries. FIG. 6 shows a relation between the grain boundary segregation index and Lankford value using the parameter of (CT+2000×Sn). The grain boundary segregation index increases with the increase of (CT+200×Sn) value.

The grain boundary segregation index expresses the rate of Sn segregating to the grain boundaries to total amount of Sn added. In a region of (CT+200×Sn) less than 610, the grain boundary segregation index is small, and the grain boundary segregation is suppressed. However, Lankford value becomes small, instead. In a region of (CT+200×Sn) above 710, the Lankford value increases, but the grain boundary segregation index also increases. In both above cases, the characteristics of steel sheet become insufficient, so that the coiling is needed to carry out in a temperature range of: $610-2000\times Sn \leqq CT\ (°C.) \leqq 710-2000\times Sn$.

The cold rolling after the coiling at the above specified temperature range and after the pickling allows to increase Lankford value with the increase of reduction ratio. However, a reduction ratio less than 70% can not give a high Lankford value, and a reduction ratio at 90% or above gives less effect of rolling. Accordingly, the reduction ratio is specified in that range.

The Ni-P coating is applied before the annealing, and it may be applied immediately after the pickling at the exit of the pickling line before the cold rolling or may be applied after the cold rolling succeeding to the pickling. Particularly when the coating is given before the cold rolling, there appears an advantage that no pickling is required as the cleaning and activating the sheet before coating.

Several methods for forming Ni-P alloy coating layer have been introduced. Among them, the electroplating or electroless coating (chemical coating) are preferred from the viewpoint of simplicity of operation and quality of obtained film.

The steel sheet coated with Ni-P alloy coating layer undergoes a heat treatment in a non-oxidizing atmosphere to form a diffused alloy layer consisting mainly of Fe-Ni-P at the interface between the base steel plate and the coating layer. The heat treatment for diffusion may be carried out in an ordinary annealing facility after cold rolling. In particular, a continuous annealing which has a high productivity is preferred. The continuous annealing may be carried out by a common continuous annealing facility for cold-rolled steel sheets and an annealing facility used as a pre-treatment unit of hot dip coating line. A preferred maximum temperature of the heat treatment is in a range of from 500° to 880°C., most preferably in a range of from 800° to 880°C. The temperature below 500° C. can not sufficiently form the diffused layer between the Ni-P alloy layer and the steel surface, and results in an insufficient dense rust formation during the corrosion process, which gives less improving effect on corrosion resistance. To obtain higher Lankford value, the temperature of 800° C. or more is preferred, and 820° C. is the more preferable lower limit. The annealing at above 880° C. likely induces pickup of metal onto the rolls in the heat treatment furnace, and tends to generate surface defects. The annealing at above 880° C. induces the growth of coarse ferrite grains to generate rough surface after press-forming. A preferred range of holding time at the maximum temperature of the steel sheet is 1 to 120 sec, though the holding time depends on the temperature. Too short holding time does not give the improving effect of corrosion resistance because sufficient diffused layer can not be formed.

An excessive holding time over 120sec. induces an excessive diffusion alloying, which results in a brittle interface layer to degrade the adhesiveness and workability of the coating layer because the sufficient diffused layer can not be formed. During the heat treatment, an excessive aging may be applied for several minutes at an approximate temperature range of from 300° to 400° C. A preferable depth of appropriate diffusion layer formed by the heat treatment is in a range of from 0.1 to 20 μm.

The heat treatment may be done in a direct fired heating furnace at a heating rate of 50° C./min. or more.

When a Ni-P alloy coating layer undergoes heat treatment, two types of coating structure appear. The one is that a part of the Ni-P alloy coating layer forms a diffused alloy layer and forms the steel sheet/diffused alloy layer/Ni-P alloy coating layer structure. The other is that all the Ni-P alloy coating layer forms a diffused alloy layer to give the steel sheet/diffused alloy layer structure. This invention includes both cases.

The heat-treated steel sheets are subjected to a temper-rolling under an appropriate condition, at need.

The steel sheets thus treated further undergo zinc electroplating or hot dip galvanizing in a zinc coating line.

Zinc electroplating bath may be sulfuric acid bath or chloride bath which are widely used. For further improvement of corrosion resistance, a chromate treatment may be applied on the zinc coating layer, and further an organic composite resin coating may be applied. As for the chromate treatment, either one of reaction type, electrolysis type, and application type is applicable. The chromate film may contain organic compound such as acrylic resin, oxide colloid such as silica colloid and alumna colloid, acid such as molybdenum acid, salt, or other corrosion-resistance-improving agent. The organic resin film which coats the chromate film may use epoxy resin as the base resin. The organic resin film preferably further contains an inhibitor additive such as silica and chromate at an approximate range of from 10 to 60 wt. %.

The steel sheets having the corrosion resistance and the deep drawing performance above described are quite suitable for automobile materials.

EXAMPLE

The following is a description of an example of this invention. Nevertheless, this invention naturally not restricted by the example.

The prepared test pieces were evaluated in terms of corrosion resistance and paintability conforming to the method and criteria given below.

(Method and criteria of evaluation)

(1) Corrosion resistance

The test piece is exposed to a corrosive condition of repeated drying and humidifying combined with salt solution spraying at a rate of 1 cycle per day. The resulted corrosion depth is measured to evaluate in accordance with the criterion given below.

○: the maximum corrosion depth is not deeper than 0.1 mm

Δ: the maximum corrosion depth is deeper than 0.1 mm and not deeper than 0.2 mm

X: the maximum corrosion depth is deeper than 0.2 mm (2) Paintability

The steel sheet is subjected to phosphate treatment and cation electrocoating. The coating layer is cut to the base steel surface using a knife and the steel sheet is exposed to the environment of (1) for 100 days. The blister generated at the cut area is observed and evaluated in accordance with the criterion given below.

○: the maximum blister width per side is not more than 1 mm

Δ: the maximum blister width per side is larger than 1 mm and not more than 3 mm X: the maximum blister width per side is larger than 3 mm (3) Workability The test piece undergoes the 180 degree bending test to observe the damage of coating layer at the tip of bent. The evaluation is given in accordance with the following criterion.

○: no damage or only fine cracks are observed

Δ: large crack is observed or partial separation of coating layer is observed

X: coating separation is observed in a wide range

EXAMPLE-16

The steels having the composition listed in Table 43 were melted and formed into slabs. Each of the slabs was hot-rolled under the condition of heating temperature of 1200° C., finish temperature of 900° C., and was coiled at 650° C. to obtain a hot-rolled sheet of 4.0 mm thick.

Then, the steel sheet was pickled and cold-rolled to 0.8 mm. The steel sheet was coated with Ni-P with P content of 12% and coating weight of 1 g/m$^2$. Two types of annealing were applied for separate steel sheet: namely, box annealing at 700° C., and continuous annealing at 850° C. After giving refining-rolling of 0.5%, the test pieces were taken for tensile test. The result is listed in Table 44. The table shows that the steels of this invention give higher Lankford value and superior corrosion resistance to comparative steels.

EXAMPLE-17

The steel sheets (No. 4, 9, 15, and 19) of this invention listed in Table 43 underwent the Ni-P coating with the P content of 12% and the coating weight of 1 g/m$^2$. These steel sheets were then treated under various conditions of hot rolling and coiling temperature, cold rolling reduction ratio, and annealing temperature listed in Table 45. The characteristics of these prepared steel sheets were analyzed. As seen in Table 46, all the tested steel sheets treated by the method of this invention have excellent properties giving Lankford value of 1.6 or higher.

EXAMPLE-18

The steel No. 4 of this invention shown in Table 43 was melted to form a slab. The slab was hot-rolled under the condition of heating temperature of 1200° C., finish temperature of 900° C., and coiling temperature of 650° C., to prepare the hot-rolled steel sheet of 4.0 mm thickness.

The sheet was pickled and cold-rolled to 0.8 mm thick. Then it was coated with Ni-P layer in a range specified in Table 47, followed by continuous annealing at a temperature range of from 800° to 880° C. and by temper-rolling of 0.5% and by Zn coating specified in Table 48 to prepare test pieces. The test result is summarized in Table 49 to Table 51. All the steel sheets of this invention tested showed excellent corrosion resistance, paintability, and workability.

EXAMPLE-19

The steel No.. 4 of this invention shown in Table 43 was melted to form a slab. The slab was hot-rolled under the condition of heating temperature of 1200° C., finish temperature of 900° C., and was coiled at a temperature of 650° C. to prepare the hot-rolled steel sheet of 4.0 mm thickness.

The sheet was pickled and coated separately with Ni-P (No. A, B, C, M, N, O and T) in a range specified in Table 47, followed by cold rolling to 0.8 mm thick and by continuous annealing in a temperature range of from 800° to 880° C. and by temper-rolling of 0.5% to prepare test pieces. The test result is summarized in Table 52. All the steel sheets of this invention tested showed excellent corrosion resistance, paintability, and workability.

TABLE 44-continued

| I | | Continious Annealinng | | | Box Annealing | | |
|---|---|---|---|---|---|---|---|
| or C** | Steel | TS (N/mm²) | rm | d | TS (N/mm²) | rm | d |
| I | 20 | 340 | 1.65 | ○ | 343 | 1.54 | ○ |
| C | 21 | 341 | 1.41 | ○ | 344 | 1.27 | ○ |

Notes)
(**)mark indicates that I: Example of the present invention; and C: Comparative example.
rm: Lankford value of annealed sheet (average of three direction)
TS: tensile strength of anealed sheet
d: evaluation of corrosion resistance (100 cycle)

TABLE 43

| | | Chemical composition (wt. %) | | | | | | | | | | | | | | | |
|---|---|---|---|---|---|---|---|---|---|---|---|---|---|---|---|---|---|
| I or C** | Steel | C | Si | Mn | P | S | sol. Al | N | Cu | Ni | Ti | Nb | B | Sn | F | P1 | P2 |
| C | 1 | 0.0034 | 0.02 | 0.20 | 0.024 | 0.005 | 0.041 | 0.0031 | 0.28 | 0.30 | 0.044 | 0.020 | 0.0010 | 0.0018* | 1.1* | 606 | 706 |
| I | 2 | 0.0021 | 0.01 | 0.17 | 0.027 | 0.007 | 0.034 | 0.0026 | 0.30 | 0.33 | 0.007 | 0.024 | 0.0007 | 0.003 | 2.1 | 604 | 704 |
| I | 3 | 0.0028 | 0.01 | 0.22 | 0.025 | 0.004 | 0.037 | 0.0023 | 0.32 | 0.32 | 0.016 | 0.043 | 0.0008 | 0.014 | 9.7 | 582 | 682 |
| I | 4 | 0.0033 | 0.02 | 0.19 | 0.022 | 0.009 | 0.040 | 0.0034 | 0.27 | 0.36 | 0.024 | 0.012 | 0.0011 | 0.029 | 19.5 | 552 | 652 |
| C | 5 | 0.0026 | 0.02 | 0.18 | 0.023 | 0.006 | 0.053 | 0.0025 | 0.29 | 0.31 | 0.034 | 0.032 | 0.0013 | 0.055* | 35.5* | 500 | 600 |
| C | 6 | 0.0032 | 0.02 | 0.18 | 0.017* | 0.005 | 0.053 | 0.0027 | 0.28 | 0.34 | 0.022 | 0.031 | 0.0008 | 0.021 | 13.7 | 568 | 668 |
| I | 7 | 0.0027 | 0.03 | 0.23 | 0.023 | 0.009 | 0.049 | 0.0031 | 0.41 | 0.37 | 0.007 | 0.040 | 0.0014 | 0.024 | 19.8 | 562 | 662 |
| I | 8 | 0.0041 | 0.01 | 0.21 | 0.044 | 0.006 | 0.041 | 0.0024 | 0.33 | 0.28 | 0.072 | 0.008 | 0.0018 | 0.018 | 12.6 | 574 | 674 |
| I | 9 | 0.0029 | 0.02 | 0.20 | 0.067 | 0.007 | 0.060 | 0.0030 | 0.29 | 0.12 | 0.057 | 0.021 | 0.0011 | 0.022 | 12.0 | 566 | 666 |
| I | 10 | 0.0030 | 0.01 | 0.22 | 0.093 | 0.008 | 0.054 | 0.0032 | 0.22 | 0.40 | 0.043 | 0.030 | 0.0006 | 0.020 | 16.1 | 570 | 670 |
| C | 11 | 0.0025 | 0.01 | 0.19 | 0.104* | 0.007 | 0.057 | 0.0029 | 0.47 | 0.25 | 0.024 | 0.015 | 0.0009 | 0.021 | 19.5 | 568 | 668 |
| C | 12 | 0.0045 | 0.03 | 0.15 | 0.058 | 0.006 | 0.058 | 0.0033 | 0.16* | 0.38 | 0.063 | 0.047 | 0.0014 | 0.015 | 9.8 | 580 | 680 |
| I | 13 | 0.0024 | 0.01 | 0.26 | 0.052 | 0.004 | 0.037 | 0.0019 | 0.23 | 0.45 | 0.054 | 0.019 | 0.0009 | 0.024 | 18.8 | 562 | 662 |
| I | 14 | 0.0033 | 0.02 | 0.18 | 0.046 | 0.009 | 0.045 | 0.0022 | 0.35 | 0.37 | 0.047 | 0.014 | 0.0011 | 0.008 | 6.5 | 594 | 694 |
| I | 15 | 0.0029 | 0.02 | 0.17 | 0.047 | 0.005 | 0.050 | 0.0035 | 0.47 | 0.34 | 0.095 | 0.035 | 0.0018 | 0.018 | 16.3* | 574 | 674 |
| C | 16 | 0.0027 | 0.01 | 0.23 | 0.045 | 0.007 | 0.048 | 0.0024 | 0.53* | 0.42 | 0.042 | 0.033 | 0.0008 | 0.040 | 41.6* | 530 | 630 |
| C | 17 | 0.0016 | 0.12 | 0.14 | 0.049 | 0.008 | 0.060 | 0.0018 | 0.33 | 0.07* | 0.094 | 0.042 | 0.0011 | 0.018 | 9.0 | 574 | 674 |
| I | 18 | 0.0025 | 0.07 | 0.17 | 0.048 | 0.004 | 0.044 | 0.0031 | 0.31 | 0.12 | 0.063 | 0.031 | 0.0009 | 0.020 | 10.5 | 570 | 670 |
| I | 19 | 0.0014 | 0.41 | 0.13 | 0.052 | 0.006 | 0.049 | 0.0020 | 0.36 | 0.29 | 0.010 | 0.021 | 0.0013 | 0.023 | 17.3 | 564 | 664 |
| I | 20 | 0.0033 | 0.08 | 0.16 | 0.050 | 0.005 | 0.045 | 0.0024 | 0.35 | 0.48 | 0.027 | 0.015 | 0.0007 | 0.021 | 19.5 | 568 | 668 |
| C | 21 | 0.0041 | 0.31 | 0.19 | 0.047 | 0.007 | 0.052 | 0.0029 | 0.28 | 0.55* | 0.060 | 0.023 | 0.0010 | 0.025 | 23.1 | 560 | 660 |

Notes)
(**)mark indicates that; I: Example of the present invention, C: Comparative example
(*)mark indicates that those are out of the range of the present invention
F: 1000 × Sn × (2 × P + Cu + Ni) (Unit of Sn, P, Cu, and Ni is wt. %)
P1: 610 − 2000 × Sn
P2: 710 − 2000 × Sn

TABLE 44

| I | | Continious Annealinng | | | Box Annealing | | |
|---|---|---|---|---|---|---|---|
| or C** | Steel | TS (N/mm²) | rm | d | TS (N/mm²) | rm | d |
| C | 1 | 319 | 1.93 | Δ | 323 | 1.84 | Δ |
| I | 2 | 325 | 1.89 | ○ | 330 | 1.75 | ○ |
| I | 3 | 340 | 1.89 | ○ | 336 | 1.83 | ○ |
| I | 4 | 353 | 1.83 | ○ | 355 | 1.68 | ○ |
| C | 5 | 360 | 1.60 | ○ | 365 | 1.45 | ○ |
| C | 6 | 312 | 1.92 | Δ | 311 | 1.76 | Δ |
| I | 7 | 326 | 1.89 | ○ | 331 | 1.72 | ○ |
| I | 8 | 341 | 1.83 | ○ | 345 | 1.68 | ○ |
| I | 9 | 359 | 1.77 | ○ | 368 | 1.64 | ○ |
| I | 10 | 386 | 1.70 | ○ | 392 | 1.56 | ○ |
| C | 11 | 390 | 1.29 | ○ | 399 | 1.11 | ○ |
| C | 12 | 317 | 1.95 | Δ | 318 | 1.81 | Δ |
| I | 13 | 325 | 1.92 | ○ | 329 | 1.76 | ○ |
| I | 14 | 327 | 1.86 | ○ | 325 | 1.74 | ○ |
| I | 15 | 335 | 1.71 | ○ | 331 | 1.60 | ○ |
| C | 16 | 340 | 1.50 | ○ | 337 | 1.40 | ○ |
| C | 17 | 312 | 1.75 | Δ | 315 | 1.64 | Δ |
| I | 18 | 320 | 1.73 | ○ | 323 | 1.55 | ○ |
| I | 19 | 327 | 1.68 | ○ | 331 | 1.53 | ○ |

TABLE 45

| I or C** | No. | Steel | CT (°C.) | CR (%) | Ann. (°C.) |
|---|---|---|---|---|---|
| I | 1 | 4 | 630 | 80 | 830 |
| I | 2 | 4 | 620 | 80 | 870 |
| C | 3 | 4 | 530* | 80 | 850 |
| C | 4 | 9 | 540* | 78 | 850 |
| C | 5 | 9 | 690* | 78 | 850 |
| I | 6 | 9 | 640 | 80 | 860 |
| I | 7 | 9 | 645 | 85 | 860 |
| C | 8 | 15 | 630 | 83 | 780* |
| C | 9 | 15 | 630 | 83 | 890* |
| I | 10 | 15 | 650 | 80 | 820 |
| I | 11 | 15 | 655 | 80 | 880 |
| C | 12 | 19 | 650 | 66* | 860 |
| I | 13 | 19 | 645 | 75 | 860 |
| I | 14 | 19 | 640 | 84 | 860 |
| C | 15 | 19 | 650 | 92* | 860 |

Notes)
(**)mark indicates that I: Example of the present invention; and C: Comparative example. (Those with (*) mark are out of the range of the present invention).
CT: coiling temperaturer TABLE 45-continued

| I or C** | No. | Steel | CT (°C.) | CR (%) | Ann. (°C.) |
|---|---|---|---|---|---|

CR: cold reduction ratio
Ann.: annealing temperature

TABLE 46

| I or C** | No. | Steel | YP N/mm² | TS N/mm² | El % | n value | r value |
|---|---|---|---|---|---|---|---|
| I | 1 | 4 | 211 | 355 | 40.0 | 0.239 | 1.78 |
| I | 2 | 4 | 196 | 338 | 42.3 | 0.260 | 1.83 |
| C | 3 | 4 | 202 | 348 | 36.0 | 0.235 | 1.55 |
| C | 4 | 9 | 209 | 370 | 35.5 | 0.227 | 1.45 |
| C | 5 | 9 | 214 | 373 | 37.8 | 0.232 | 1.61 |
| I | 6 | 9 | 211 | 366 | 42.1 | 0.244 | 1.75 |
| I | 7 | 9 | 220 | 362 | 42.8 | 0.253 | 1.83 |
| C | 8 | 15 | 208 | 349 | 38.3 | 0.246 | 1.62 |
| C | 9 | 15 | 191 | 333 | 42.1 | 0.251 | 1.79 |
| I | 10 | 15 | 210 | 350 | 41.6 | 0.243 | 1.84 |
| I | 11 | 15 | 208 | 348 | 40.9 | 0.248 | 1.82 |
| C | 12 | 19 | 209 | 343 | 36.5 | 0.222 | 1.57 |
| I | 13 | 19 | 210 | 333 | 38.7 | 0.240 | 1.66 |
| I | 14 | 19 | 202 | 323 | 41.4 | 0.250 | 1.75 |
| C | 15 | 19 | 193 | 320 | 42.1 | 0.250 | 1.77 |

Notes)
(**)mark indicates that I: Example of the present invention; and C: Comparative example.
YP: yield strength
TS: tensile strength
El: elongation
r: Lankford value

TABLE 47

| | P wt. % | Other component wt. % | Coating weight g/m² | |
|---|---|---|---|---|
| A | 8 | — | 1.0 | Example of the present invention |
| B | 12 | — | 0.1 | |
| C | 12 | — | 1.0 | |
| D | 12 | — | 8.0 | |
| E | 12 | 12%Cu | 1.0 | |
| F | 12 | 8%Mo | 1.0 | |
| G | 12 | 12%W | 1.0 | |
| H | 12 | 5%Cr | 1.0 | |
| I | 12 | 1%Mo—5%Cu | 1.0 | |
| J | 12 | 8%Cu—5%Cr | 1.0 | |
| K | 12 | 8%Cu—5%W | 1.0 | |
| L | 18 | — | 1.0 | |
| M | 6 | — | 1.0 | Comparative example |
| N | 12 | — | 0.05 | |
| O | 12 | — | 10.0 | |
| P | 12 | 16%W | 1.0 | |
| Q | 12 | 16%Mo | 1.0 | |
| R | 12 | 8%Cu—16%W | 1.0 | |
| S | 12 | 8%Cu—16%Mo | 1.0 | |
| T | — | — | — | |

TABLE 48

| No. | Coating type | Other component wt. % | Coating weight g/m² |
|---|---|---|---|
| I | Electrolytic Zn coating | 100%Zn | 20.0 |
| II | Electrolytic Zn—Ni coating | 12%Ni | 5.0 |
| III | Electrolytic Zn—Fe coating | 15%Fe | 10.0 |
| IV | Electrolytic Zn—Cr coating | 12%Cr | 10.0 |
| V | Electrolytic Zn—Mn coating | 60%Mn | 10.0 |
| VI | Electrolytic Zn—$SiO_2$ coating | 5%$SiO_2$ | 10.0 |
| VII | Electrolytic Zn—Co—Cr—$All_2O_3$ coating | 1%Co, 1%Cr, 0.2%$Al_2O_3$ | 10.0 |
| VIII | Electrolytic Zn—$Cr(OH)_3$ coating | 3%$Cr(OH)_3$ | 10.0 |
| IX | Alloy hot dip Zn coating | 11%Fe, 0.13%Al | 45.0 |
| X | Hot dip Zn coating | 0.15%Al | 30.0 |
| XI | Alloy hot dip Zn coating | 11%Fe, 0.13%Al | 60.0 |
| XII | Electrolytic Zn coating | 100%Zn | 70.0 |

Notes)
XII: Comparative example.

TABLE 49

| No. | Ni—P coating | Zn coating | Corrosion resistance 100 cycles | Paintability 100 cycles | Workability | Remarks |
|---|---|---|---|---|---|---|
| 1 | A | I | ○ | ○ | ○ | |
| 2 | A | II | ○ | ○ | ○ | |
| 3 | A | III | ○ | ○ | ○ | |
| 4 | A | IV | ○ | ○ | ○ | |
| 5 | A | V | ○ | ○ | ○ | |
| 6 | A | VI | ○ | ○ | ○ | |
| 7 | A | VII | ○ | ○ | ○ | |
| 8 | A | VIII | ○ | ○ | ○ | |
| 9 | A | IX | ○ | ○ | ○ | |
| 10 | A | X | ○ | ○ | ○ | |
| 11 | A | XI | ○ | ○ | ○ | |
| 12 | A | XII | ○ | ○ | X | Comparative example |
| 13 | B | I | ○ | ○ | ○ | |
| 14 | B | II | ○ | ○ | ○ | |
| 15 | B | III | ○ | ○ | ○ | |
| 16 | B | IV | ○ | ○ | ○ | |
| 17 | B | V | ○ | ○ | ○ | |
| 18 | B | VI | ○ | ○ | ○ | |
| 19 | B | VII | ○ | ○ | ○ | |
| 20 | B | VIII | ○ | ○ | ○ | |
| 21 | B | IX | ○ | ○ | ○ | |
| 22 | B | X | ○ | ○ | ○ | |
| 23 | B | XI | ○ | ○ | ○ | |
| 24 | B | XII | ○ | ○ | X | Comparative example |
| 25 | C | I | ○ | ○ | ○ | |
| 26 | C | II | ○ | ○ | ○ | |
| 27 | C | III | ○ | ○ | ○ | |
| 28 | C | IV | ○ | ○ | ○ | |
| 29 | C | V | ○ | ○ | ○ | |
| 30 | C | VI | ○ | ○ | ○ | |
| 31 | C | VII | ○ | ○ | ○ | |
| 32 | C | VIII | ○ | ○ | ○ | |
| 33 | C | IX | ○ | ○ | ○ | |
| 34 | C | X | ○ | ○ | ○ | |
| 35 | C | XI | ○ | ○ | ○ | |
| 36 | C | XII | ○ | ○ | X | Comparative example |
| 37 | D | I | ○ | ○ | ○ | |
| 38 | D | II | ○ | ○ | ○ | |
| 39 | D | III | ○ | ○ | ○ | |
| 40 | D | IV | ○ | ○ | ○ | |
| 41 | D | V | ○ | ○ | ○ | |
| 42 | D | VI | ○ | ○ | ○ | |
| 43 | D | VII | ○ | ○ | ○ | |
| 44 | D | VIII | ○ | ○ | ○ | |
| 45 | D | IX | ○ | ○ | ○ | |
| 46 | D | X | ○ | ○ | ○ | |
| 47 | D | XI | ○ | ○ | ○ | |
| 48 | D | XII | ○ | ○ | X | Comparative example |
| 49 | E | I | ○ | ○ | ○ | |
| 50 | E | II | ○ | ○ | ○ | |

TABLE 49-continued

| No. | Ni—P coating | Zn coating | Corrosion resistance 100 cycles | Paint-ability 100 cycles | Work-ability | Remarks |
|---|---|---|---|---|---|---|
| 51 | E | III | ○ | ○ | ○ | |
| 52 | E | IV | ○ | ○ | ○ | |
| 53 | E | V | ○ | ○ | ○ | |
| 54 | E | VI | ○ | ○ | ○ | |
| 55 | E | VII | ○ | ○ | ○ | |
| 56 | E | VIII | ○ | ○ | ○ | |
| 57 | E | IX | ○ | ○ | ○ | |
| 58 | E | X | ○ | ○ | ○ | |
| 59 | E | XI | ○ | ○ | ○ | |
| 60 | E | XII | ○ | ○ | X | Comparative example |
| 61 | F | I | ○ | ○ | ○ | |
| 62 | F | II | ○ | ○ | ○ | |
| 63 | F | III | ○ | ○ | ○ | |
| 64 | F | IV | ○ | ○ | ○ | |
| 65 | F | V | ○ | ○ | ○ | |
| 66 | F | VI | ○ | ○ | ○ | |
| 67 | F | VII | ○ | ○ | ○ | |
| 68 | F | VIII | ○ | ○ | ○ | |
| 69 | F | IX | ○ | ○ | ○ | |
| 70 | F | X | ○ | ○ | ○ | |
| 71 | F | XI | ○ | ○ | ○ | |
| 72 | F | XII | ○ | ○ | X | Comparative example |
| 73 | G | I | ○ | ○ | ○ | |
| 74 | G | II | ○ | ○ | ○ | |
| 75 | G | III | ○ | ○ | ○ | |
| 76 | G | IV | ○ | ○ | ○ | |
| 77 | G | V | ○ | ○ | ○ | |
| 78 | G | VI | ○ | ○ | ○ | |
| 79 | G | VII | ○ | ○ | ○ | |
| 80 | G | VIII | ○ | ○ | ○ | |
| 81 | G | IX | ○ | ○ | ○ | |
| 82 | G | X | ○ | ○ | ○ | |
| 83 | G | XI | ○ | ○ | ○ | |
| 84 | G | XII | ○ | ○ | X | Comparative example |
| 85 | H | I | ○ | ○ | ○ | |
| 86 | H | II | ○ | ○ | ○ | |
| 87 | H | III | ○ | ○ | ○ | |
| 88 | H | IV | ○ | ○ | ○ | |
| 89 | H | V | ○ | ○ | ○ | |
| 90 | H | VI | ○ | ○ | ○ | |
| 91 | H | VII | ○ | ○ | ○ | |
| 92 | H | VIII | ○ | ○ | ○ | |
| 93 | H | IX | ○ | ○ | ○ | |
| 94 | H | X | ○ | ○ | ○ | |
| 95 | H | XI | ○ | ○ | ○ | |
| 96 | H | XII | ○ | ○ | X | Comparative example |

TABLE 50

| No. | Ni—P coating | Zn coating | Corrosion resistance 100 cycles | Paint-ability 100 cycles | Work-ability | Remarks |
|---|---|---|---|---|---|---|
| 97 | I | I | ○ | ○ | ○ | |
| 98 | I | II | ○ | ○ | ○ | |
| 99 | I | III | ○ | ○ | ○ | |
| 100 | I | IV | ○ | ○ | ○ | |
| 101 | I | V | ○ | ○ | ○ | |
| 102 | I | VI | ○ | ○ | ○ | |
| 103 | I | VII | ○ | ○ | ○ | |
| 104 | I | VIII | ○ | ○ | ○ | |
| 105 | I | IX | ○ | ○ | ○ | |
| 106 | I | X | ○ | ○ | ○ | |
| 107 | I | XI | ○ | ○ | ○ | |
| 108 | I | XII | ○ | ○ | X | Comparative example |

TABLE 50-continued

| No. | Ni—P coating | Zn coating | Corrosion resistance 100 cycles | Paint-ability 100 cycles | Work-ability | Remarks |
|---|---|---|---|---|---|---|
| 109 | J | I | ○ | ○ | ○ | |
| 110 | J | II | ○ | ○ | ○ | |
| 111 | J | III | ○ | ○ | ○ | |
| 112 | J | IV | ○ | ○ | ○ | |
| 113 | J | V | ○ | ○ | ○ | |
| 114 | J | VI | ○ | ○ | ○ | |
| 115 | J | VII | ○ | ○ | ○ | |
| 116 | J | VIII | ○ | ○ | ○ | |
| 117 | J | IX | ○ | ○ | ○ | |
| 118 | J | X | ○ | ○ | ○ | |
| 119 | J | XI | ○ | ○ | ○ | |
| 120 | J | XII | ○ | ○ | X | Comparative example |
| 121 | K | I | ○ | ○ | ○ | |
| 122 | K | II | ○ | ○ | ○ | |
| 123 | K | III | ○ | ○ | ○ | |
| 124 | K | IV | ○ | ○ | ○ | |
| 125 | K | V | ○ | ○ | ○ | |
| 126 | K | VI | ○ | ○ | ○ | |
| 127 | K | VII | ○ | ○ | ○ | |
| 128 | K | VIII | ○ | ○ | ○ | |
| 129 | K | IX | ○ | ○ | ○ | |
| 130 | K | X | ○ | ○ | ○ | |
| 131 | K | XI | ○ | ○ | ○ | |
| 132 | K | XII | ○ | ○ | X | Comparative example |
| 133 | L | I | ○ | ○ | ○ | |
| 134 | L | II | ○ | ○ | ○ | |
| 135 | L | III | ○ | ○ | ○ | |
| 136 | L | IV | ○ | ○ | ○ | |
| 137 | L | V | ○ | ○ | ○ | |
| 138 | L | VI | ○ | ○ | ○ | |
| 139 | L | VII | ○ | ○ | ○ | |
| 140 | L | VIII | ○ | ○ | ○ | |
| 141 | L | IX | ○ | ○ | ○ | |
| 142 | L | X | ○ | ○ | ○ | |
| 143 | L | XI | ○ | ○ | ○ | |
| 144 | L | XII | ○ | ○ | X | Comparative example |
| 145 | M | I | Δ | Δ | ○ | Comparative example |
| 146 | M | II | Δ | Δ | ○ | Comparative example |
| 147 | M | III | Δ | Δ | ○ | Comparative example |
| 148 | M | IV | Δ | Δ | ○ | Comparative example |
| 149 | M | V | Δ | Δ | ○ | Comparative example |
| 150 | M | VI | Δ | Δ | ○ | Comparative example |
| 151 | M | VII | Δ | Δ | ○ | Comparative example |
| 152 | M | VIII | Δ | Δ | ○ | Comparative example |
| 153 | M | IX | Δ | Δ | ○ | Comparative example |
| 154 | M | X | Δ | Δ | ○ | Comparative example |
| 155 | M | XI | Δ | Δ | ○ | Comparative example |
| 156 | M | XII | Δ | Δ | X | Comparative example |
| 157 | N | I | Δ | Δ | ○ | Comparative example |
| 158 | N | II | Δ | Δ | ○ | Comparative example |
| 159 | N | III | Δ | Δ | ○ | Comparative example |
| 160 | N | IV | Δ | Δ | ○ | Comparative example |
| 161 | N | V | Δ | Δ | ○ | Comparative |

TABLE 50-continued

| No. | Ni—P coating | Zn coating | Corrosion resistance 100 cycles | Paintability 100 cycles | Workability | Remarks |
|---|---|---|---|---|---|---|
| | | | | | | example |
| 162 | N | VI | Δ | Δ | ○ | Comparative example |
| 163 | N | VII | Δ | Δ | ○ | Comparative example |
| 164 | N | VIII | Δ | Δ | ○ | Comparative example |
| 165 | N | IX | Δ | Δ | ○ | Comparative example |
| 166 | N | X | Δ | Δ | ○ | Comparative example |
| 167 | N | XI | Δ | Δ | ○ | Comparative example |
| 168 | N | XII | Δ | Δ | X | Comparative example |
| 169 | O | I | ○ | ○ | X | Comparative example |
| 170 | O | II | ○ | ○ | X | Comparative example |
| 171 | O | III | ○ | ○ | X | Comparative example |
| 172 | O | IV | ○ | ○ | X | Comparative example |
| 173 | O | V | ○ | ○ | X | Comparative example |
| 174 | O | VI | ○ | ○ | X | Comparative example |
| 175 | O | VII | ○ | ○ | X | Comparative example |
| 176 | O | VIII | ○ | ○ | X | Comparative example |
| 177 | O | IX | ○ | ○ | X | Comparative example |
| 178 | O | X | ○ | ○ | X | Comparative example |
| 179 | O | XI | ○ | ○ | X | Comparative example |
| 180 | O | XII | ○ | ○ | X | Comparative example |
| 181 | P | I | ○ | ○ | Δ | Comparative example |
| 182 | P | II | ○ | ○ | Δ | Comparative example |
| 183 | P | III | ○ | ○ | Δ | Comparative example |
| 184 | P | IV | ○ | ○ | Δ | Comparative example |
| 185 | P | V | ○ | ○ | Δ | Comparative example |
| 186 | P | VI | ○ | ○ | Δ | Comparative example |
| 187 | P | VII | ○ | ○ | Δ | Comparative example |
| 188 | P | VIII | ○ | ○ | Δ | Comparative example |
| 189 | P | IX | ○ | ○ | Δ | Comparative example |
| 190 | P | X | ○ | ○ | Δ | Comparative example |
| 191 | P | XI | ○ | ○ | Δ | Comparative example |
| 192 | P | XII | ○ | ○ | X | Comparative example |

TABLE 51

| No. | Ni—P coating | Zn coating | Corrosion resistance 100 cycles | Paintability 100 cycles | Workability | Remarks |
|---|---|---|---|---|---|---|
| 193 | Q | I | ○ | ○ | Δ | Comparative example |
| 194 | Q | II | ○ | ○ | Δ | Comparative example |
| 195 | Q | III | ○ | ○ | Δ | Comparative example |
| 196 | Q | IV | ○ | ○ | Δ | Comparative example |
| 197 | Q | V | ○ | ○ | Δ | Comparative example |
| 198 | Q | VI | ○ | ○ | Δ | Comparative example |
| 199 | Q | VII | ○ | ○ | Δ | Comparative example |
| 200 | Q | VIII | ○ | ○ | Δ | Comparative example |
| 201 | Q | IX | ○ | ○ | Δ | Comparative example |
| 202 | Q | X | ○ | ○ | Δ | Comparative example |
| 203 | Q | XI | ○ | ○ | Δ | Comparative example |
| 204 | Q | XII | ○ | ○ | X | Comparative example |
| 205 | R | I | ○ | ○ | X | Comparative example |
| 206 | R | II | ○ | ○ | X | Comparative example |
| 207 | R | III | ○ | ○ | X | Comparative example |
| 208 | R | IV | ○ | ○ | X | Comparative example |
| 209 | R | V | ○ | ○ | X | Comparative example |
| 210 | R | VI | ○ | ○ | X | Comparative example |
| 211 | R | VII | ○ | ○ | X | Comparative example |
| 212 | R | VIII | ○ | ○ | X | Comparative example |
| 213 | R | IX | ○ | ○ | X | Comparative example |
| 214 | R | X | ○ | ○ | X | Comparative example |
| 215 | R | XI | ○ | ○ | X | Comparative example |
| 216 | R | XII | ○ | ○ | X | Comparative example |
| 217 | R | I | ○ | ○ | X | Comparative example |
| 218 | S | II | ○ | ○ | X | Comparative example |
| 219 | S | III | ○ | ○ | X | Comparative example |
| 220 | S | IV | ○ | ○ | X | Comparative example |
| 221 | S | V | ○ | ○ | X | Comparative example |
| 222 | S | VI | ○ | ○ | X | Comparative example |
| 223 | S | VII | ○ | ○ | X | Comparative example |
| 224 | S | VIII | ○ | ○ | X | Comparative example |
| 225 | S | IX | ○ | ○ | X | Comparative example |
| 226 | S | X | ○ | ○ | X | Comparative example |
| 227 | S | XI | ○ | ○ | X | Comparative example |
| 228 | S | XII | ○ | ○ | X | Comparative example |
| 229 | S | I | X | X | ○ | Comparative |

TABLE 51-continued

| No. | Ni—P coating | Zn coating | Corrosion resistance 100 cycles | Paint-ability 100 cycles | Work-ability | Remarks |
|---|---|---|---|---|---|---|
| | | | | | | example |
| 230 | T | II | X | X | ○ | Comparative example |
| 231 | T | III | X | X | ○ | Comparative example |
| 232 | T | IV | X | X | ○ | Comparative example |
| 233 | T | V | X | X | ○ | Comparative example |
| 234 | T | VI | X | X | ○ | Comparative example |
| 235 | T | VII | X | X | ○ | Comparative example |
| 236 | T | VIII | X | X | ○ | Comparative example |
| 237 | T | IX | X | X | ○ | Comparative example |
| 238 | T | X | X | X | ○ | Comparative example |
| 239 | T | XI | X | X | ○ | Comparative example |
| 240 | T | XII | X | X | X | Comparative example |

TABLE 52

| No. | Steel sheet | Ni—P coating | Zn coating | Corrosion resistance 100 cycle | Paint-ability 100 cycle | Paint-ability 100 cycle | Remarks |
|---|---|---|---|---|---|---|---|
| 1 | 3 | A | I | ○ | ○ | ○ | |
| 2 | 3 | A | IX | ○ | ○ | ○ | |
| 3 | 3 | B | I | ○ | ○ | ○ | |
| 4 | 3 | B | IX | ○ | ○ | ○ | |
| 5 | 3 | C | I | ○ | ○ | ○ | |
| 6 | 3 | C | IX | ○ | ○ | ○ | |
| 7 | 3 | M | I | Δ | Δ | ○ | Comparative example |
| 8 | 3 | M | IX | Δ | Δ | ○ | Comparative example |
| 9 | 3 | N | I | Δ | Δ | ○ | Comparative example |
| 10 | 3 | N | IX | Δ | Δ | ○ | Comparative example |
| 11 | 3 | O | I | ○ | ○ | X | Comparative example |
| 12 | 3 | O | IX | ○ | ○ | X | Comparative example |
| 13 | 3 | T | I | X | X | ○ | Comparative example |
| 14 | 3 | T | IX | X | X | ○ | Comparative example |

What is claimed is:

1. A surface treated steel sheet comprising:

a steel sheet consisting essentially of:

0.001 to 0.005 wt. % C, 0.1 wt. % or less Si, 0.05 to 0.3 wt. % Mn, 0.02 wt. % or less P, 0.001 to 0.01 wt. % S, 0.004 wt. % or less N, 0.1 wt. % or less sol.Al, 0.05 to 0.3 wt. % Ni, 0.005 to 0.1 wt. % Ti, 0.05 to 0.3 wt. % Cu, 0.0002 to 0.002 wt. % B, and the balance being Fe;

S and Cu satisfying the following equation;

$$(S\ wt.\ \%/Cu\ wt.\ \%) \leqq 0.1;$$

a diffused alloy layer containing Fe, Ni, and P, the diffused alloy layer being formed on at least one surface of the steel sheet.

2. The surface treated steel sheet of claim 1, wherein the diffused alloy layer further contains at least one element selected from the group consisting of W, Mo, Cr, and Cu.

3. The surface treated steel sheet of claim 1, wherein the C content is from 0.001 to 0.003 wt. %.

4. A surface treated steel sheet comprising:

a steel sheet consisting essentially of:

0.001 to 0.005 wt. % C, 0.1 wt. % or less Si, 0.05 to 0.3 wt. % Mn, 0.02 wt. % or less P, 0.001 to 0.01 wt. % S, 0.004 wt. % or less N, 0.1 wt. % or less sol.Al, 0.05 to 0.3 wt. % Ni, 0.005 to 0.1 wt. % Ti, 0.05 to 0.3 wt. % Cu, 0.0002 to 0.002 wt. % B, and the balance being Fe;

S and Cu satisfying the following equation;

$$(S\ wt.\ \%/Cu\ wt.\ \%) \leqq 0.1;$$

a diffused alloy layer containing Fe, Ni, and P, the diffused alloy layer being formed on at least one surface of the steel sheet; and a zinc-system coating layer formed on the diffused alloy layer.

5. The surface treated steel sheet of claim 4, wherein the zinc-system coating layer is a zinc coating layer.

6. The surface treated steel sheet of claim 4, wherein the zinc-system coating layer contains Zn as matrix and at least one metal selected from the group consisting of Ni, Fe, Co, Mn, Ti, Mo, Si, and Al as an alloy.

7. The surface treated steel sheet of claim 4, wherein the zinc-system coating layer contains Zn as matrix and at least one oxide of Ni, Fe, Co, Mn, Ti, Mo, Si or Al as dispersed particles.

8. The surface treated steel sheet of claim 4, wherein the diffused alloy layer further contains at least one element selected from the group consisting of W, Mo, Cr, and Cu.

9. The surface treated steel sheet of claim 4, wherein the C content is from 0.001 to 0.003 wt. %.

10. A surface treated steel sheet comprising:

a steel sheet consisting essentially of:

0.001 to 0.006 wt. % C, less than 0.35 wt. % Si, 0.05 to 0.5 wt. % Mn, 0.03 to 0.08 wt. % P, less than 0.01 wt. % S, 0.01 to 0.1 wt. % sol.Al, 0.0035 wt. % or less N, 0.1 to 0.5 wt. % Cu, 0.1 to 0.5 wt. % Ni, 0.01 to 0.06 wt. % Ti, 0.003 to 0.015 wt. % Nb, 0.0002 to 0.002 wt. % B, and the balance being Fe;

the steel having the composition satisfying the following equations;

$$(P\ wt.\ \%/200) \leqq B\ wt.\ \%,$$

$$4 \times C\ wt.\ \% < Ti\ wt.\ \% - (48/14) \times N\ wt.\ \% - (48/32) \times S\ wt.\ \%,$$

$$0.004 \leqq Nb\ wt.\ \% \times (10 \times P\ wt.\ \% + 2 \times Cu\ wt.\ \% + Ni\ wt.\ \%)$$

a diffused alloy layer containing Fe, Ni, and P, the diffused alloy layer being formed on at least one surface of the steel sheet.

11. The surface treated steel sheet of claim 10, wherein the diffused alloy layer further contains at least one element selected from the group consisting of W, Mo, Cr, and Cu.

12. The surface treated steel sheet of claim 10, wherein the surface treated steel sheet has an average surface roughness, Rz, of ten measured points in a range of from 1 to 8 μm, and Rz satisfies the following equation;

$$Rz \times S/(10 \times P+2 \times Cu+Ni) \leqq 0.025.$$

13. A surface treated steel sheet comprising:

a steel sheet consisting essentially of:

0.001 to 0.006 wt. % C, less than 0.35 wt. % Si, 0.05 to 0.5 wt. % Mn, 0.03 to 0.08 wt. % P, less than 0.01 wt. % S, 0.01 to 0.1 wt. % sol.Al, 0.0035 wt. % or less N, 0.1 to 0.5 wt. % Cu, 0.1 to 0.5 wt. % Ni, 0.01 to 0.06 wt. % Ti, 0.003 to 0.015 wt. % Nb, 0.0002 to 0.002 wt. % B, and the balance being Fe;

the steel having the composition satisfying the following equations;

$$(P \text{ wt. } \%/200) \leqq B \text{ wt. } \%,$$

$$4 \times C \text{ wt. } \% < Ti \text{ wt. } \% - (48/14) \times N \text{ wt. } \% - (48/32) \times S \text{ wt. } \%,$$

$$0.004 \leqq Nb \text{ wt. } \% \times (10 \times P \text{ wt. } \% + 2 \times Cu \text{ wt. } \% + Ni \text{ wt. } \%)$$

a diffused alloy layer containing Fe, Ni, and P, the diffused alloy layer being formed on at least one surface of the steel sheet; and a zinc-system coating layer formed on the diffused alloy layer.

14. The surface treated steel sheet of claim 13, wherein the zinc-system coating layer is a zinc coating layer.

15. The surface treated steel sheet of claim 13, wherein the zinc-system coating layer contains Zn as matrix and at least one metal selected from the group consisting of Ni, Fe, Co, Mn, Ti, Mo, Si and Al as an alloy.

16. The surface treated steel sheet of claim 13, wherein the zinc-system coating layer contains Zn as matrix and at least one oxide of Ni, Fe, Co, Mn, Ti, Mo, Si and Al as dispersed particles.

17. The surface treated steel sheet of claim 13, wherein the diffused alloy layer further contains at least one element selected from the group consisting of W, Mo, Cr, and Cu.

18. The surface treated steel sheet of claim 13, wherein the surface treated steel sheet has an average surface roughness, Rz, of ten measured points in a range of from 1 to 8 μm, and Rz satisfies the following equation;

$$Rz \times S/(10 \times P+2 \times Cu+Ni) \leqq 0.025.$$

19. A surface treated steel sheet comprising:

a steel sheet consisting essentially of:

0.002 to 0.01 wt. % C, 1 wt. % or less Si, 0.05 to 1 wt. % Mn, 0.02 to 0.1 wt. % P, 0.01 wt. % or less S, 0.1 wt. % or less sol.Al, 0.004 wt. % or less N, 0.0005 to 0.002 wt. % B, 0.2 to 0.5 wt. % Cu, 0.1 to 0.5 wt. % Ni, 0.002 to 0.05 wt. % Sn, and at least one element selected from the group consisting of 0.005 to 0.1 wt. % Ti and 0.002 to 0.05 wt. % Nb, and the balance being Fe;

the steel having the composition satisfying the following equation:

$$2 \leqq 1000 \times Sn \text{ wt. } \% \times (2 \times P \text{ wt. } \% + Cu \text{ wt. } \% + Ni \text{ wt. } \%) \leqq 20;$$

a diffused alloy layer containing Fe, Ni and P, the diffused alloy layer being formed on at least one surface of the steel sheet.

20. The surface treated steel sheet of claim 19, wherein the diffused alloy layer further contains at least one element selected from the group consisting of N, Mo, Cr and Cu.

21. A surface treated steel sheet comprising:

a steel sheet consisting essentially of:

0.002 to 0.01 wt. % C, 1 wt. % or less Si, 0.05 to 1 wt. % Mn, 0.02 to 0.1 wt. % P, 0.01 wt. % or less S, 0.1 wt. % or less sol.Al, 0.004 wt. % or less N, 0.0005 to 0.002 wt. % B, 0.2 to 0.5 wt. % Cu, 0.1 to 0.5 wt. % Ni, 0.002 to 0.05 wt. % Sn, and at least one element selected from the group consisting of 0.005 to 0.1 wt. % Ti and 0.002 to 0.05 wt. % Nb, and the balance being Fe;

the steel having the composition satisfying the following equation:

$$2 \leqq 1000 \times Sn \text{ wt. } \% \times (2 \times P \text{ wt. } \% + Cu \text{ wt. } \% + Ni \text{ wt. } \%) \leqq 20;$$

a diffused alloy layer containing Fe, Ni and P, the diffused alloy layer being formed on at least one surface of the steel sheet; and a zinc-system coating layer formed on the diffused alloy layer.

22. The surface treated steel sheet of claim 21, wherein the zinc-system coating layer is a zinc coating layer.

23. The surface treated steel sheet of claim 21, wherein the zinc-system coating layer contains Zn as matrix and at least one metal selected from the group consisting of Ni, Fe, Co, Mn, Ti, Mo, Si, and Al as an alloy.

24. The surface treated steel sheet of claim 21, wherein the zinc-system coating layer contains Zn as matrix and at least one oxide of Ni, Fe, Co, Mn, Ti, Mo, Si, and Al as dispersed particles.

25. The surface treated steel sheet of claim 21, wherein the diffused alloy layer further contains at least one element selected from the group consisting of W, No, Cr, and Cu.

* * * * *